US009352201B2

(12) United States Patent
Query, Jr. et al.

(10) Patent No.: US 9,352,201 B2
(45) Date of Patent: May 31, 2016

(54) ROTATING FOOTBALL GOALPOST AND METHOD OF RETROFITTING AN EXISTING FOOTBALL GOALPOST

(75) Inventors: William Kress Query, Jr., Matthews, NC (US); Larry Theodore Tucker, Oakboro, NC (US); Timothy Harold Wallace, Charlotte, NC (US); Christopher Charles Cucchiara, Statesville, NC (US); Christopher Edward Brafford, Mooresville, NC (US); Frank Sherrill, Statesville, NC (US)

(73) Assignee: ABT, INC., Troutman, NC (US)

( * ) Notice: Subject to any disclaimer, the term of this patent is extended or adjusted under 35 U.S.C. 154(b) by 520 days.

(21) Appl. No.: 13/038,303

(22) Filed: Mar. 1, 2011

(65) Prior Publication Data

US 2011/0269580 A1 Nov. 3, 2011

Related U.S. Application Data

(63) Continuation-in-part of application No. 12/337,268, filed on Dec. 17, 2008.

(60) Provisional application No. 61/339,153, filed on Mar. 1, 2010.

(51) Int. Cl.

| | |
|---|---|
| ***A63B 63/00*** | (2006.01) |
| ***A63B 71/00*** | (2006.01) |
| ***A63B 63/06*** | (2006.01) |

(52) U.S. Cl.

CPC ..... *A63B 63/008* (2013.01); *A63B 63/06* (2013.01); *Y10T 29/49716* (2015.01)

(58) Field of Classification Search

CPC ..... A63B 63/04
USPC ..... 473/477; 464/76; 440/83; 384/549; 318/55; 312/292; 211/144; 119/704; 472/1, 14, 18, 24

See application file for complete search history.

(56) References Cited

U.S. PATENT DOCUMENTS

| | | | | |
|---|---|---|---|---|
| 263,415 | A | | 8/1882 | Lightburne, Jr. |
| 333,210 | A | * | 12/1885 | Fisher ..... 108/60 |
| 421,532 | A | | 2/1890 | Van Dorn |
| 519,311 | A | | 5/1894 | Andrew et al. |
| 648,512 | A | | 5/1900 | Manley |

(Continued)

OTHER PUBLICATIONS

Roya12013, 2004-2013, Screenshots from Royal High School 2003-2004 highlights and screen shots of playing area, 12 pages.*

(Continued)

*Primary Examiner* — Gene Kim
*Assistant Examiner* — M Chambers

(57) ABSTRACT

A rotatable football goalpost is provided comprising a mounting structure; a gooseneck, the gooseneck comprising an outer tubular member having first and second portions, each of the first and second portions of the outer tubular member having first and second ends, the first end of the first portion of the outer tubular member being secured to the mounting structure, the second end of the first portion of the outer tubular member releasably engaging the first end of the second portion of the outer tubular member such that the second portion of the outer tubular member is structured to rotate relative to the first portion of the outer tubular member; a cross bar attached to the second end of the second portion of the outer tubular member; and a pair of upright members extending from the cross bar.

16 Claims, 45 Drawing Sheets

(56) References Cited

U.S. PATENT DOCUMENTS

| | | | | | |
|---|---|---|---|---|---|
| 1,071,585 | A | | 9/1913 | Rossell | |
| 1,267,117 | A | * | 5/1918 | Riotte | 440/83 |
| 1,540,490 | A | * | 6/1925 | Mertel | 49/381 |
| 1,645,218 | A | * | 10/1927 | Boye | 312/234 |
| 1,720,397 | A | * | 7/1929 | Hainke | 472/14 |
| 2,074,125 | A | | 4/1937 | Leffet et al. | |
| 2,151,146 | A | * | 3/1939 | Petry | 366/331 |
| 2,175,752 | A | | 10/1939 | Gray | |
| 2,246,891 | A | | 6/1941 | Moise | |
| 2,521,368 | A | * | 9/1950 | Hingerty | 440/83 |
| 2,567,243 | A | | 9/1951 | Smith | |
| 2,655,416 | A | * | 10/1953 | Annen | 384/415 |
| 2,694,540 | A | | 11/1954 | Pfaff | |
| 2,701,605 | A | | 2/1955 | Belmont | |
| 2,991,495 | A | | 7/1961 | Blalack | |
| 3,073,595 | A | * | 1/1963 | Jones | 472/18 |
| 3,083,680 | A | * | 4/1963 | Willis, Jr. et al. | 440/83 |
| 3,138,010 | A | * | 6/1964 | Shipley et al. | 464/158 |
| 3,209,720 | A | * | 10/1965 | Campbell et al. | 440/83 |
| 3,288,438 | A | * | 11/1966 | Baas | 254/354 |
| 3,345,826 | A | | 10/1967 | Hignite | |
| 3,443,827 | A | | 5/1969 | Boezi et al. | |
| 3,462,140 | A | * | 8/1969 | Halaj | 472/18 |
| 3,516,666 | A | | 6/1970 | Rottman et al. | |
| 3,550,938 | A | | 12/1970 | Cunningham, Jr. | |
| 3,802,653 | A | | 4/1974 | Nyulassie | |
| 3,820,787 | A | | 6/1974 | Heinbigner | |
| 3,856,302 | A | | 12/1974 | Karkoska | |
| 3,981,501 | A | | 9/1976 | Gonzalez et al. | |
| 4,173,376 | A | * | 11/1979 | Standing et al. | 384/517 |
| 4,278,289 | A | * | 7/1981 | Esposito | 297/188.12 |
| 4,820,211 | A | * | 4/1989 | Onoue | 440/83 |
| 4,949,525 | A | | 8/1990 | Weaver | |
| 5,037,093 | A | | 8/1991 | Roark, Jr. | |
| 5,060,989 | A | | 10/1991 | Gallucci et al. | |
| 5,332,196 | A | | 7/1994 | Wright | |
| 2,216,408 | A | | 10/1994 | Elmer | |
| 5,513,843 | A | | 5/1996 | Russell | |
| 5,584,480 | A | | 12/1996 | Grimsrud | |
| 5,685,343 | A | | 11/1997 | Smith | |
| 6,202,639 | B1 | | 3/2001 | Partee et al. | |
| 6,375,585 | B1 | | 4/2002 | Driscoll | |
| 6,389,917 | B1 | | 5/2002 | Oberle | |
| 6,394,917 | B1 | | 5/2002 | Chiappini et al. | |
| 6,585,601 | B2 | * | 7/2003 | Booker et al. | 464/146 |
| 6,915,913 | B2 | | 7/2005 | Cardinell | |
| 6,945,885 | B2 | | 9/2005 | Snider | |
| 7,014,578 | B1 | * | 3/2006 | Brodeur | 473/477 |
| 7,278,894 | B2 | * | 10/2007 | Lyon et al. | 440/83 |
| 7,331,880 | B2 | | 2/2008 | Rogers | |
| 7,914,401 | B2 | | 3/2011 | Hulbert | |
| 2009/0156334 | A1 | | 6/2009 | Cucchiara et al. | |
| 2011/0269580 | A1 | * | 11/2011 | Query et al. | 473/477 |
| 2012/0052991 | A1 | * | 3/2012 | Hulbert et al. | 473/477 |

OTHER PUBLICATIONS

Design Specifications for Model #SEF305 High School 8 FT Football Goal, published prior to Jun. 28, 2007, 2 pages, United States.
WVU President Asks Fans to Behave, Pittsburgh Tribune Review—Sports, Nov. 1, 2003, 2 pages, Associated Press, United States.
Athletic Tools and Equipment, web pages from www.courtandsports.com, published prior to Jul. 17, 2007, 2 pages, United States.
Miscellaneous Hardware Specifications and Installation Instructions, published prior to Dec. 17, 2007, 6 pages, Sportsfield Specialties Inc., United States.
Hinged Goal Post—Gilman Gear Online Store, web pages from www.nexternal.com, published prior to Jul. 17, 2007, 2 pages, United States.
International Search Report and the Written Opinion of the International Searching Authority mailed Nov. 22, 2011 for International Application PCT/US2011/026746.
International Preliminary Report on Patentability issued on Sep. 4, 2012 for International Application PCT/US2011/026746.
Webpage, screen shots, Rogers, 2004, www.youtube.com/watch?v=0PZzd6QGSic; 10 pages.
Assembly Instructions, Sportsfield, 2010; 11 pages.
Mexican Patent Office. Mexican Office Action dated Dec. 17, 2014. Mexican Application No. MX/a/2012/010080. Name of Applicant: ABT, Inc. English Language. 5 pages.
Mexican Patent Office. Mexican Office Action dated Dec. 17, 2014. Mexican Application No. MX/a/2012/010080. Name of Applicant: ABT, Inc. Spanish Language. 5 pages.
U.S. Appl. No. 12/337,268, entitled: Football Goalpost Rotation Apparatus and Method; Filed: Dec. 17, 2008, Jun. 18, 2009, Christopher Charles Cucchiara et al.
Mexican Patent Office. Mexican Office Action dated Aug. 16, 2015. Mexican Patent Application No. MX/a/2014/014068. Name of Applicant: ABT, Inc. English Language. 2 pages.
Mexican Patent Office. Mexican Office Action dated Aug. 16, 2015. Mexican Patent Application No. MX/a/2012/010080. Name of Applicant: ABT, Inc. English Language. 5 pages.

* cited by examiner

| | ITEM | QTY | DESCRIPTION |
|---|---|---|---|
| | 1 | 2 | GOOSENECK ASSEMBLY (6" SCH 40 - ALUMINUM) |
| | 2 | 2 | CROSSBAR ASSEMBLY (6" SCH 40 - ALUMINUM) |
| | 3 | 4 | UPRIGHT ASSEMBLY (4" OD - ALUMINUM) |
| ALL IN ONE BOX (FOUNDATION PLATES BANDED ON TOP) | 4 | 1 | INSTALLATION KIT |
| | 5 | 2 | FOUNDATION PLATE (STEEL) |
| | 6 | 8 | TEE ANCHOR (3/4"-10 x 18" THD ROD - STAINLESS) |
| | 7 | 2 | INNER COVER - LARGE (3/4" TREATED PLYWOOD) |
| | 8 | 2 | INNER COVER - SMALL (3/4" TREATED PLYWOOD) |
| | 9 | 2 | OUTER COVER - LARGE 1/2" TREATED PLYWOOD) |
| | 10 | 2 | OUTER COVER - SMALL 1/2" TREATED PLYWOOD) |
| | 11 | 12 | ANGLE - COVER (ALUMINUM) |
| | 12 | 36 | WOOD SCREW (#7 x 3/4" - 82° PHILLIPS - ZINC PLT) |
| | 13 | 8 | HEX BOLT (1/2"-13 x 1-1/2"- FULL THD - ZINC PLT) |
| | 14 | 8 | LOCK WASHER (1/2"-STAINLESS) |
| | 15 | 24 | HEX NUT (3/4"-10 STAINLESS) |
| | 16 | 8 | HEX BOLT (3/4"-10 x 2" - FULL THD - GALVANIZED) |
| | 17 | 8 | HEX BOLT (3/4"-10 x 4" - FULL THD - GALVANIZED) |
| | 18 | 16 | LOCK WASHER (3/4"-STAINLESS) |
| | 19 | 16 | FLAT WASHER (3/4" - STAINLESS) |
| | 20 | 1 | TOUCH-UP SPRAY PAINT (NOT SHOWN) |
| | 21 | 1 | INSTALLATION INSTRUCTIONS (NOT SHOWN) |
| IN A BAG | 22 | 4 | FLAG (STREAMER) |
| | 23 | 4 | HEX BOLT (3/8"-16 x 1-1/2" - PARTIAL THD - ZINC PLATE) |
| | 24 | 4 | FLAT WASHER (3/8" - ZINC PLT) |
| | 25 | 4 | HEX NUT (3/8"-16 - ZINC PLT) |

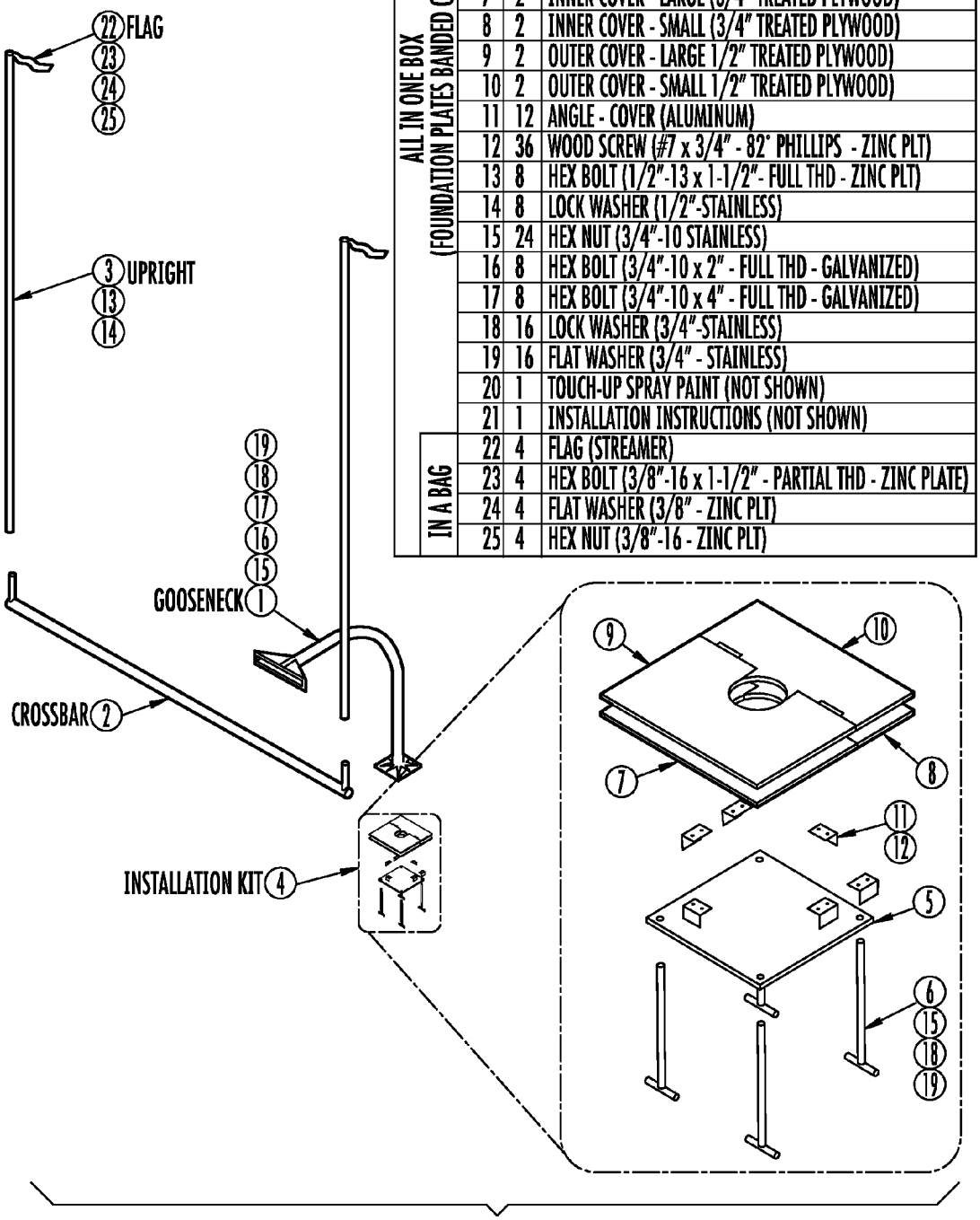

FIG. 1

FOUNDATION PLATE

PARTS LIST:
(1) Steel Foundation Plate - 1/2" thick x 20" square
(4) Stainless Anchor Bolts - 3/4" - 10 x18" long
(4) 3/4" Flat Washers
(8) 3/4"-10 Hex Nuts

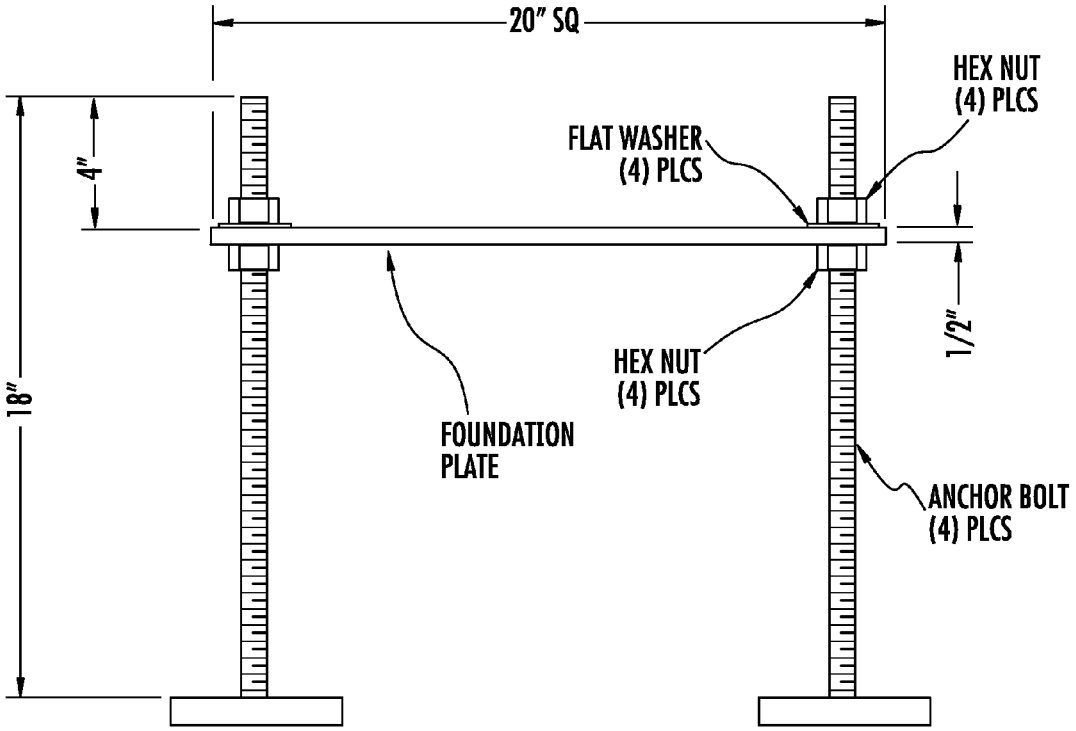

THREAD NUT ONTO EACH ANCHOR BOLT LEAVING 4-1/2" OF THREAD EXPOSED ABOVE NUT. THREAD ANCHOR BOLTS INTO FOUNDATION PLATE UNTIL NUT JAMS AGAINST PLATE WITH 4" OF THREAD EXPOSED ABOVE THE TOP OF THE PLATE AS SHOWN. ORIENTATION OF ANCHOR BOLT "TEE" IS NOT REQUIRED. PLACE FLAT WASHERS AND NUTS AS SHOWN ABOVE TEMPORARILY TO PROTECT THREADS FROM CONCRETE SLURRY. PROTECT EXPOSED THREADS FROM DAMAGE AS NEEDED.

FIG. 3

LOCATE THE POSITION OF THE GOAL FOUNDATION ACCORDING TO PLANS AND SPECIFICATIONS. EXCAVATE AS NECESSARY, FOR A CONCRETE FORM SIZE OF 36" DIAMETER AND 60" DEEP MINIMUM. A 40 " DIAMETER CARDBOARD TUBE FORM IS RECOMMENDED. CENTER THE FOUNDATION PLATE AND ANCHORS WITHIN THE FORM. THE TOP OF THE FOUNDATION PLATE SHOULD BE 6-3/4" BELOW THE FINISHED FIELD SURFACE.

FOUNDATION ORIENTATION

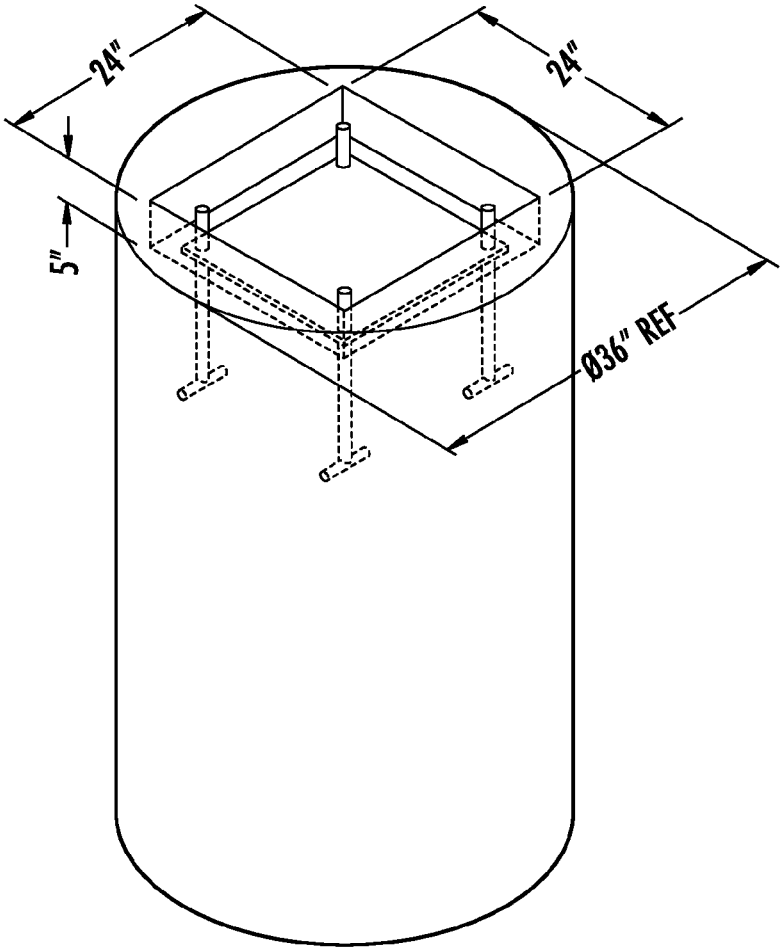

SPECIAL ATTENTION SHOULD BE PAID TO ORIENTATION OF FOUNDATION PLATE.
FOUNDATION PLATE HOLE PATTERN MUST BE SQUARE TO THE END ZONE LINE.
THE TOP OF FOUNDATION PLATE SHOULD BE 6-3/4" BELOW THE FINISHED FIELD SURFACE, OR TOP OF INFILL MATERIAL.
IT IS SUGGESTED THAT A LEDGE OR SHOULDER BE FORMED TO SUPPORT AND RETAIN BASE PLATE ACCESS COVERS (SEE ILLUSTRATIONS SHEET 6 & 7).
TIME SPENT ACCURATELY LOCATING FOUNDATION PLATE AND ANCHORS WILL SIMPLIFY FINAL ASSEMBLY ALIGNMENT.

FIG. 5

GOOSENECK ASSEMBLY INSTALLATION

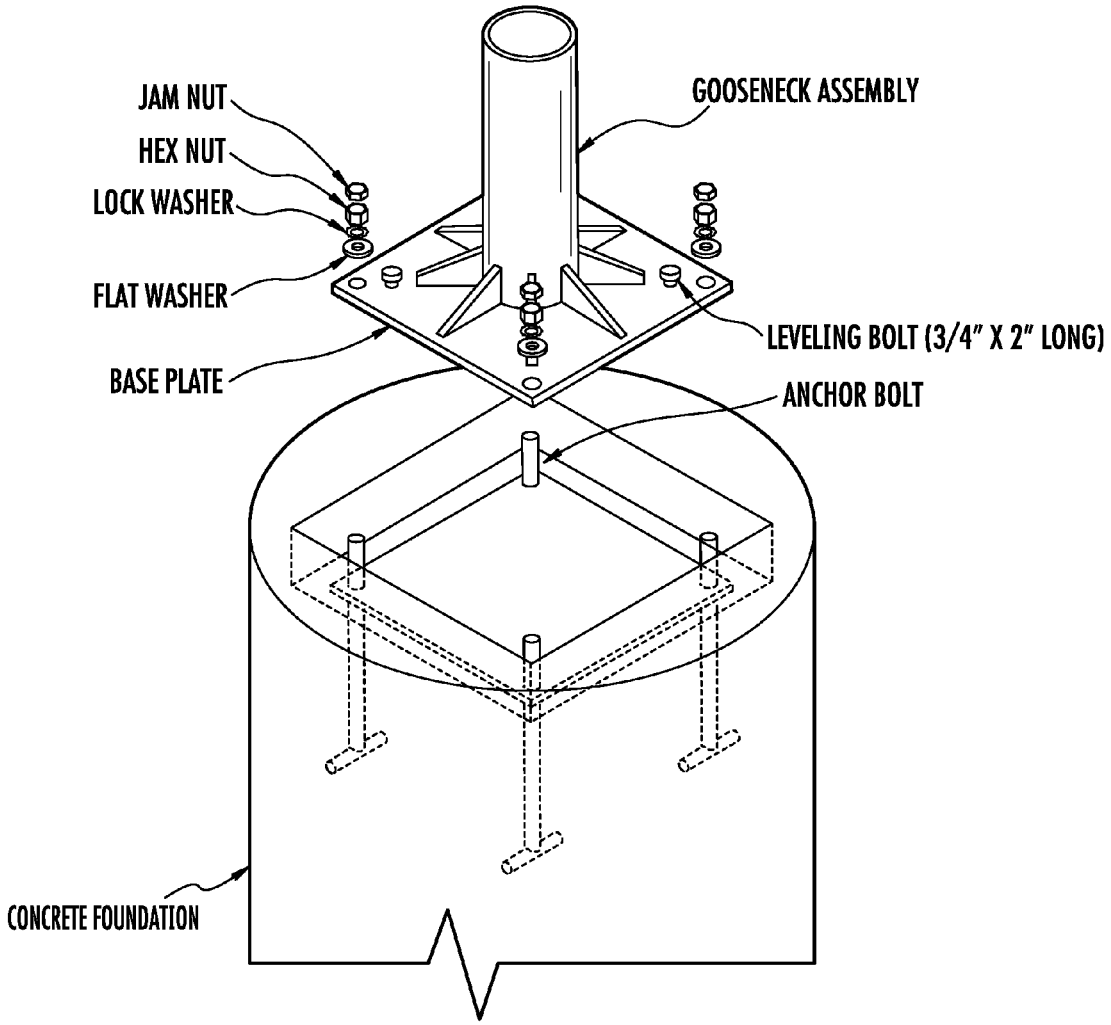

REMOVE PROTECTIVE COVERING OF ANCHOR BOLT THREAD. REMOVE HEX NUTS AND FLAT WASHERS, INSPECT THREADS, REPAIR AND CLEAN AS NECESSARY. THREAD LEVELING BOLTS INTO GOOSENECK BASE PLATE, THREAD IS TO BE FLUSH TO BOTTOM OF BASE PLATE TO START. POSITION GOOSENECK ASSEMBLY OVER ANCHOR BOLTS AND INSTALL FLAT WASHERS, LOCK WASHERS, AND NUTS ON TO ANCHOR BOLTS. ADJUST LEVELING BOLTS AS NECESSARY TO ACHIEVE POST PERPENDICULARITY IN ALL PLANES. ADJUSTMENT PROCEDURE: SCREW IN OR OUT LEVELING BOLTS FORCING GOOSENECK BASE PLATE AGAINST NUTS AND WASHERS OF ANCHOR BOLTS. TIGHTEN OR LOOSEN NUTS UNTIL POST IS TRUE. ASSURE ALL FOUR LEVELING BOLTS ARE TIGHT. INSTALL EXTRA HEX NUTS AS JAM NUTS TO SECURE.

FIG. 6

BASE PLATE ACCESS COVERS
ATTACH SYNTHETIC TURF TO OUTER COVERS

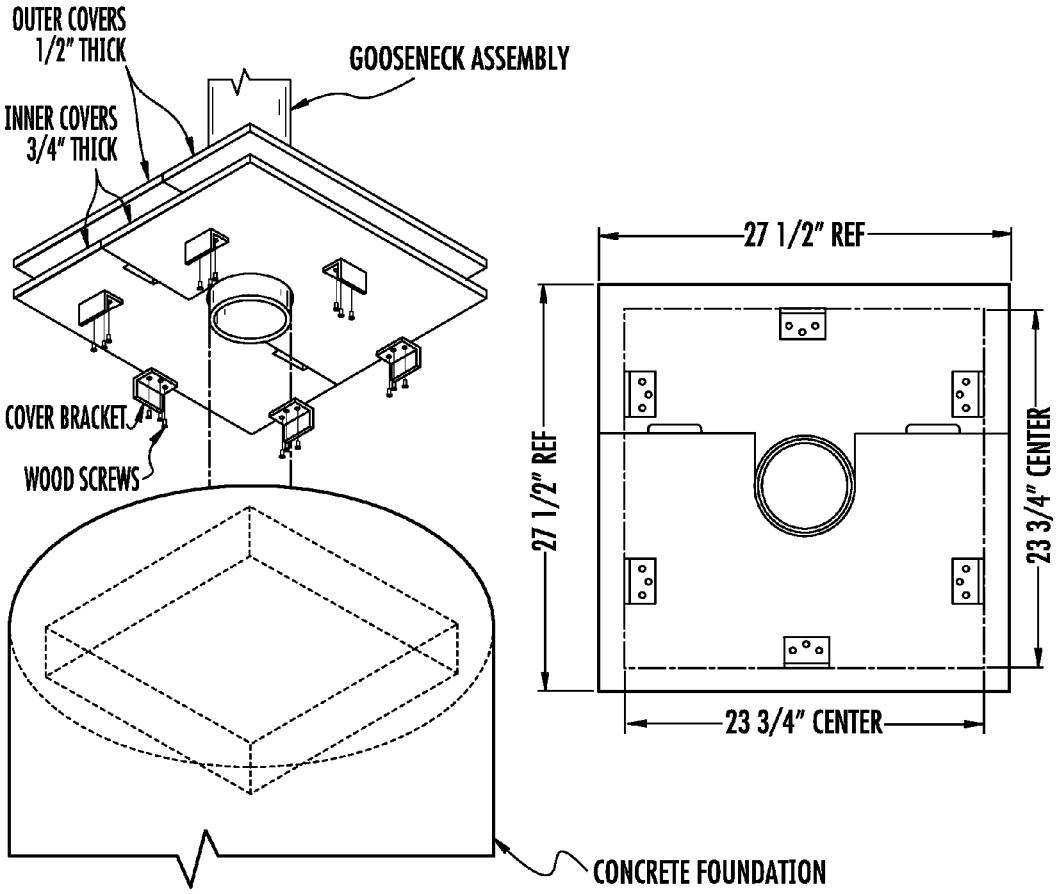

ALIGN INNER COVERS (3/4" THICK) AND LAYOUT AND ATTACH BRACKETS AS SHOWN ABOVE. THESE WILL LOCATE INNER COVERS AROUND GOAL POST AND SUPPORT OUTER COVERS (1/2" THICK). THE TOP OF OUTER COVERS SHOULD BE FLUSH WITH FINISHED FIELD SURFACE. SYNTHETIC TURF MAY BE ATTACHED TO THIS SURFACE WITH ADHESIVE OR STAPLES. NOTE, COVERS ARE ROTATED OPPOSITE EACH OTHER FOR IMPROVED SUPPORT.

FIG. 7

UPRIGHT ASSEMBLY INSTALLATION

SLIDE UPRIGHT ASSEMBLY ON TO CROSSBAR MOUNTING SLEEVE ALIGNING HOLES. INSTALL HEX BOLTS AND LOCK WASHERS AS SHOWN. HEX BOLTS 1/2" X 1-1/2" LONG (FULL THREAD). PERPENDICULARITY OF UPRIGHT DEPENDS UPON ADJUSTMENTS OF BASE PLATE (SEE SHT 4).

FLAG (STREAMER) ASSEMBLY INSTALLATION

FLAG (STREAMER) SHOULD ROTATE FREELY ABOUT HEX BOLT AFTER ASSEMBLY

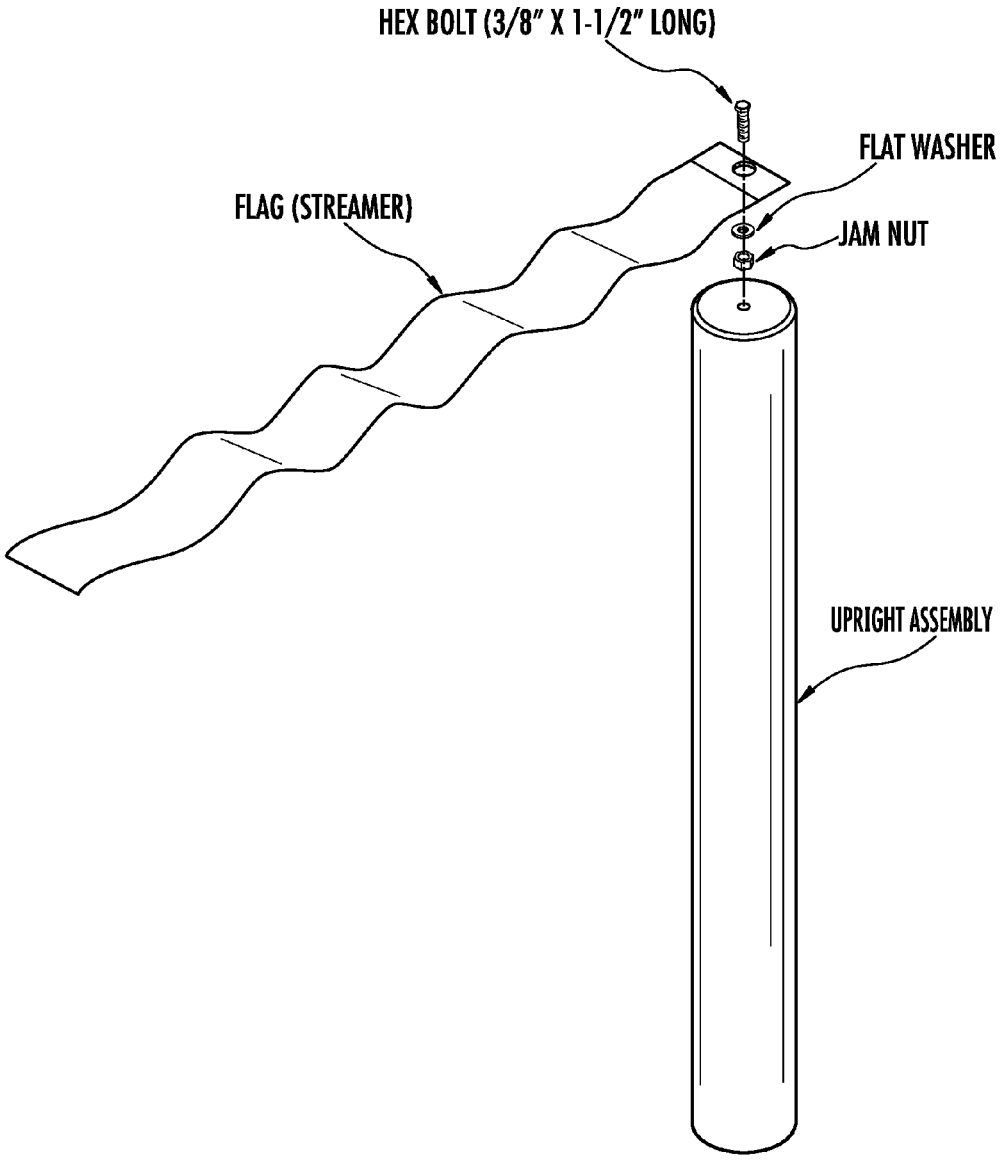

PLACE HEX THRU FLAG (STREAMER) GROMMET. SLIDE FLAT WASHER ONTO HEX BOLT. THREAD HEX NUT ONTO BOLT UNTIL REACHING END OF BOLT THREAD. THREAD ASSEMBLED PARTS INTO POLE END CAP UNTIL NUT BOTTOMS OUT, THEN TIGHTEN NUT WITH WRENCH. FLAG (STREAMER) SHOULD ROTATE FREELY ABOUT BOLT.

FIG. 10

HELLAS MODEL #7850
FOOTBALL GOAL DIMENSIONS

| | ITEM | QTY | DESCRIPTION |
|---|---|---|---|
| SLEEVED | 1 | 2 | GROUND SLEEVE ASSEMBLY (STEEL) |
| | 2 | 2 | GOOSENECK ASSEMBLY (6-5/8" OD - ALUMINUM) |
| | 3 | 2 | CROSSBAR ASSEMBLY (6-5/8" OD - ALUMINUM) |
| | 4 | 4 | UPRIGHT ASSEMBLY (4" OD - ALUMINUM) |
| BOXED | 5 | 4 | ELBOW ASSEMBLY (ALUMINUM) |
| | 6 | 4 | THREADED ROD (5/8"11 X 10-3/4" LG - ZINC PLT) |
| | 7 | 4 | THREADED ROD (5/8"-11 X 7-7/8" LG - ZINC PLT) |
| | 8 | 8 | FLAT WASHER (5/8" X 1-3/4" OD - ZINC PLT) |
| | 9 | 16 | HEX JAM NUT (5/8" - 11 - ZINC PLT) |
| | 10 | 8 | HEX NUT (5/8"-11 - ZINC PLT) |
| | 11 | 12 | HEX BOLT (1/2"-13 X 7-1/2" LG - ZINC PLT - GR 5) |
| | 12 | 8 | HEX BOLT (1/2"-13 X 4-1/2" LG - ZINC PLT - GR 5) |
| | 13 | 12 | FLAT WASHER (1/2" X 1-1/16" OD - ZINC PLT) |
| | 14 | 8 | NYLOK HEX NUT - THIN (1/2" X 13 - ZINC PLT) |
| | 15 | 12 | NYLOK HEX NUT (1/2"-13 - ZINC PLT) |
| | 16 | 12 | SPRING PIN (3/8" X 1-1/2" ZINC PLT) |
| | 17 | 1 | TOUCH-UP SPRAY PAINT (NOT SHOWN) |
| | 18 | 1 | INSTALLATION INSTRUCTIONS (NOT SHOWN) |
| BAGGED | 19 | 4 | FLAG (STREAMER) |
| | 20 | 4 | HEX BOLT (3/8"-16 x 1-1/2" - PARTIAL THD - ZINC PLT) |
| | 21 | 4 | FLAT WASHER (3/8" - ZINC PLT) |
| | 22 | 4 | HEX NUT (3/8" - 16 - ZINC PLT) |

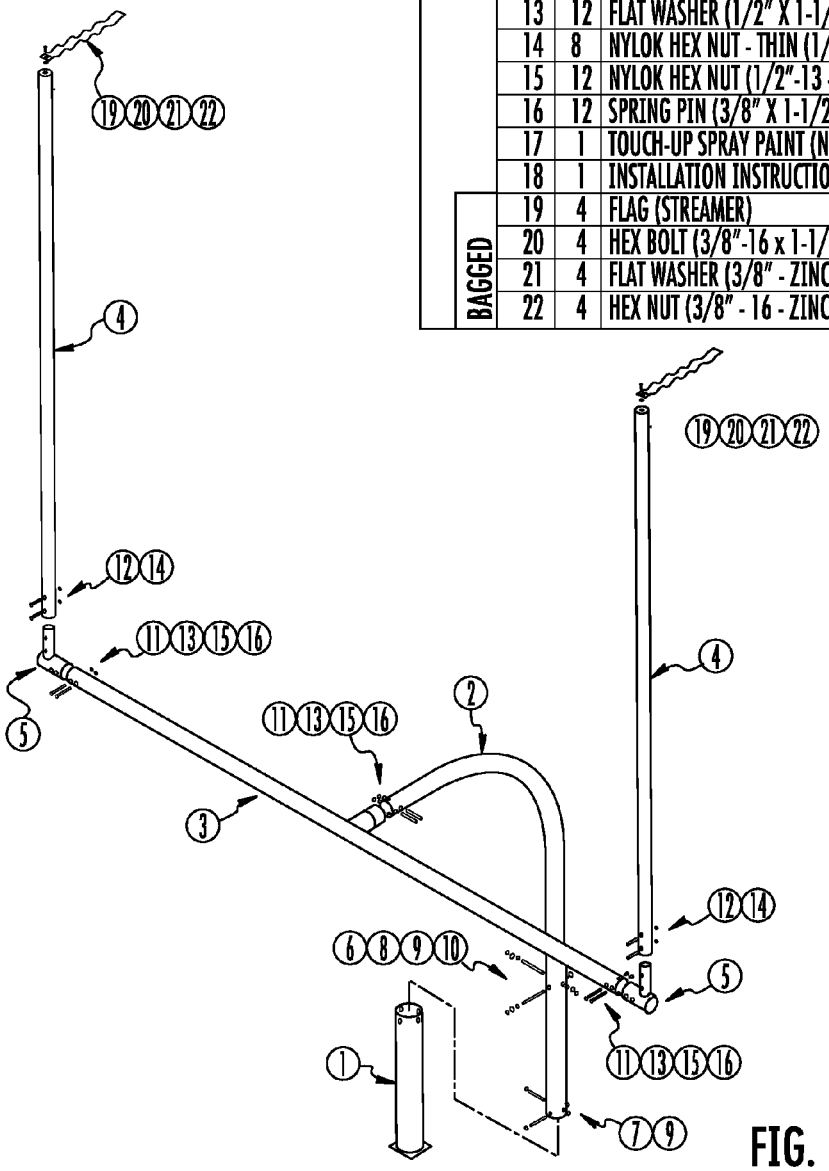

FIG. 12

GROUND SLEEVE ORIENTATION

GROUND SLEEVE & GOOSENECK ASSEMBLY

UPRIGHT & ELBOW ASSEMBLIES
MATCH DRILL & INSTALL PINS AFTER FINAL ASSEMBLY ALIGNMENT.

RIGHT SIDE

CROSS BAR ASSEMBLY
MATCH DRILL & INSTALL PINS AFTER FINAL ASSEMBLY ALIGNMENT

FLAG (STREAMER) ASSEMBLY INSTALLATION

FLAG (STREAMER) SHOULD ROTATE FREELY ABOUT HEX BOLT AFTER ASSEMBLY.

Material--- 6061-T6 Aluminum

Material--- 304 Stainless

Material--- Bearing Bronze

Material--- 6061-T6 Aluminum (Item #7B)
304 Stainless Steel (Item #75B)

Material--- 6061-T6 Aluminum (Item #7T)
304 Stainless Steel (item #7ST)

Material--- 304 Stainless

Material--- 6061-T6 Aluminum

ROTATING FOOTBALL GOALPOST AND METHOD OF RETROFITTING AN EXISTING FOOTBALL GOALPOST

CROSS REFERENCES TO RELATED APPLICATIONS

This application is a continuation in part of co-pending U.S. patent application Ser. No. 12/337,268, filed on Dec. 17, 2008, and entitled "FOOTBALL GOALPOST ROTATION APPARATUS AND METHOD", the entire contents of which are incorporated herein by reference. This application also claims priority to U.S. patent application Ser. No. 61/339,153 filed Mar. 1, 2010, and entitled "ROTATING FOOTBALL GOALPOST AND METHOD OF RETROFITTING AN EXISTING FOOTBALL GOALPOST", the entire contents of which are also incorporated herein by reference.

FIELD

The invention generally relates to the field of sporting goal structures and apparatus, and more particularly, embodiments of the present invention relate to a rotatable football goalpost and method for retrofitting existing football goalposts.

BACKGROUND

Football is an enormously popular sport in the United States. All across the country, playing fields are frequently designed to facilitate football games. A football field has a football goalpost located at each end of the playing field. As illustrated in FIGS. 2 and 13, a conventional football goalpost 10 generally has a U-shaped goal defined by a horizontal crossbar 12 and two vertical uprights 14. The goalpost 10 is usually supported by a tubular base 16, generally referred to as a gooseneck, extending up from the ground. FIGS. 1-10 and 11(*a*)-11(*c*) illustrate one embodiment of a plate-mounted version of a goalpost 10 in which the gooseneck 16 is secured (typically by welding) to a plate 18 that is in turn mounted on a concrete foundation 19 as shown in the corresponding Figures. FIGS. 12-15, 16(*a*)-16(*c*), 17-21, 22(*a*)-22(*b*), 23, and 24(*a*)-24(*b*) illustrate an embodiment of another version of a conventional football goalpost 10 in which the gooseneck 16 is mounted within a ground sleeve 15 secured within and partially buried in the ground as shown in the corresponding Figures. FIGS. 1 and 12 include a part list and corresponding reference numbers for each part. These reference numbers are provided for convenience only and are associated only with the corresponding FIG. 1 or 12, respectively, and are not used in any other the Figures or in the specification of this application.

As illustrated in FIG. 1(*b*), the gooseneck 16 typically is curved such that the crossbar 12 and two vertical uprights 14 are positioned approximately 8 to 9 feet from the central vertical axis 11 of the gooseneck adjacent the ground. In many instances, however, this configuration of the gooseneck 16 (and the football goalpost 10 itself, including, the crossbar 12 and vertical uprights 14) obstructs the ability of athletic facility personnel to convert a football field into a field suitable for other sporting events or purposes. This problem is particularly apparent when personnel must convert a football field into a soccer field. Because a soccer field is substantially the same size as a football field, the football goalposts 10 (which have no use in a soccer game) tend to be a nuisance. Although football goalposts 10 may be removed from the field by removing the goosenecks 16 from the ground sleeves 15 or by disconnecting the mounting plates 18 from their concrete foundations 19, the removal process can be time-consuming and labor intensive, which can be problematic when soccer and football games may be played back-to-back. As a result, and as illustrated in FIG. 41, personnel usually position each soccer goal 30 directly under each football goalpost 10. Positioned as such, the upper crossbar 32 of the soccer goal 30 is usually located only slightly below, e.g., approximately twenty-four inches or so below, the crossbar 12 of the football goalpost 10. This configuration has many drawbacks. For example, this configuration may make it difficult for soccer referees to distinguish between a soccer ball striking the crossbar 12 of the football goalpost 10 (out of bounds) and striking the upper crossbar 32 of the soccer goal 30 (in play).

Accordingly, there is a need to provide a football goalpost that enables facility personnel to quickly and easily move or otherwise reconfigure the goalpost such that the crossbar 12 of the football goalpost 10 is not positioned above or otherwise in the way of the soccer goal 30, including, without limitation, the upper crossbar 32 of a soccer goal.

BRIEF DESCRIPTION OF THE SEVERAL VIEWS OF THE DRAWINGS

Figure 2:
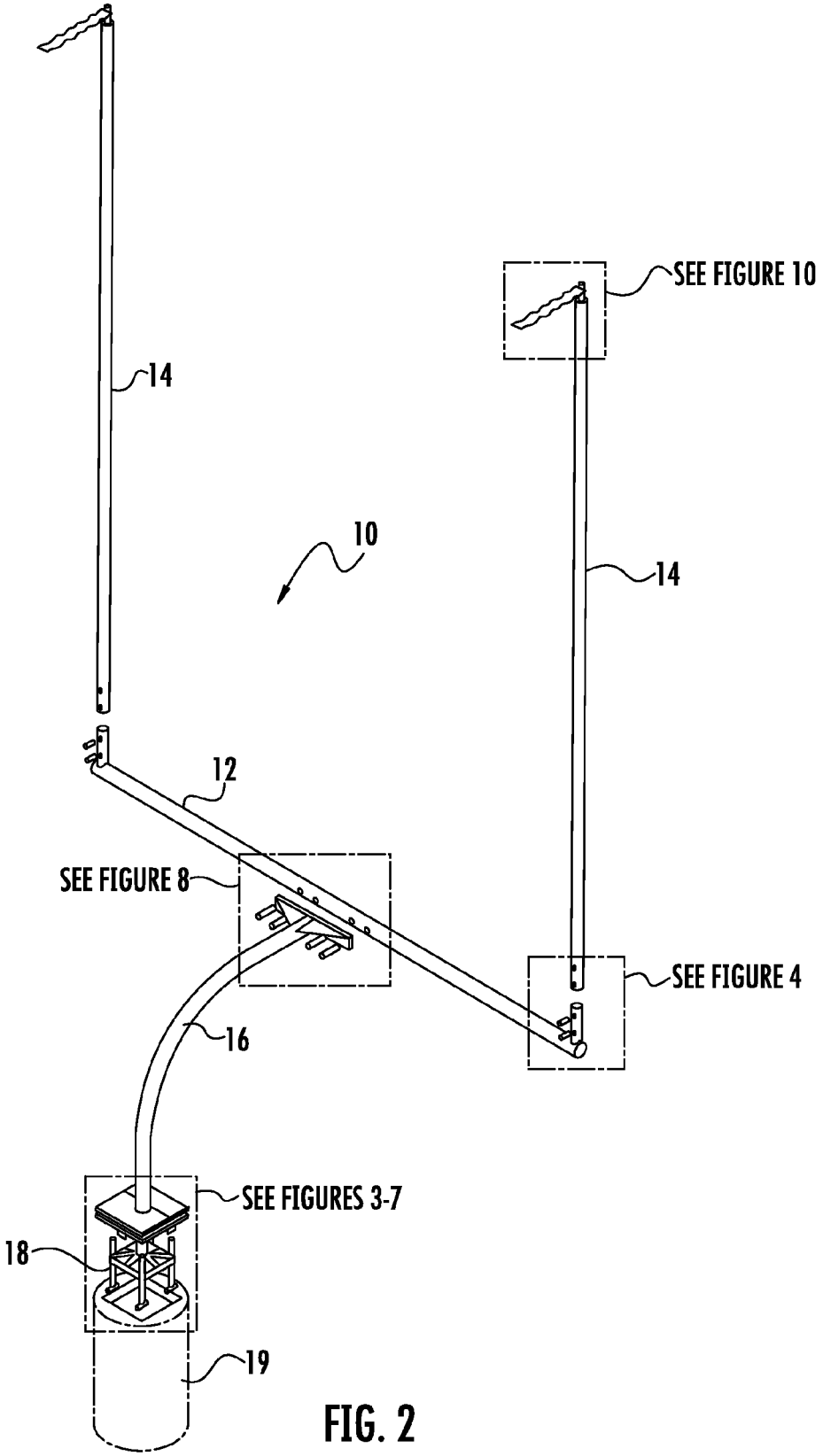
Figure 4:
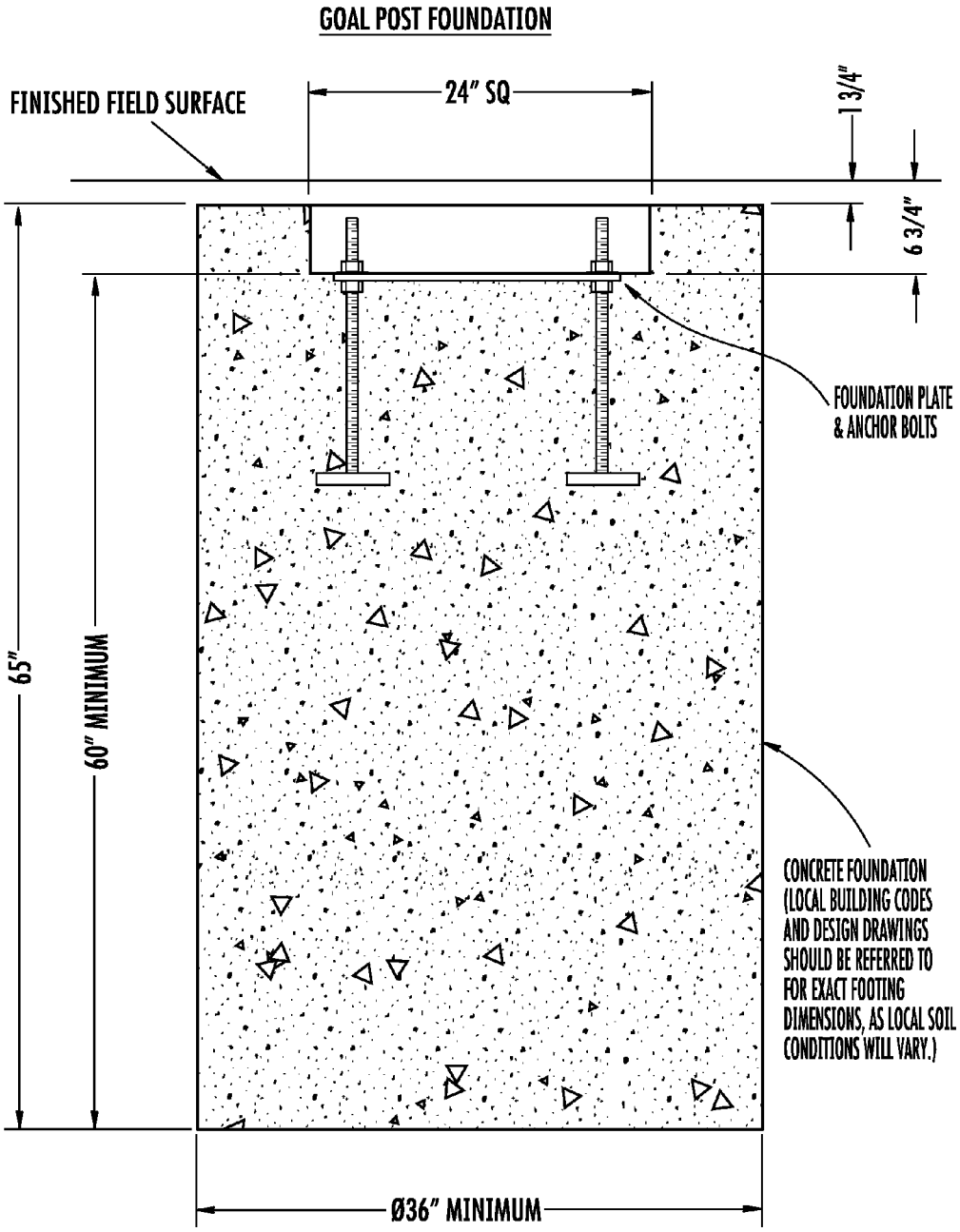
Figure 8:
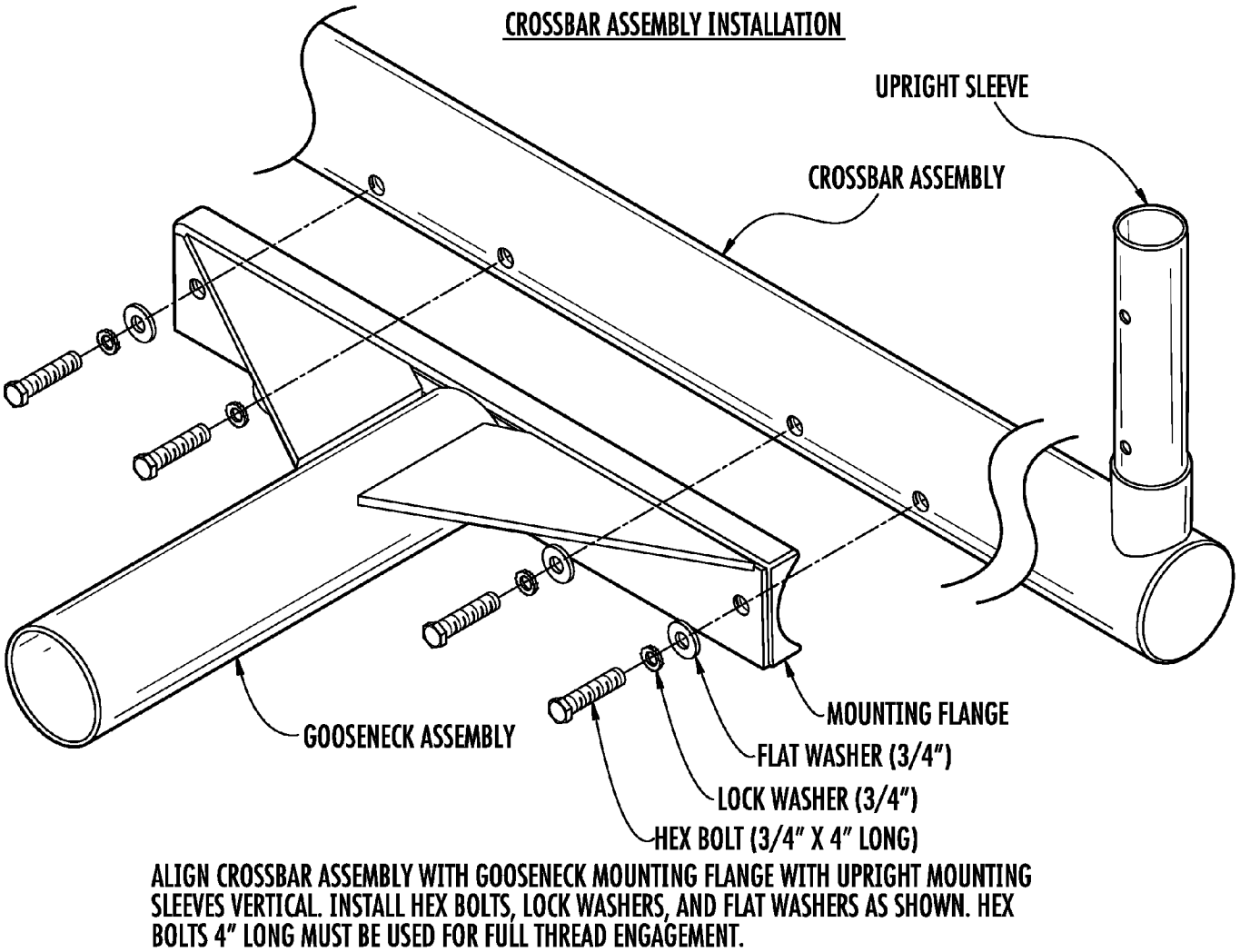
Figure 9:
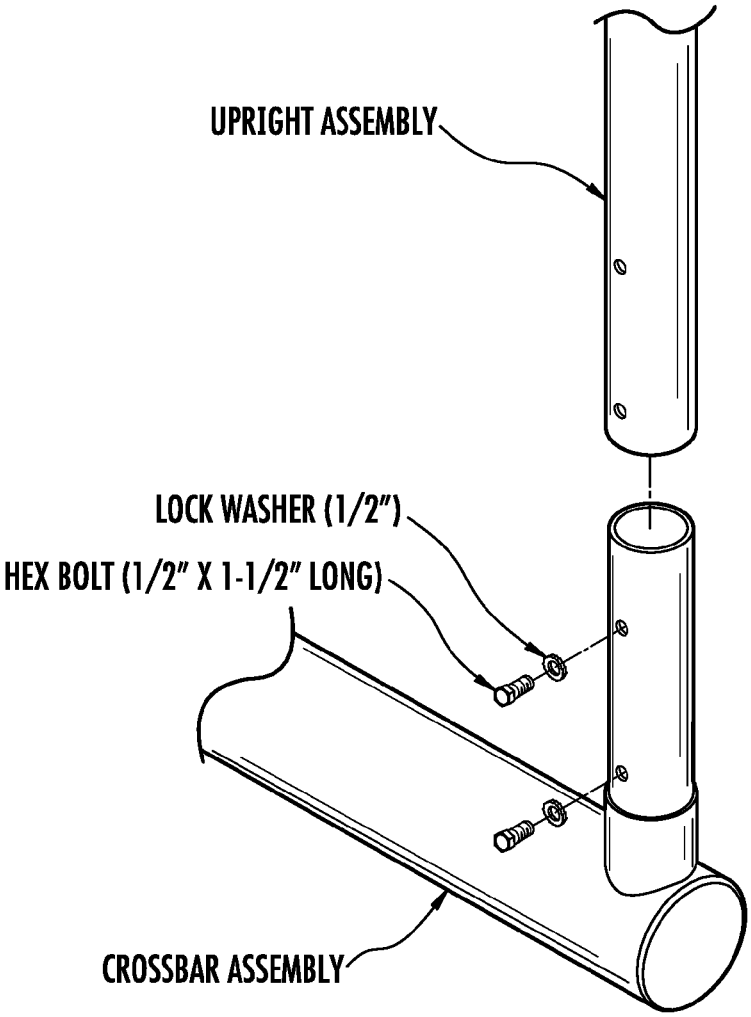
Figures 11A, 11B, 11C:
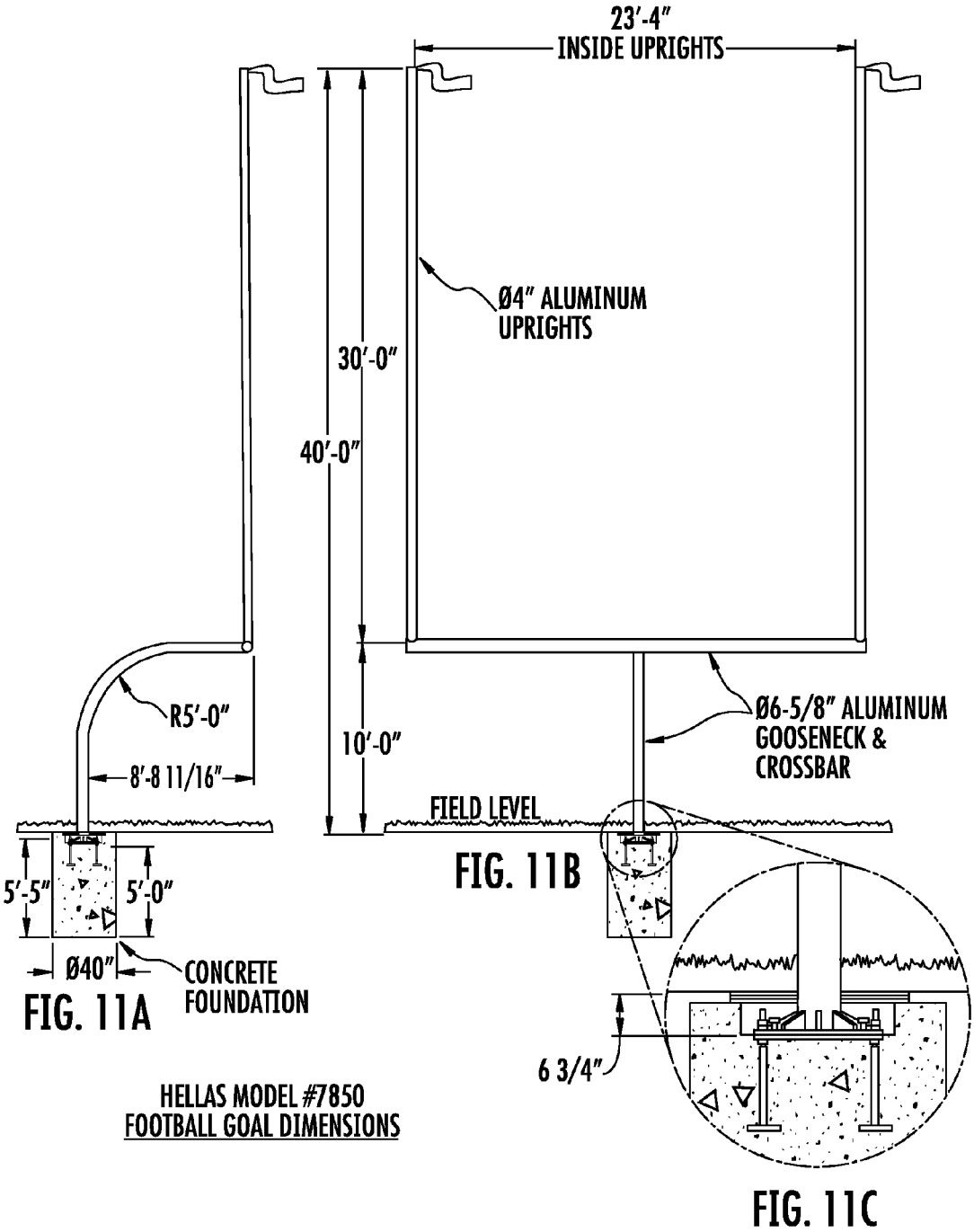
Figure 13:
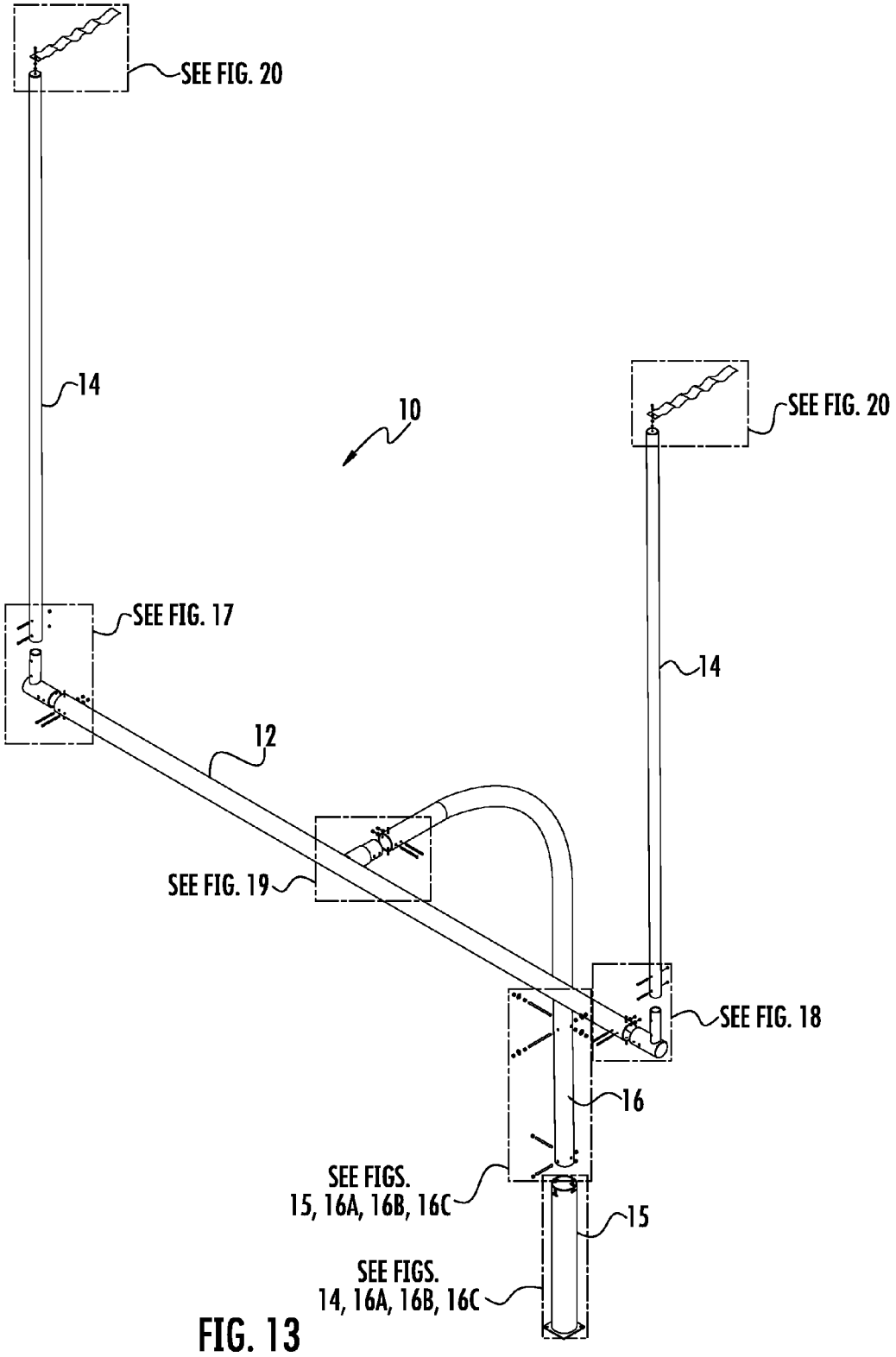
Figure 14:
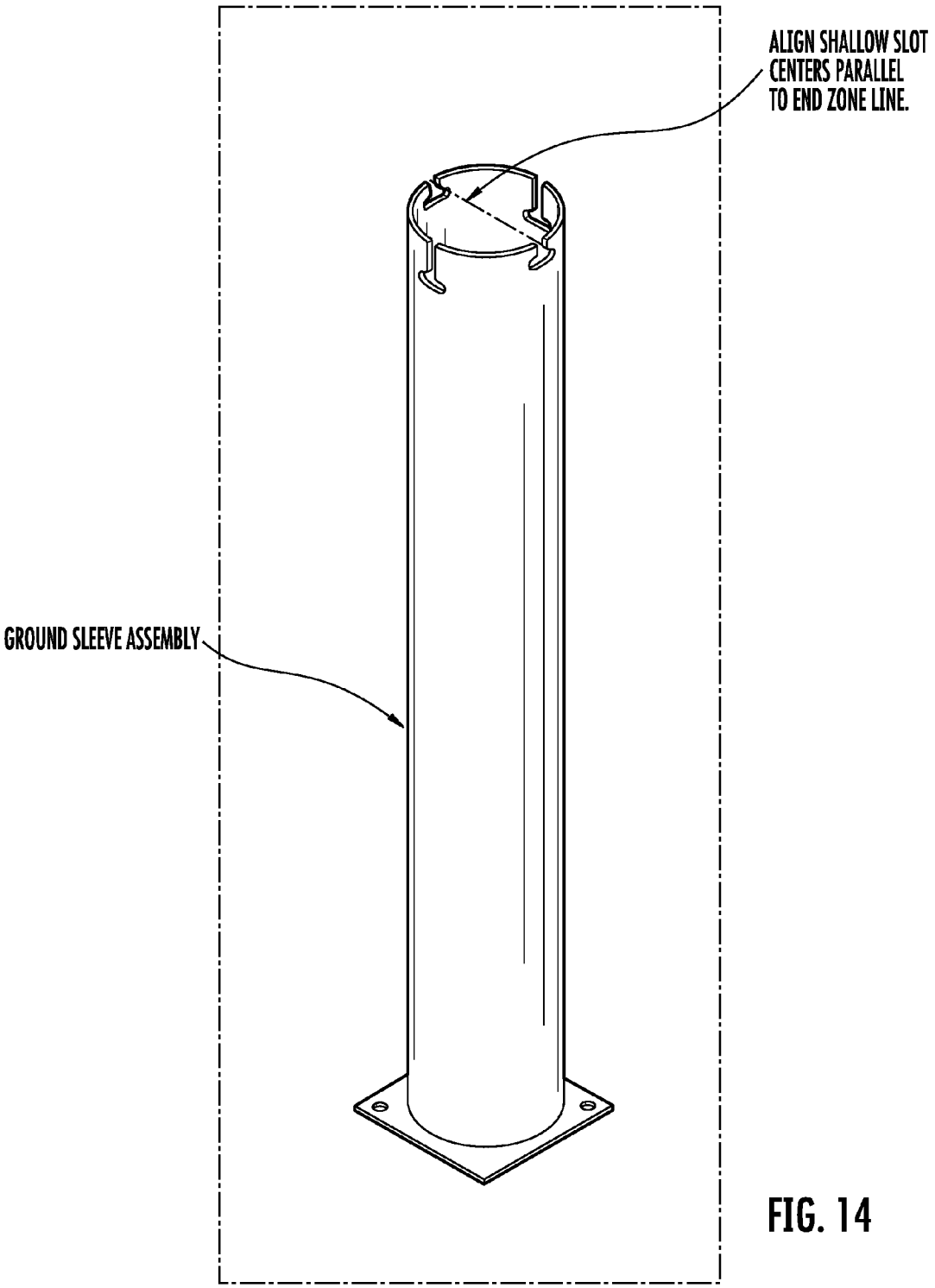
Figure 15:
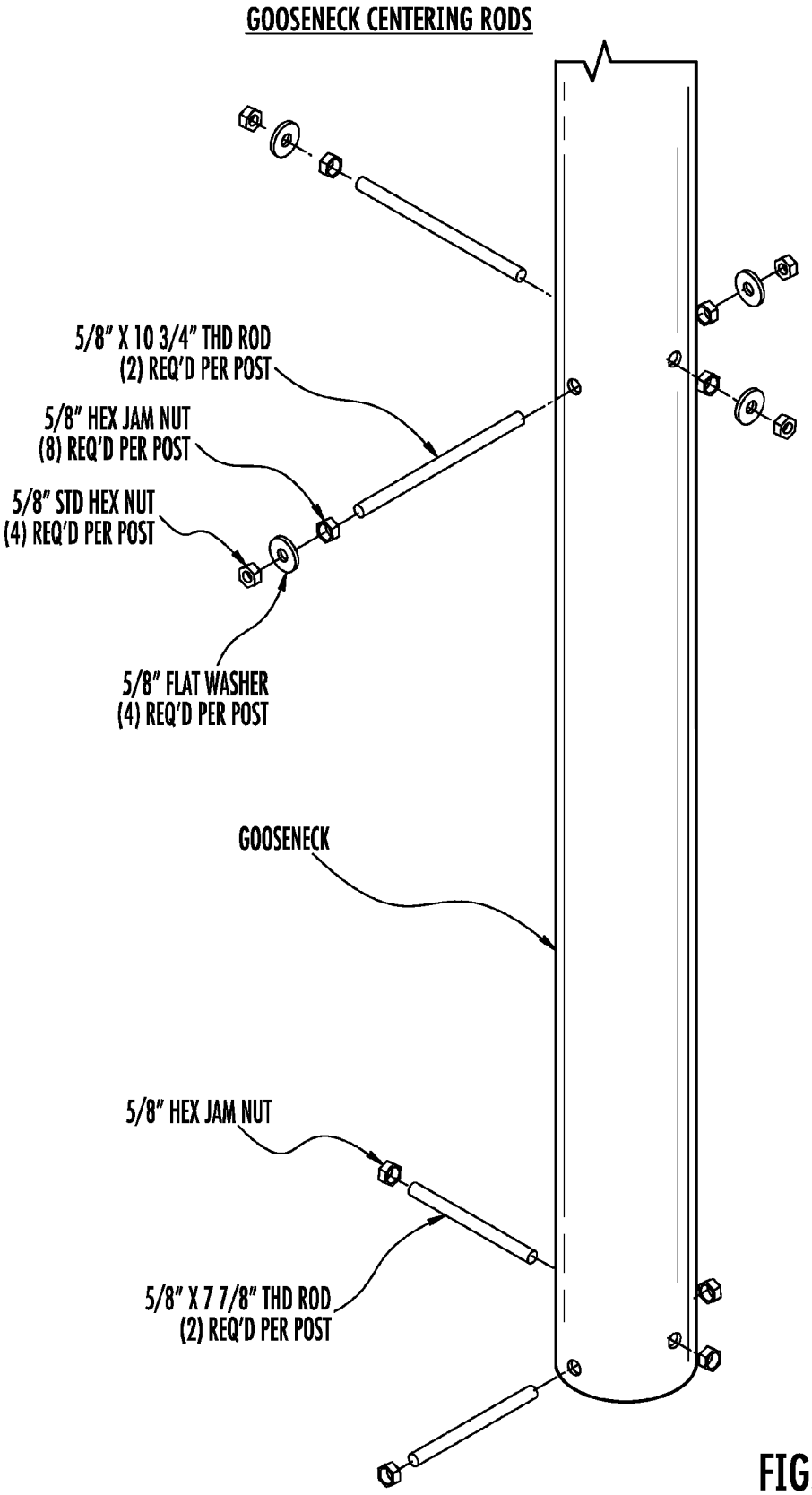
Figure 16:
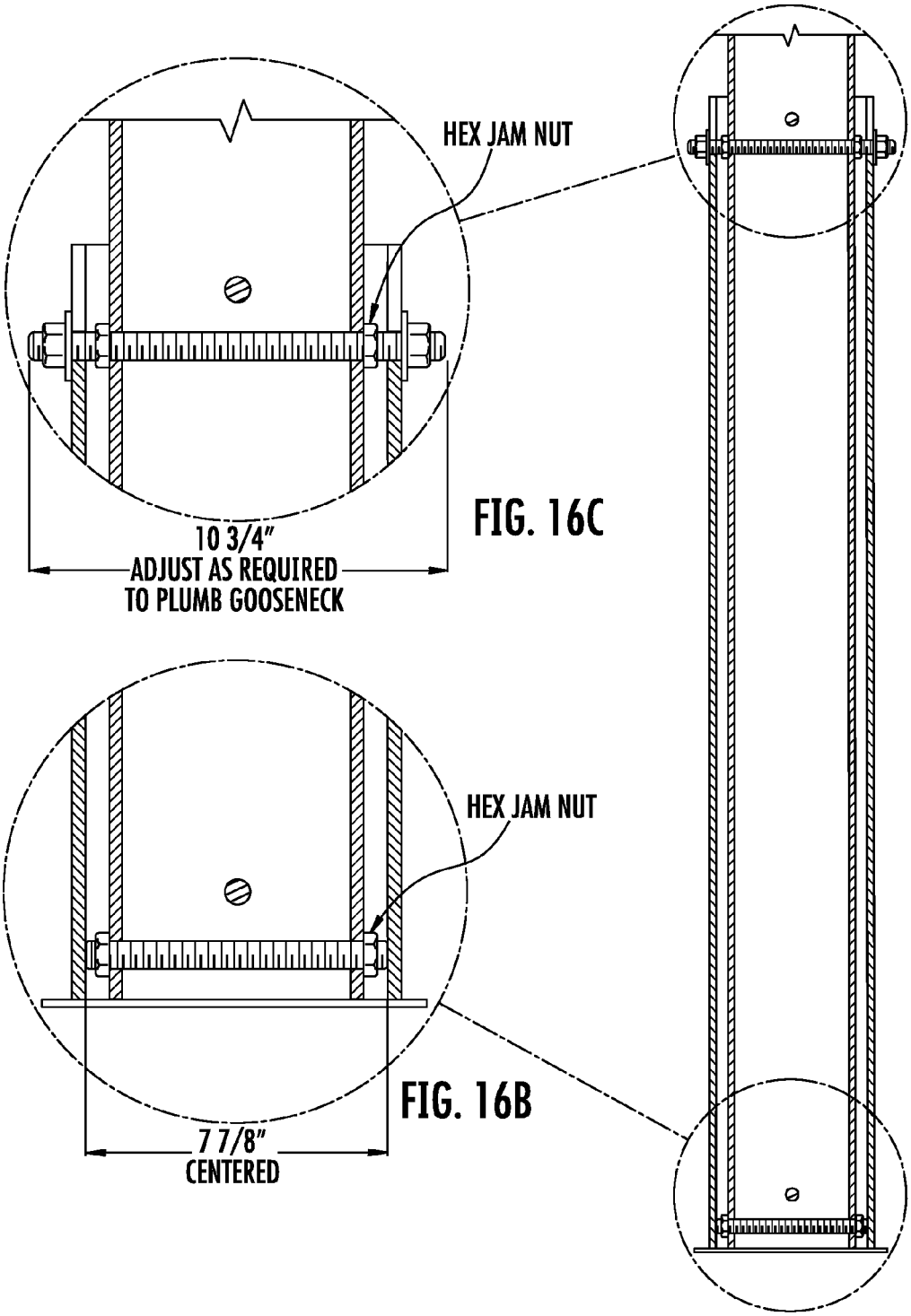
Figure 17:
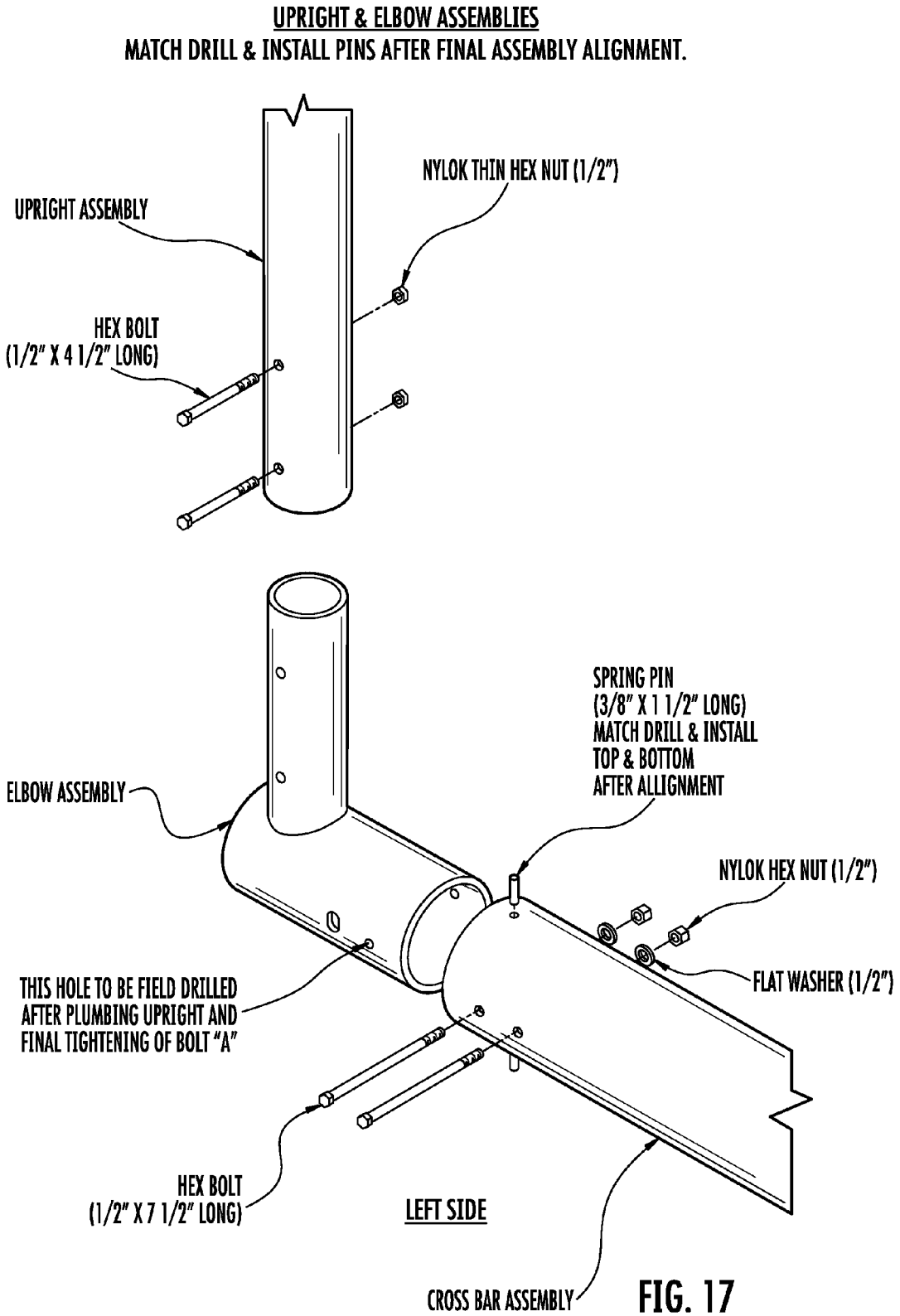
Figure 18:
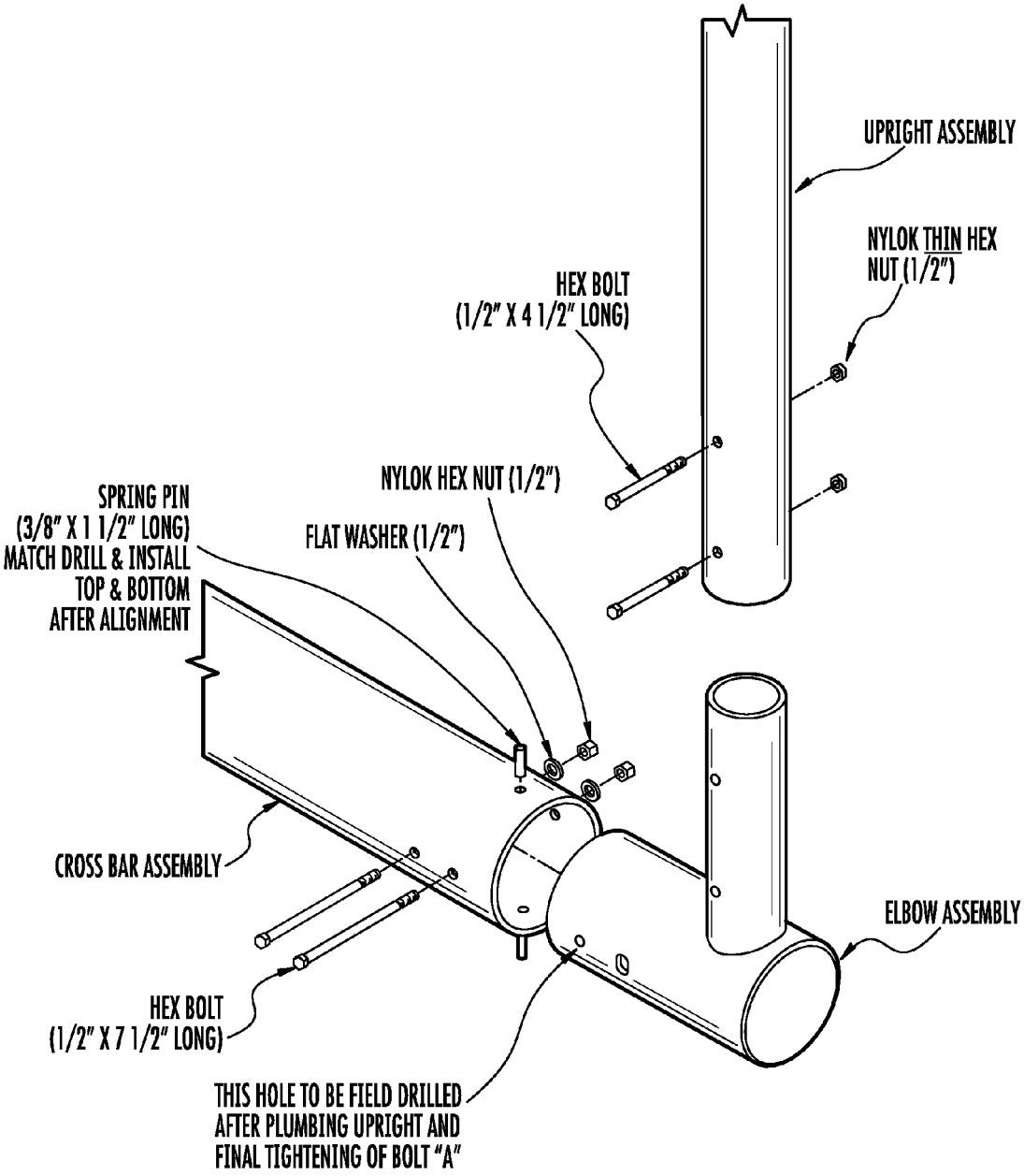
Figure 19:
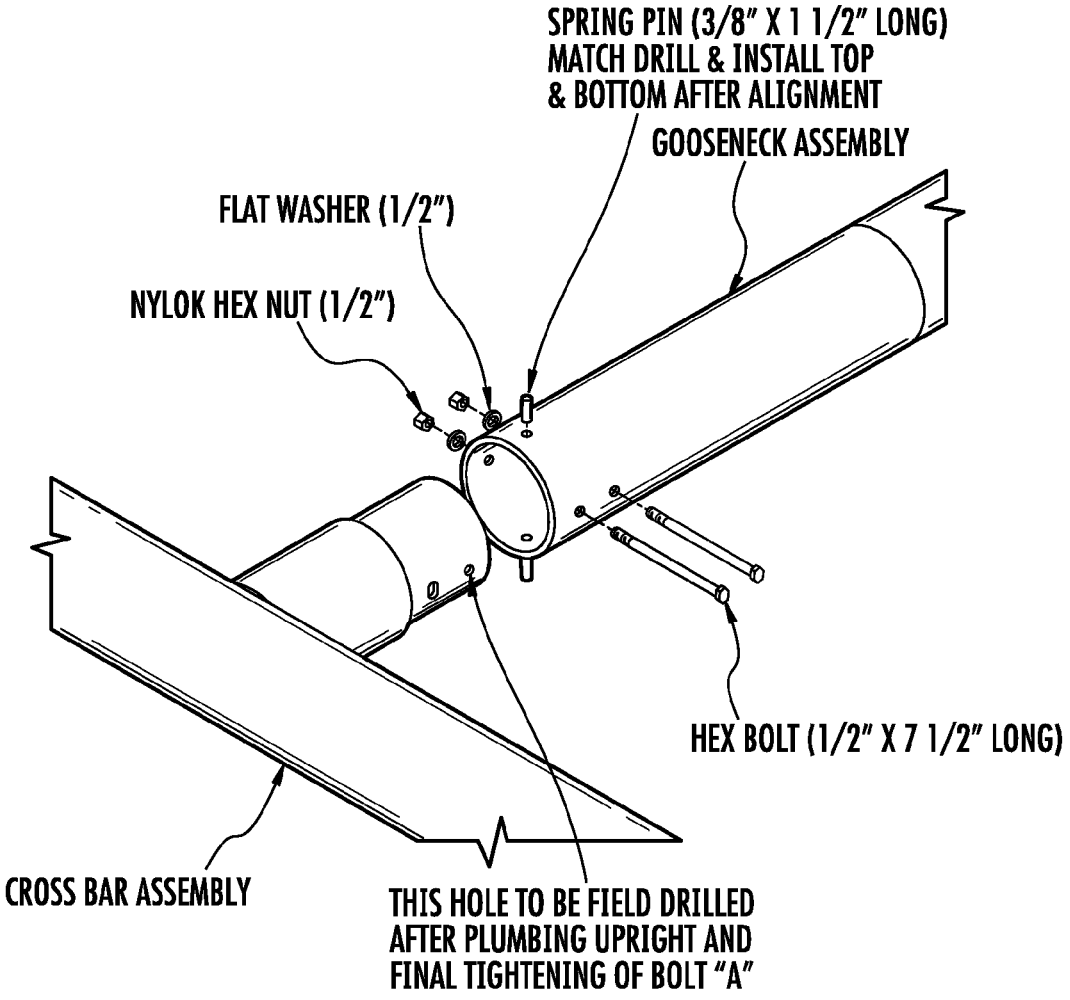
Figure 20:
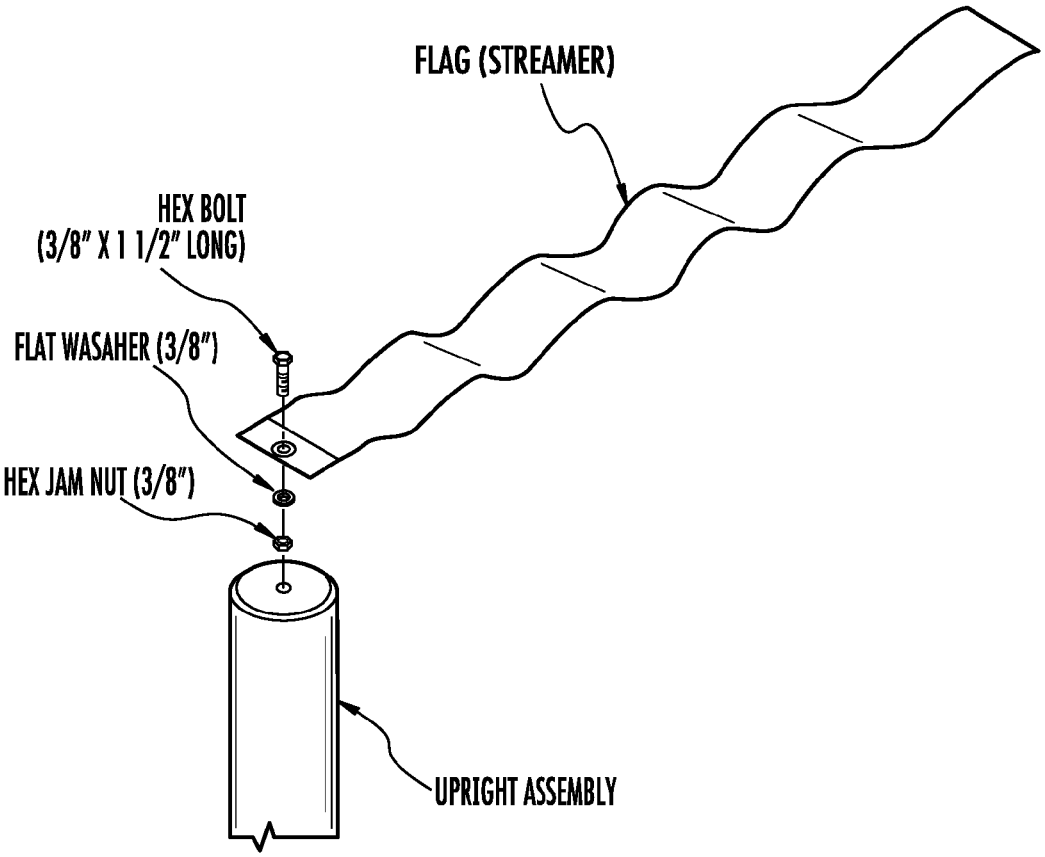
Figure 21:
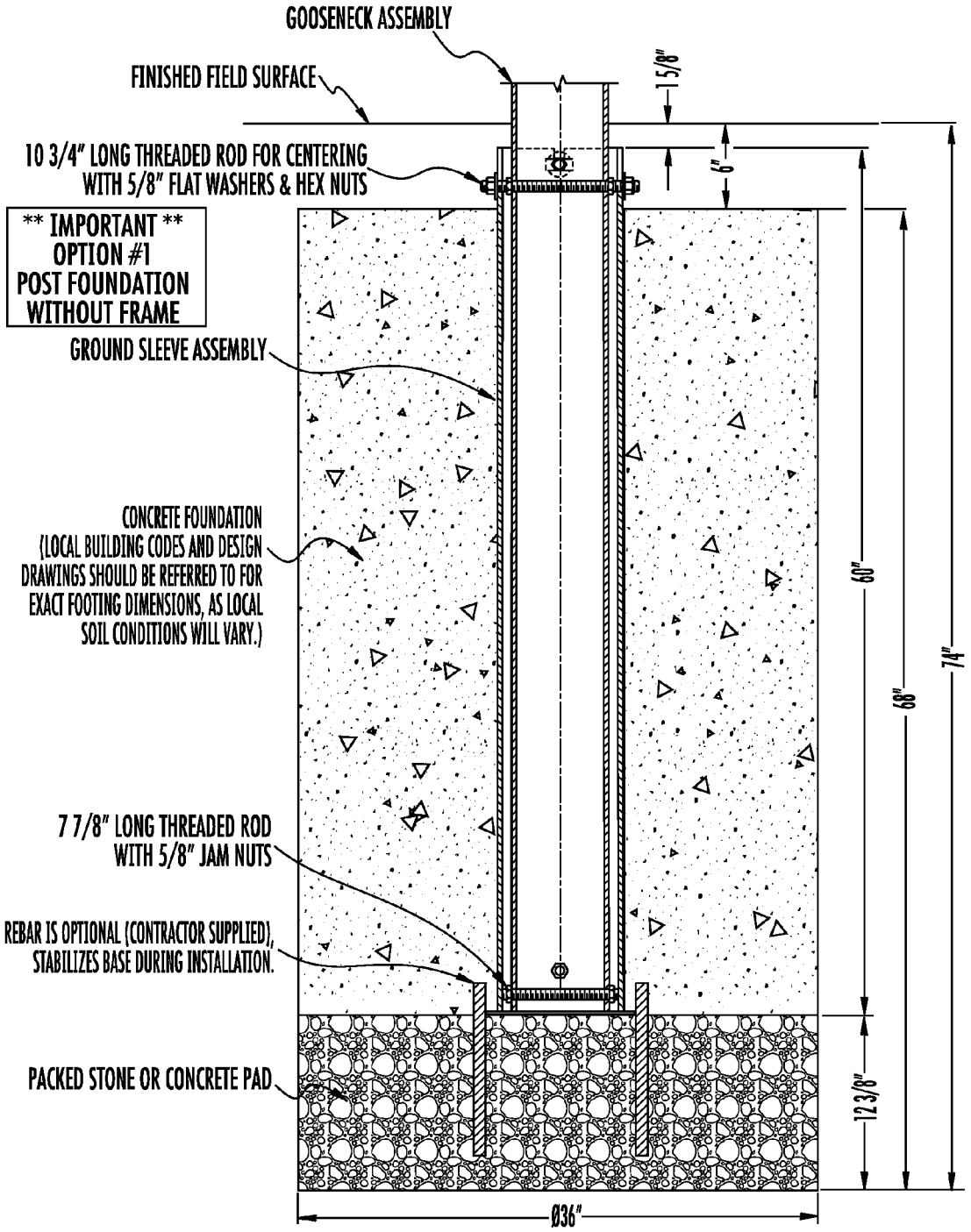
Figure 22B:
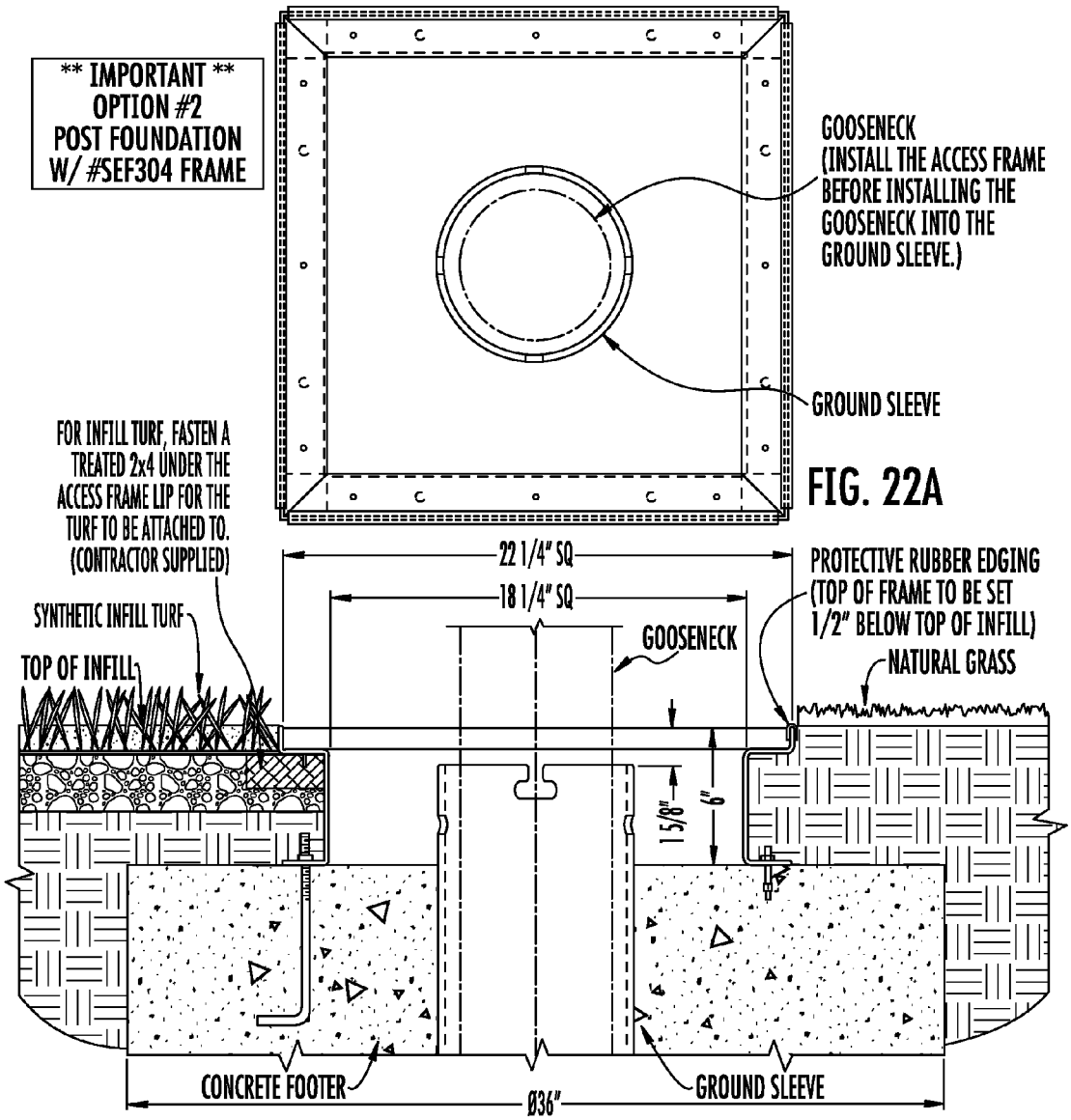
Figure 23:
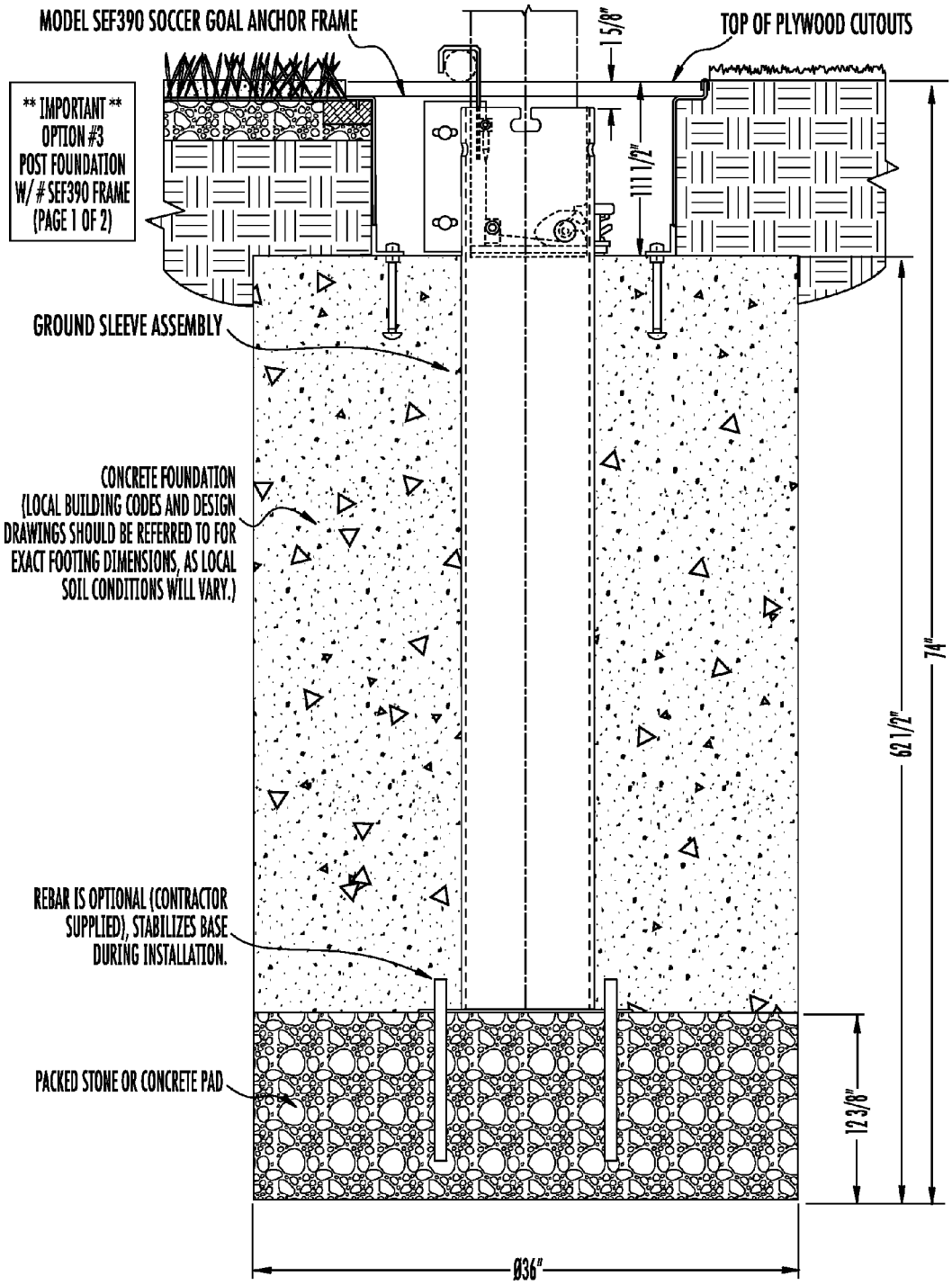
Figures 24A, 24B:
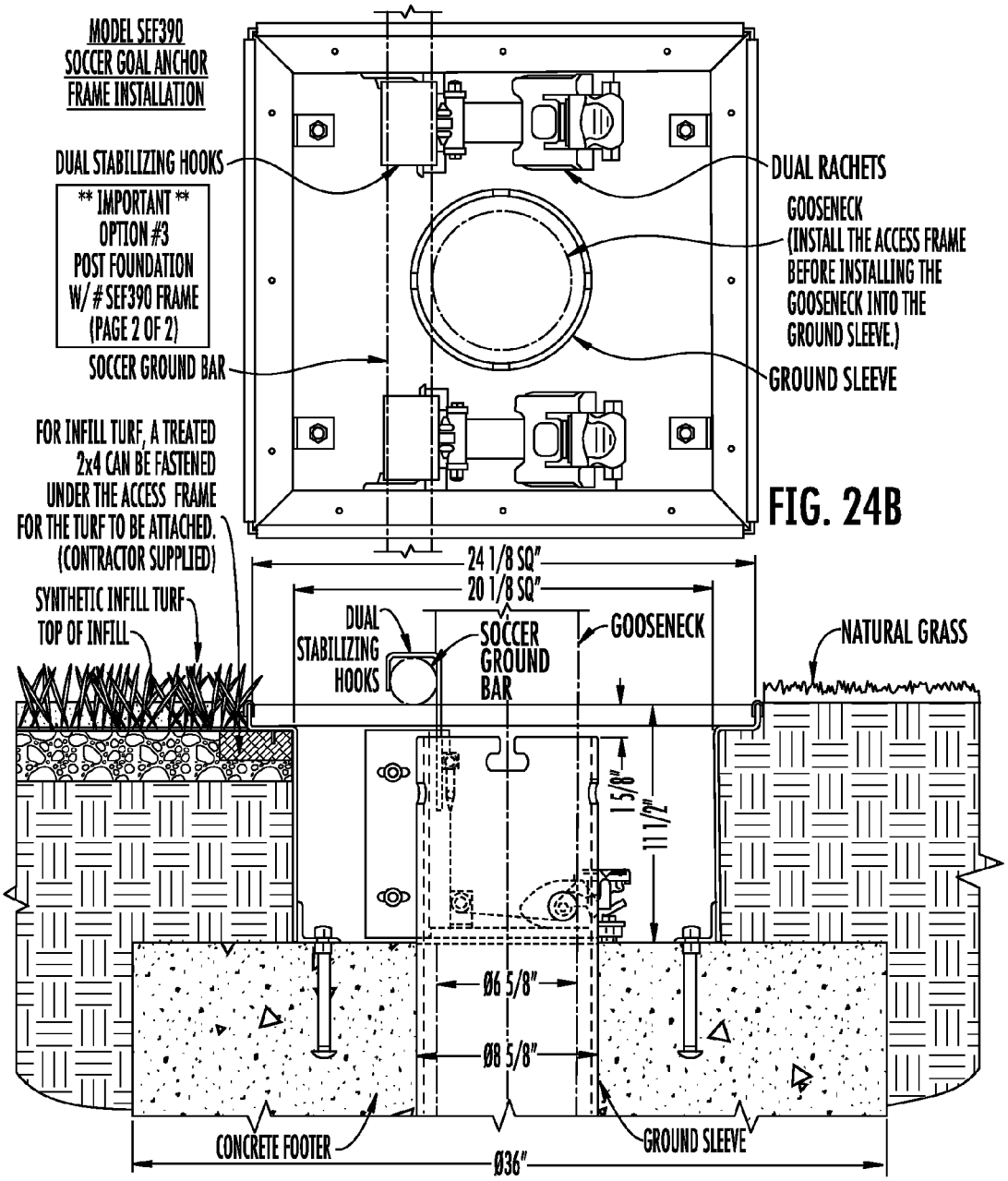
Figure 25:
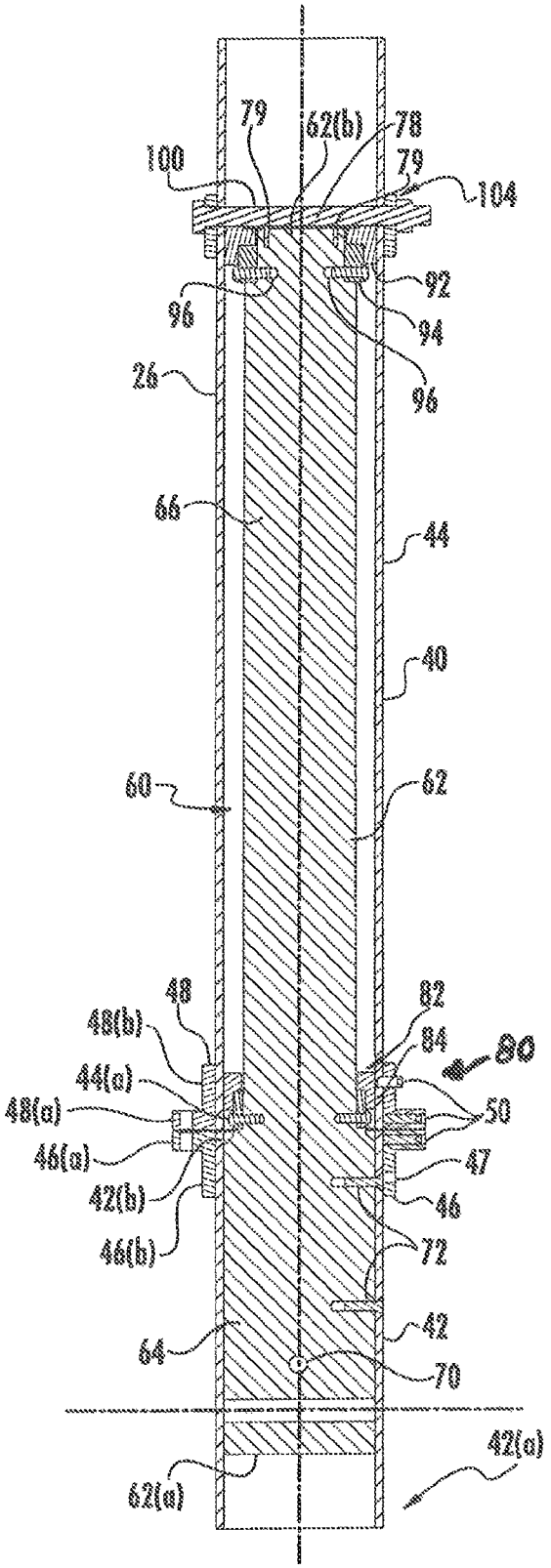
Figure 26:
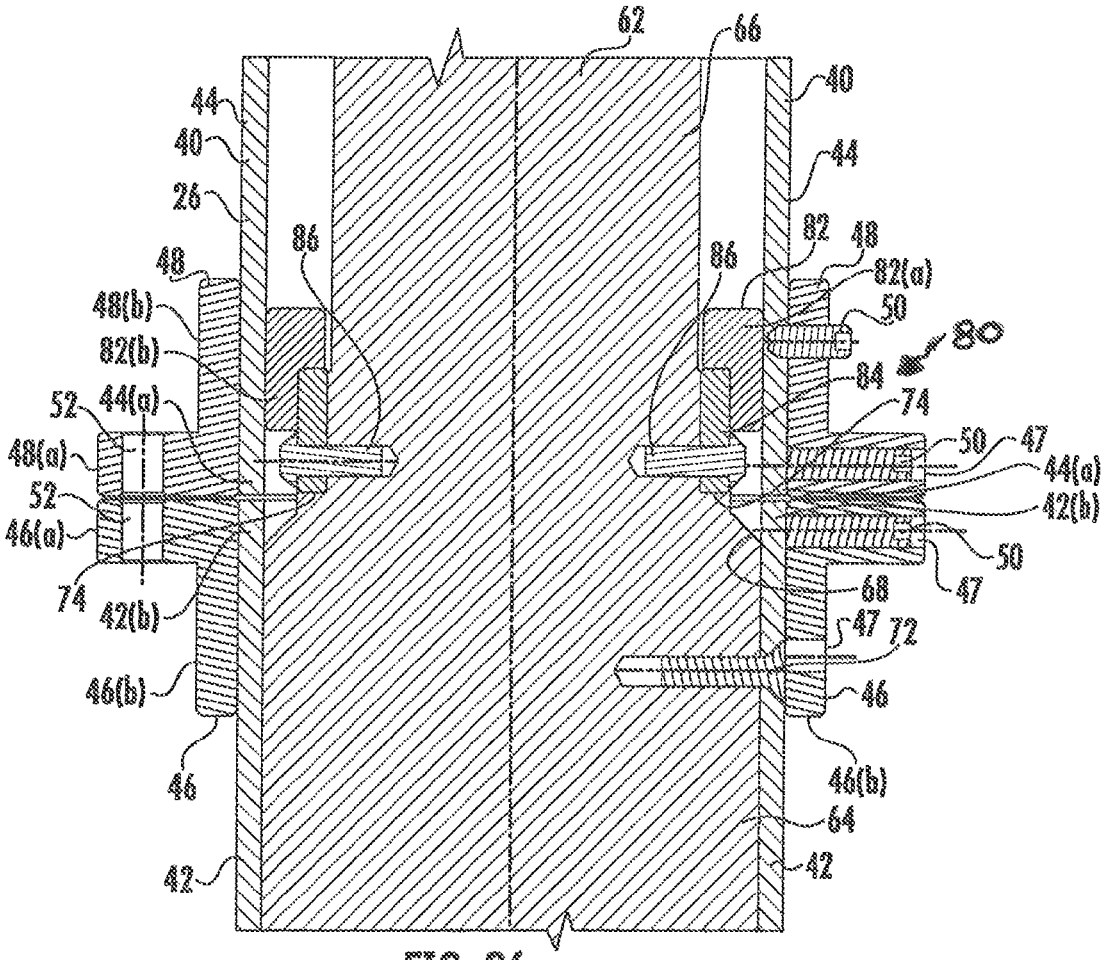
Figure 27:
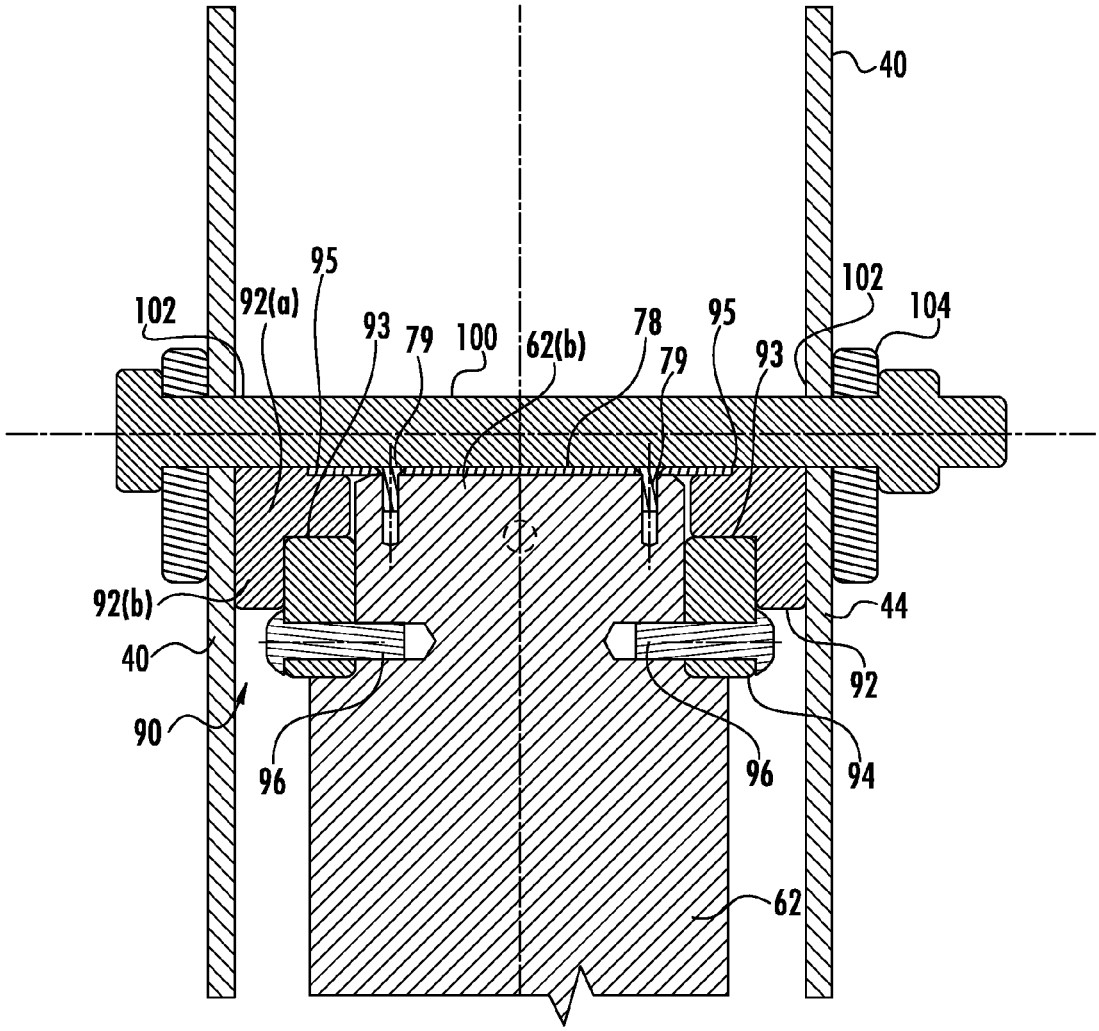
Figure 28:
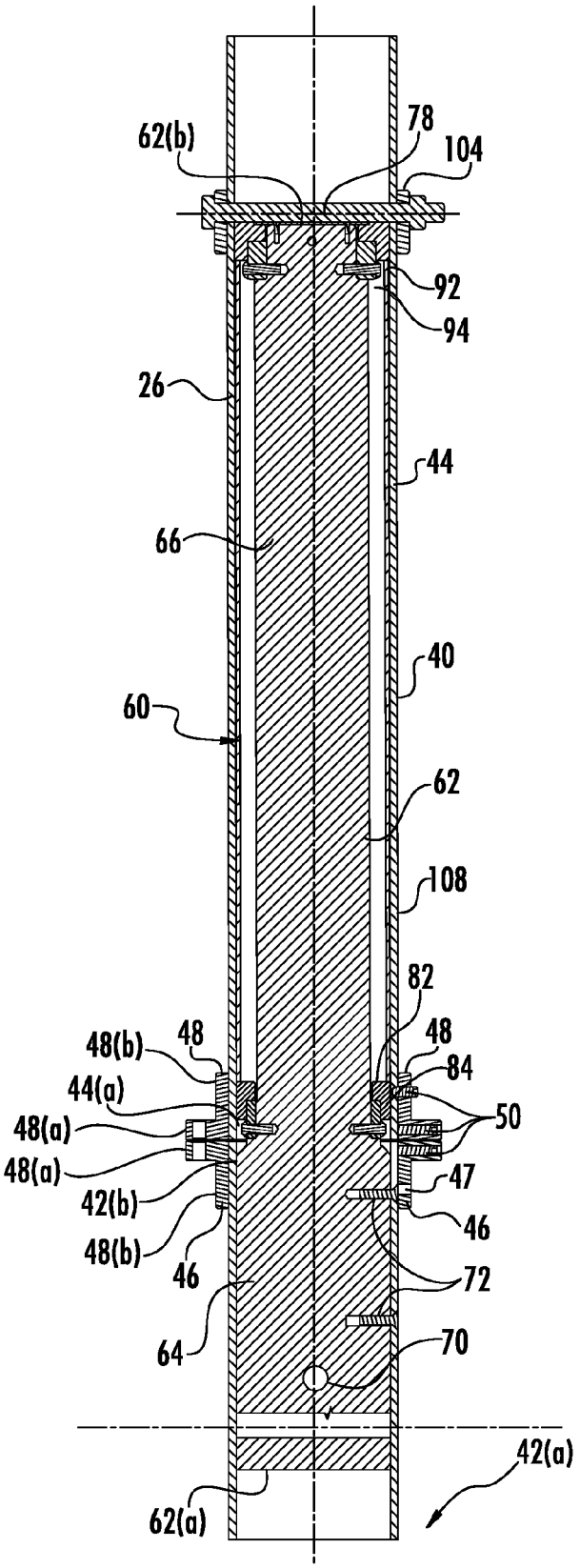
Figure 29:
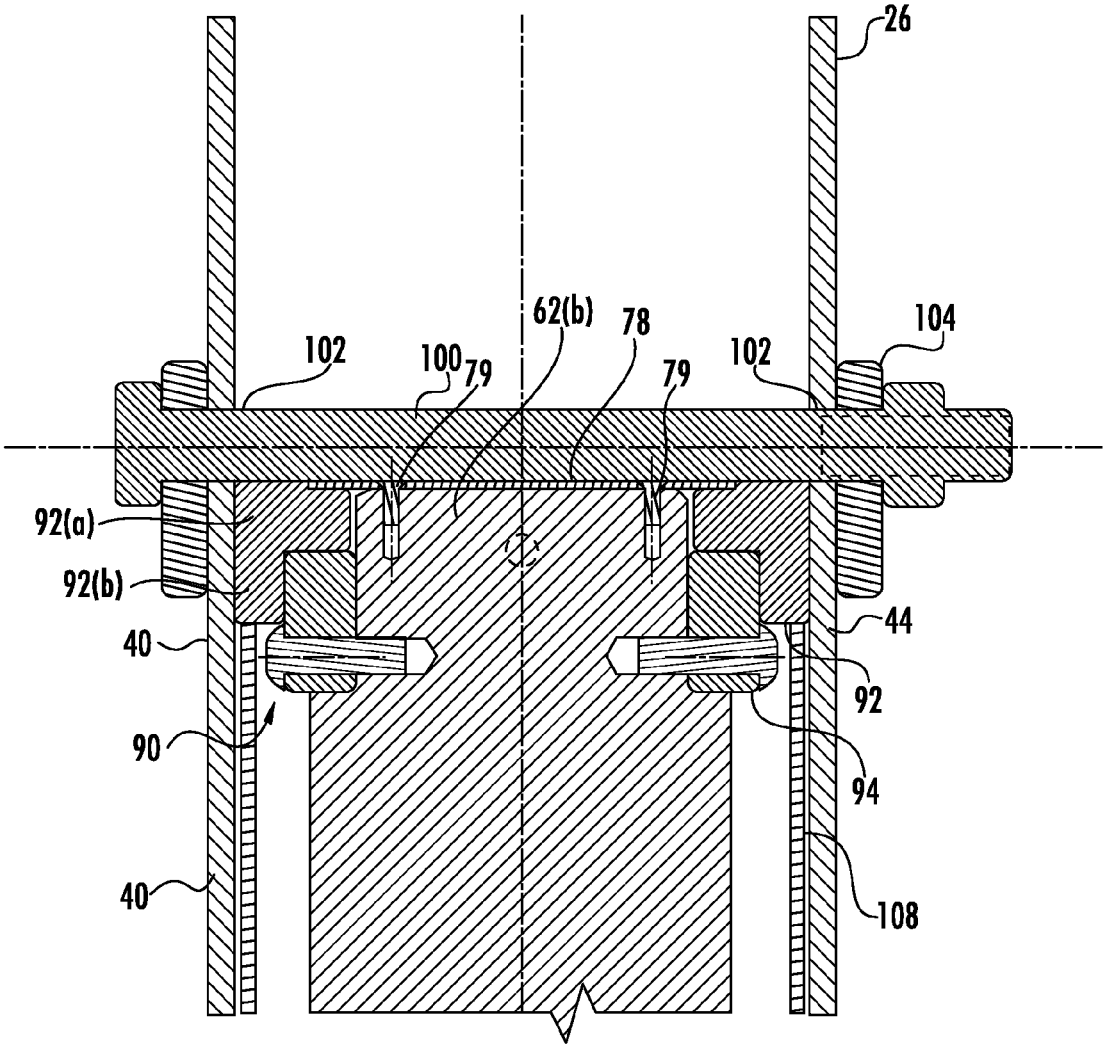
Figure 30:
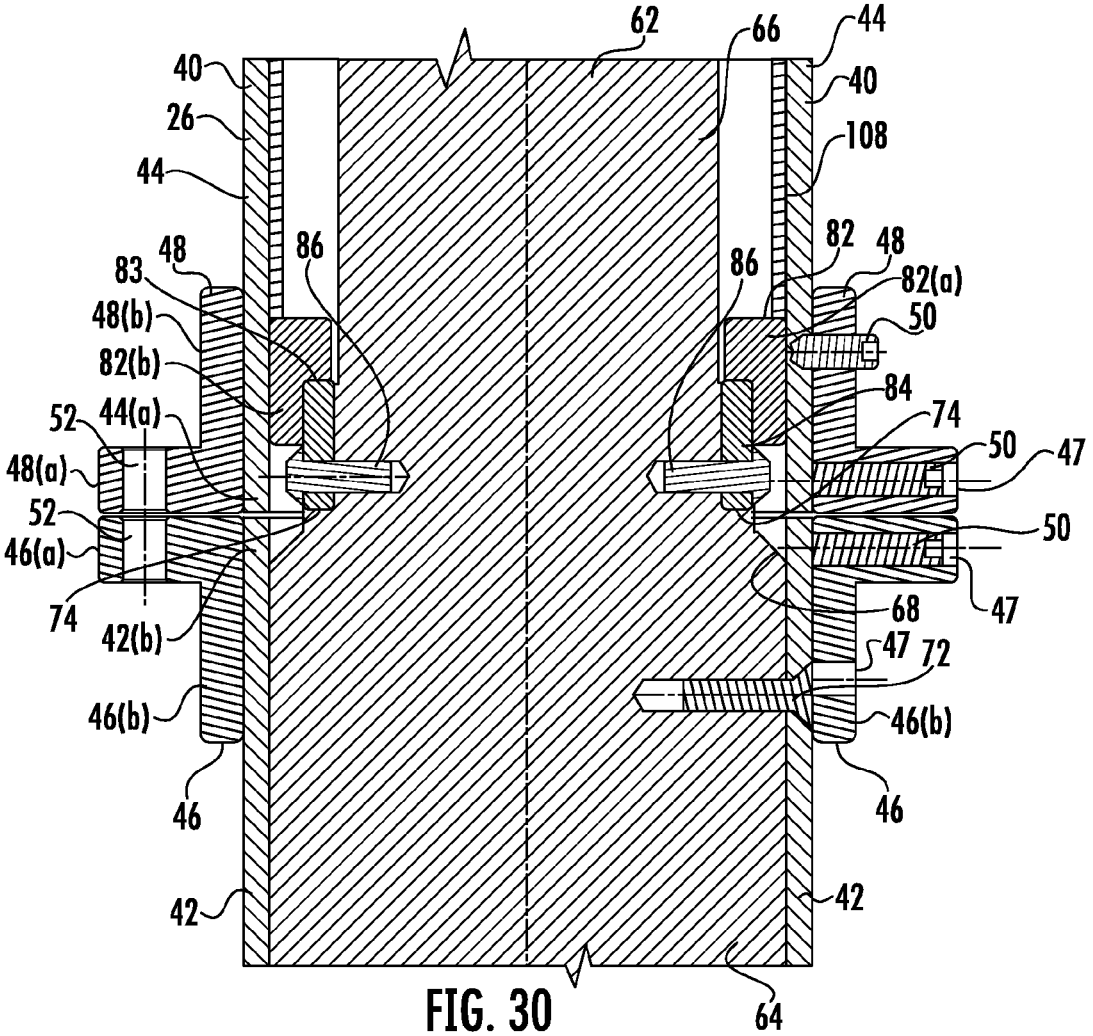
Figure 30A:
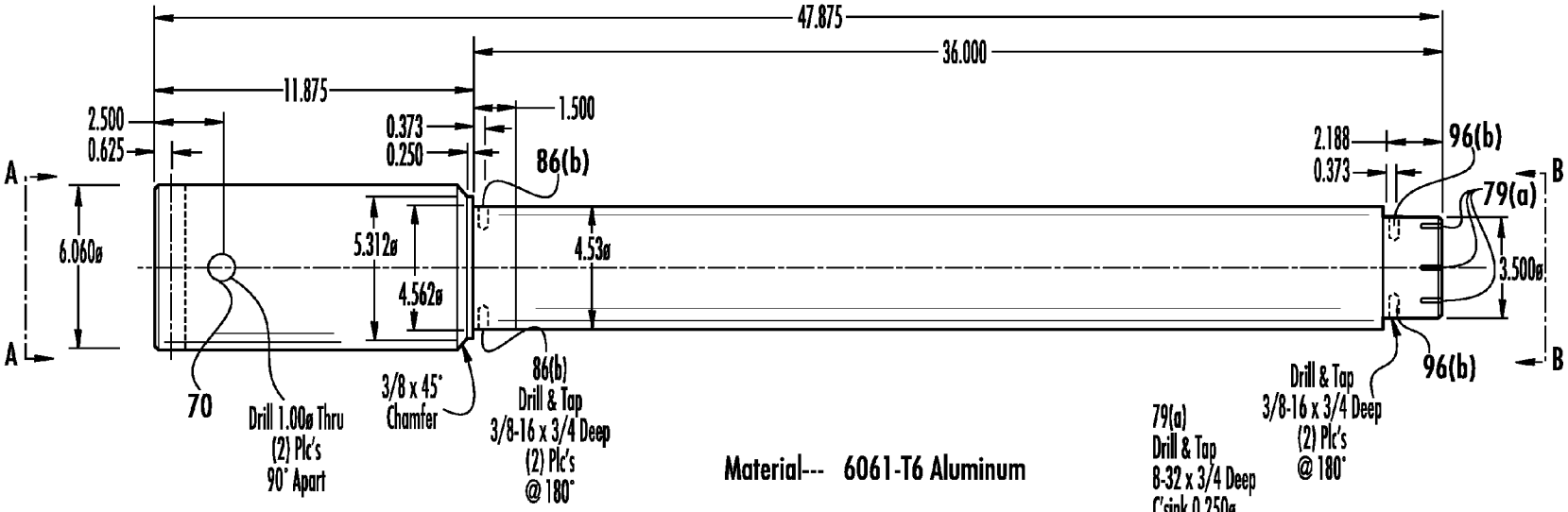
Figure 30D:
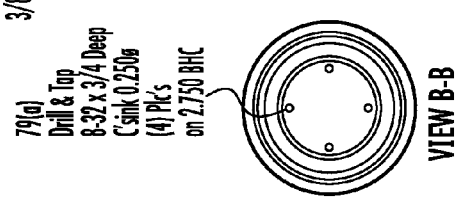
Figure 30C:
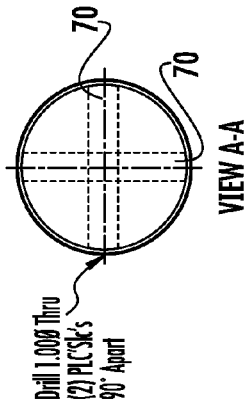
Figure 30B:
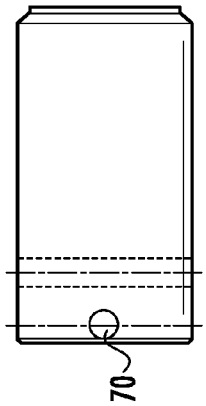
Figure 31B:
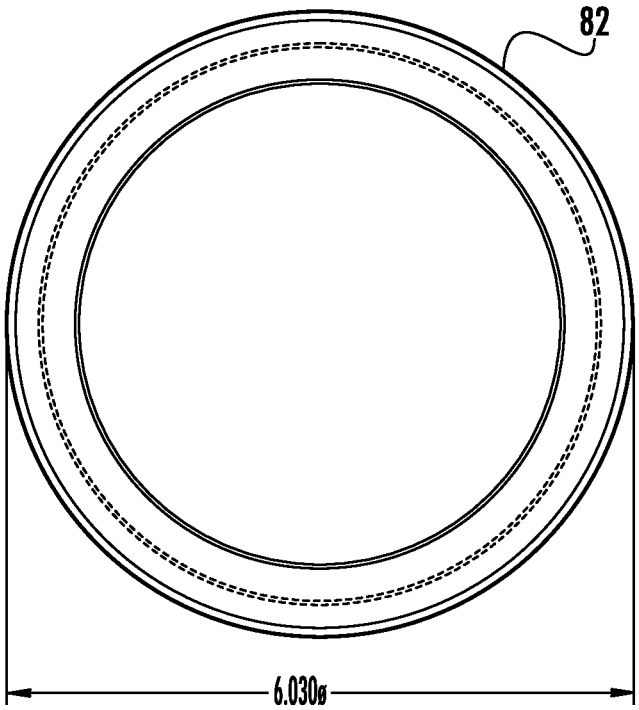
Figure 31A:
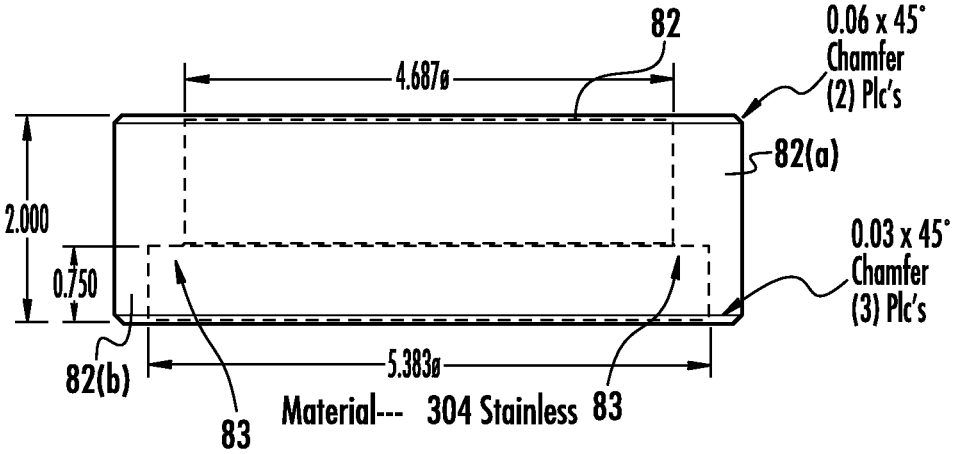
Figure 32B:
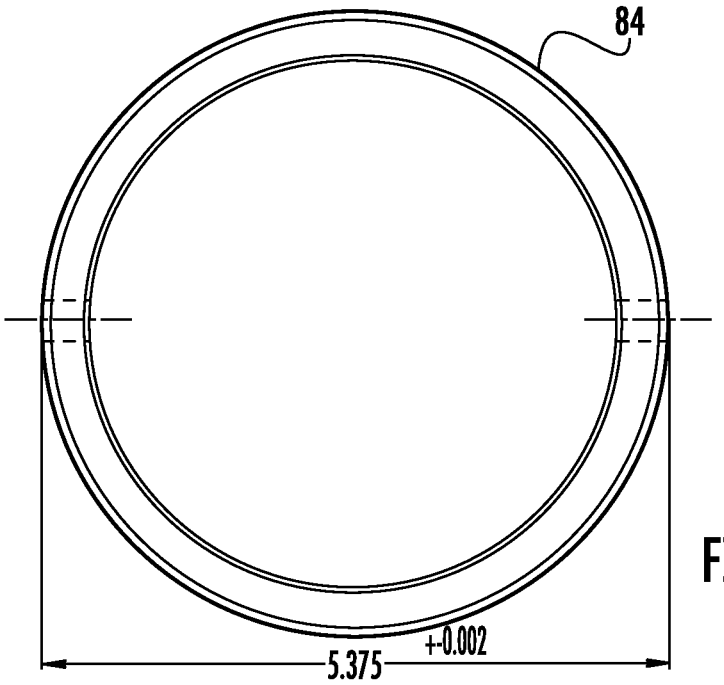
Figure 32A:
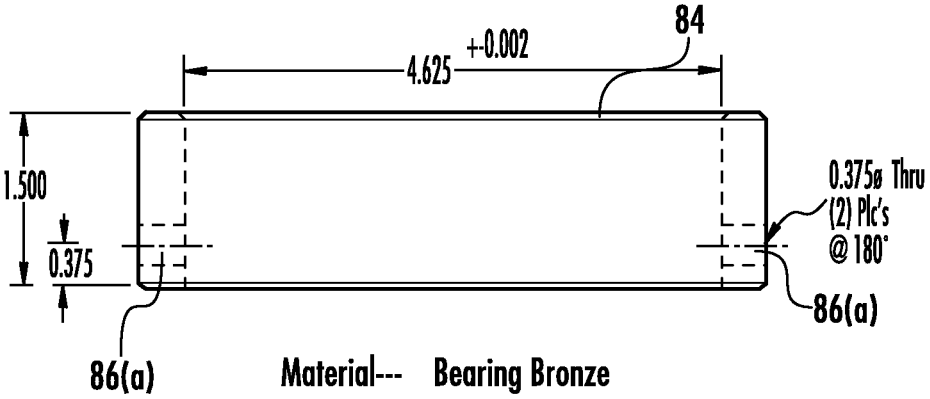
Figure 33B:
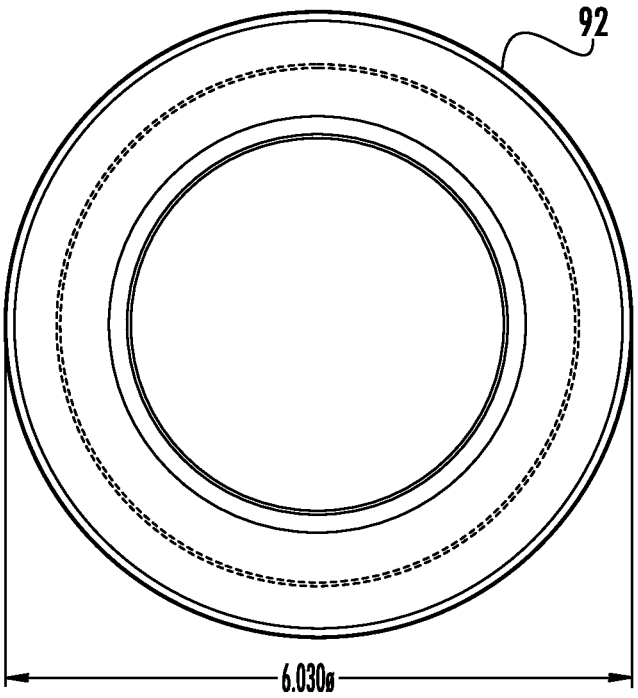
Figure 33A:
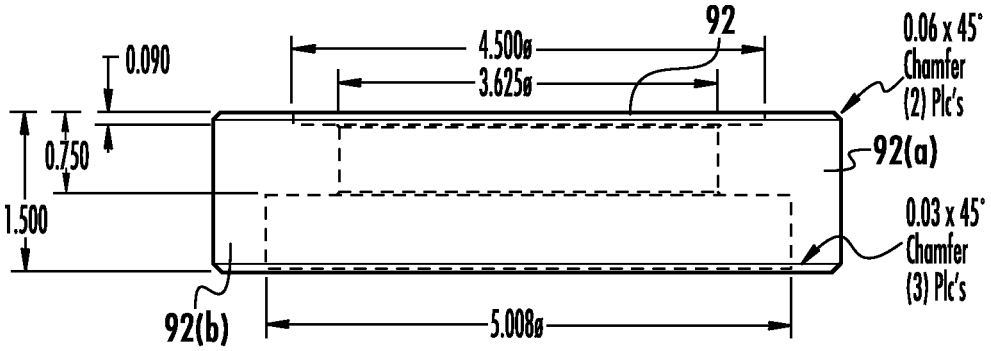
Figure 34B:
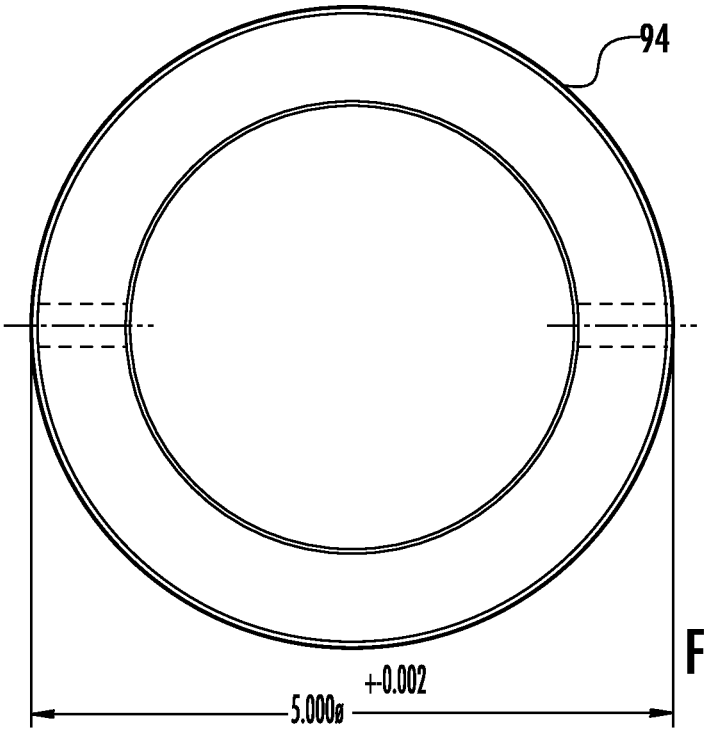
Figure 34A:
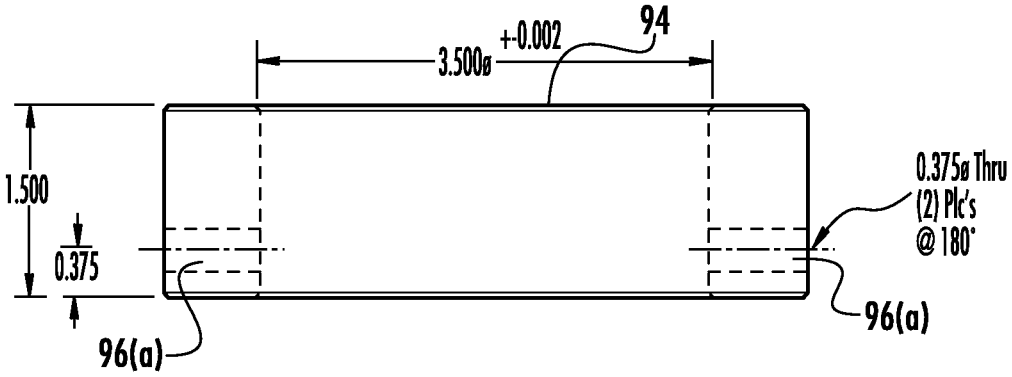
Figure 35B:
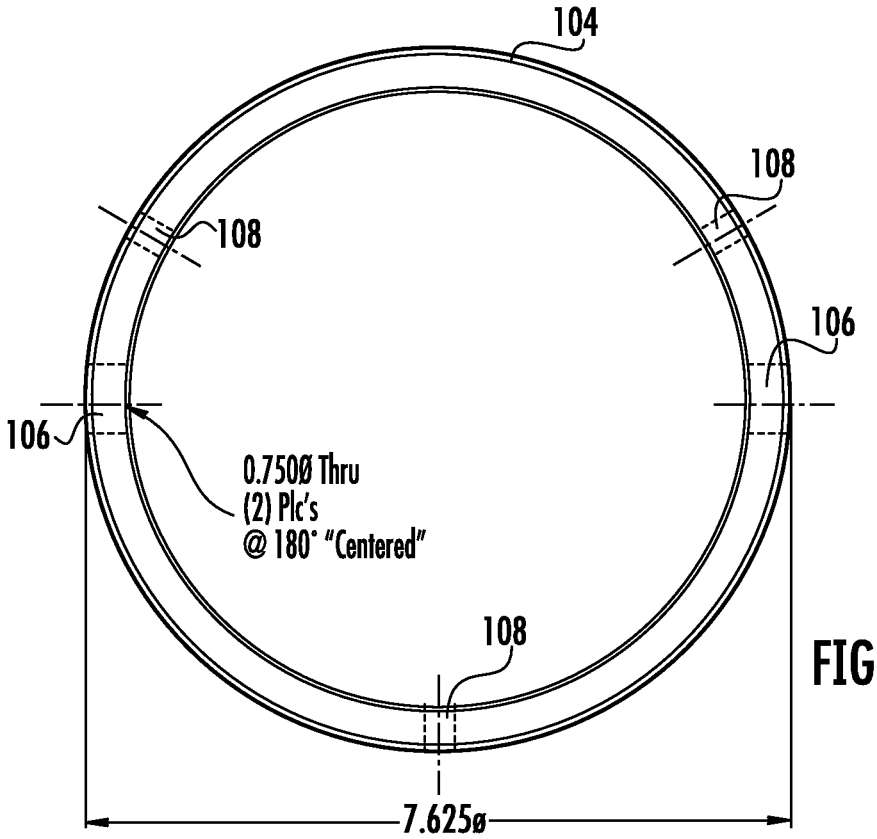
Figure 35A:
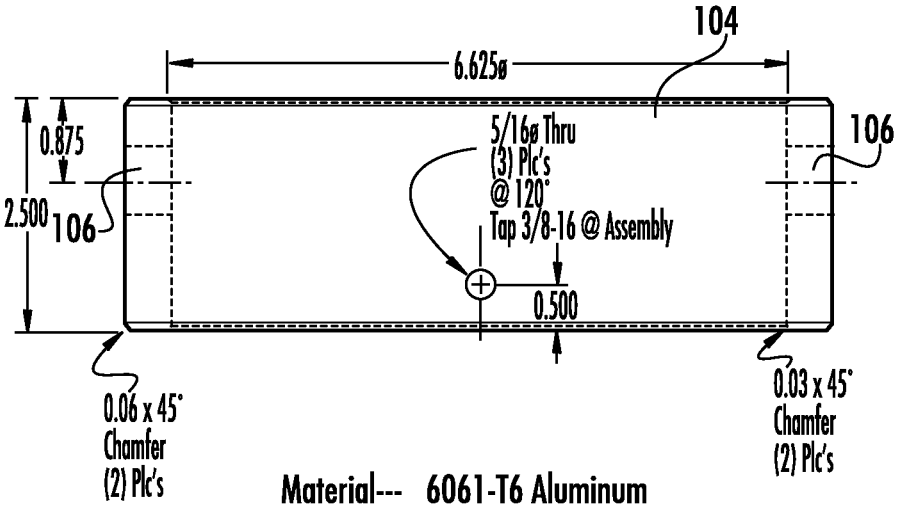
Figure 36B:
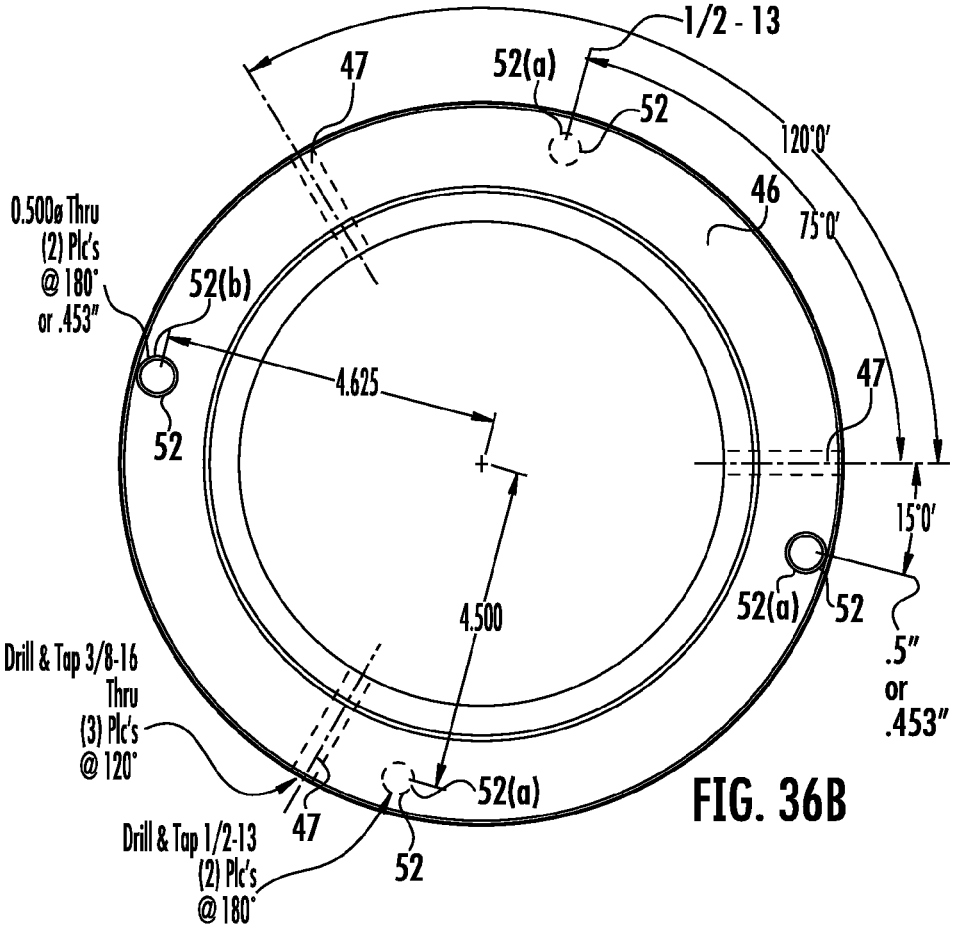
Figure 36A:
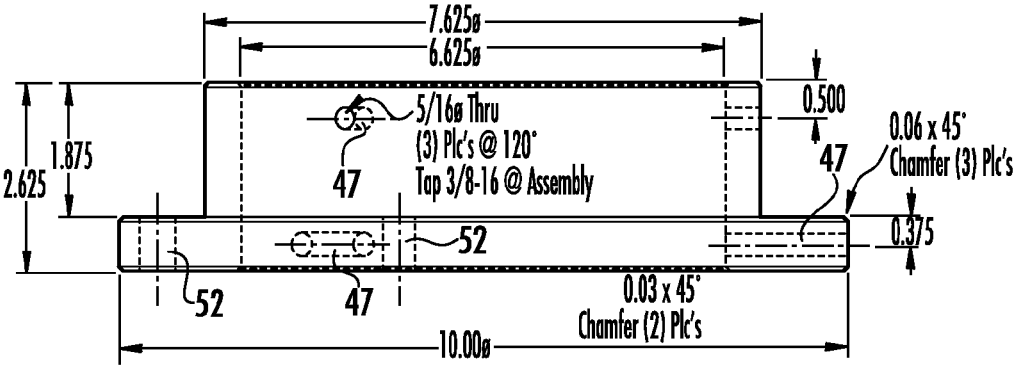
Figure 37B:
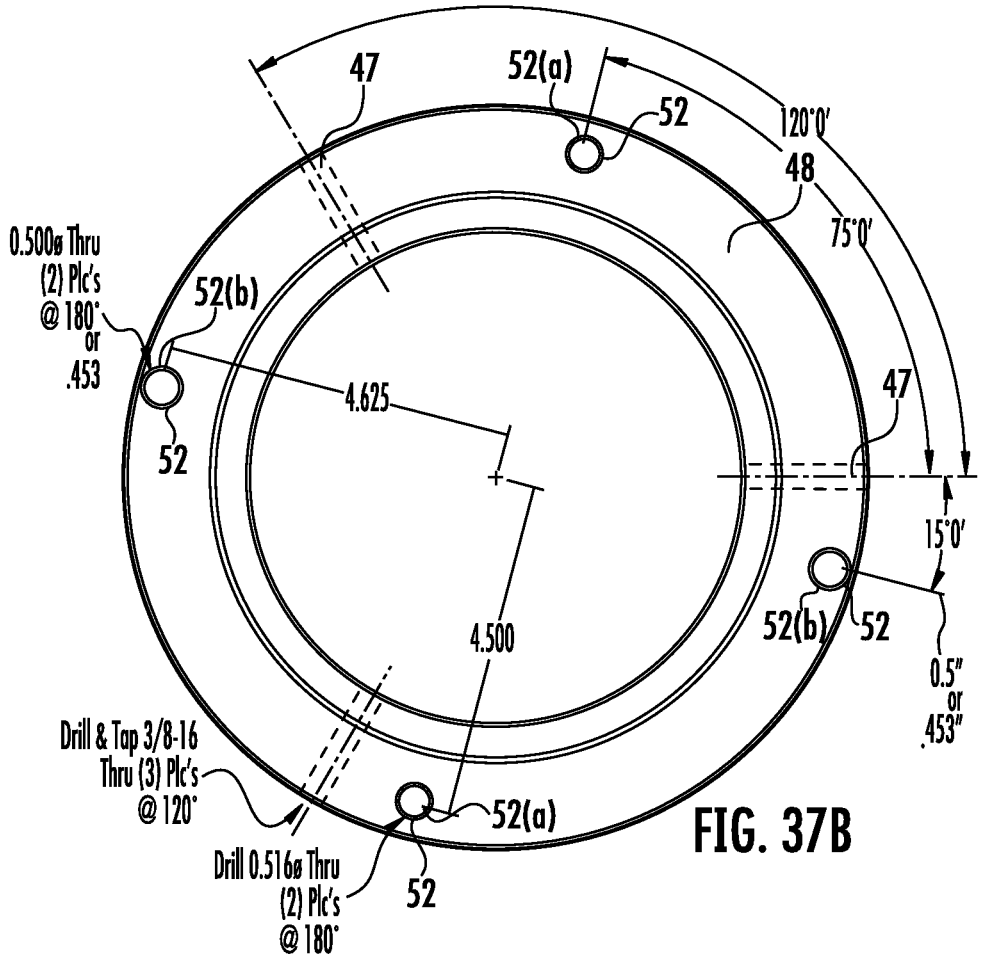
Figure 37A:
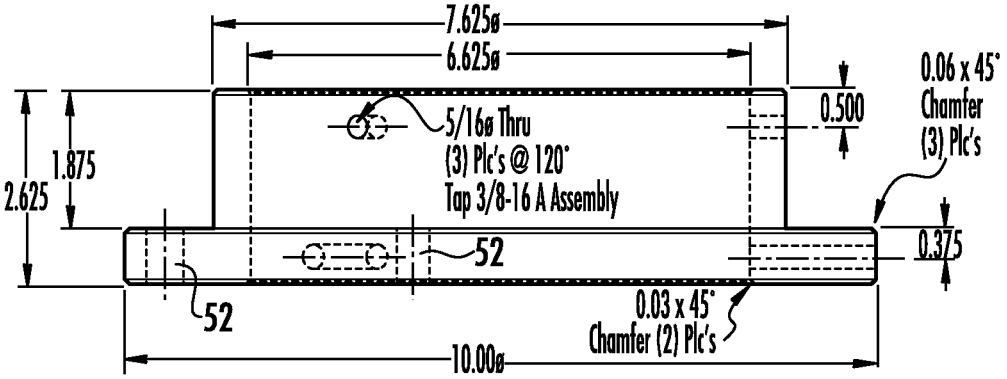
Figure 38B:
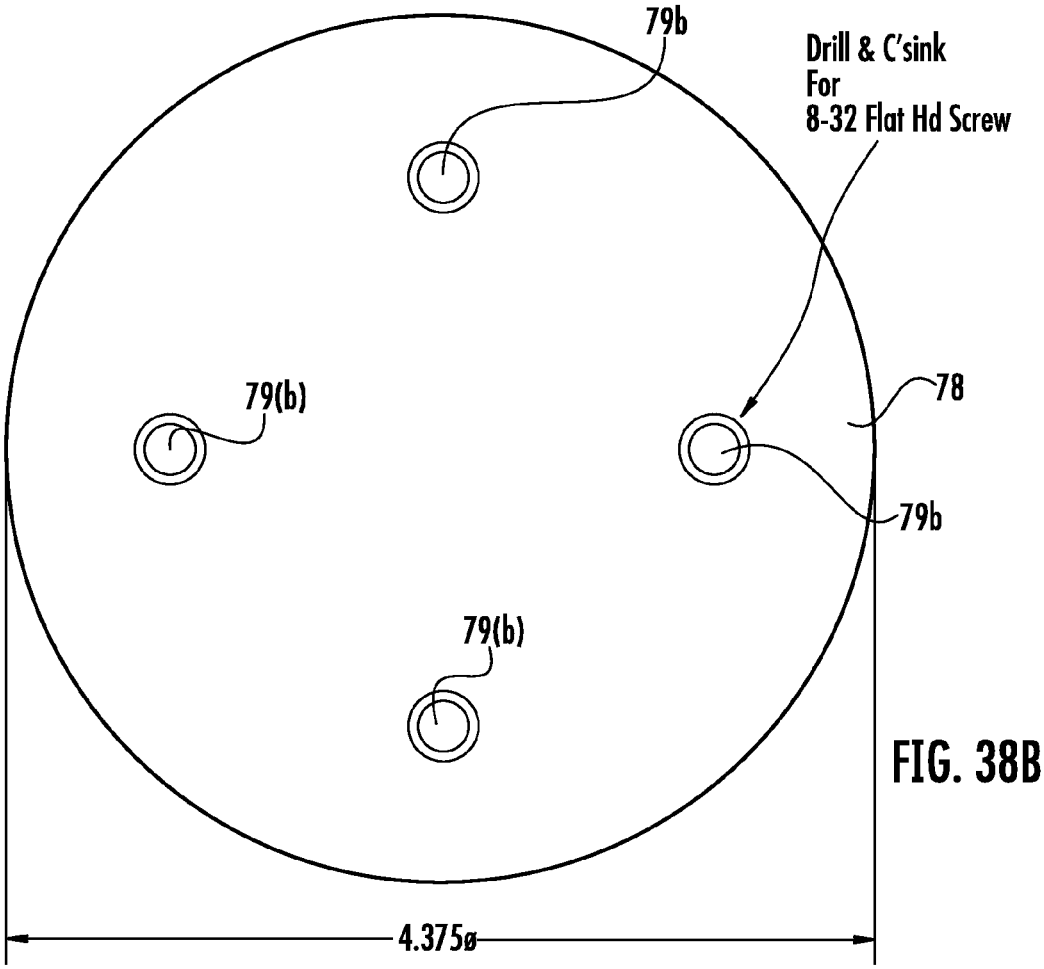
Figure 38A:
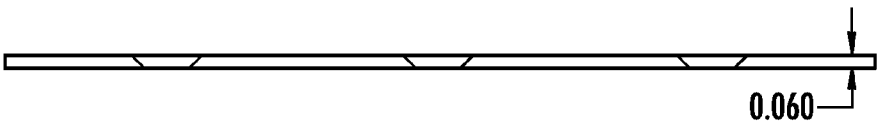
Figure 39B:
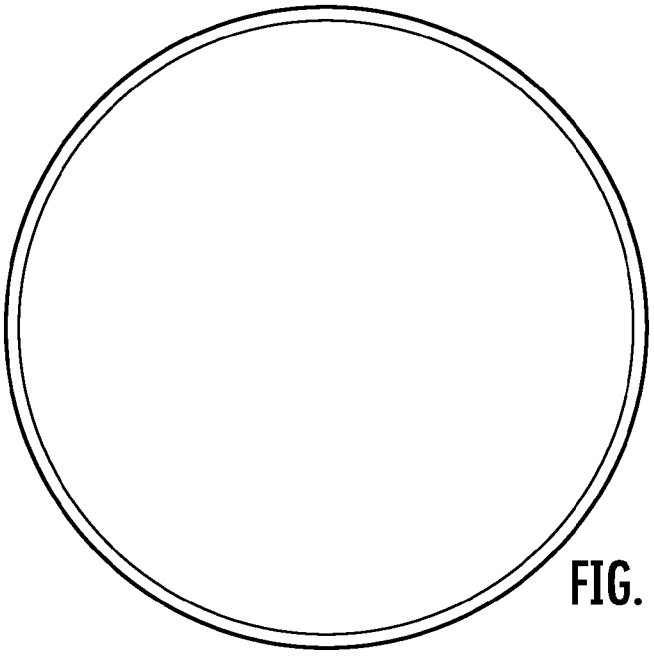
Figure 39A:
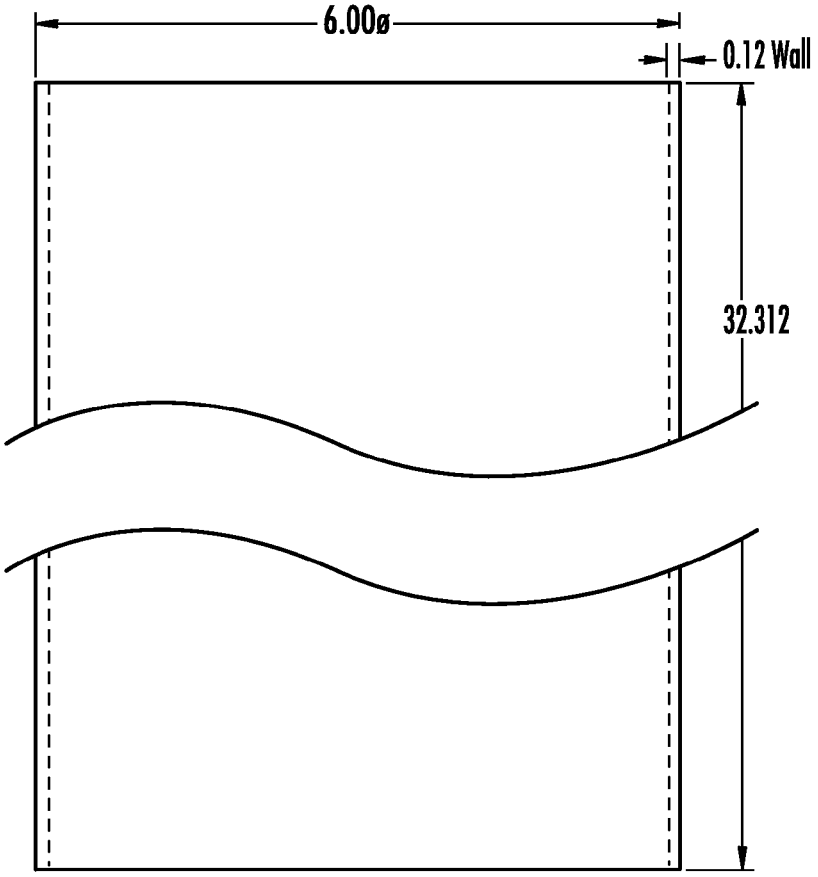
Figure 40A:
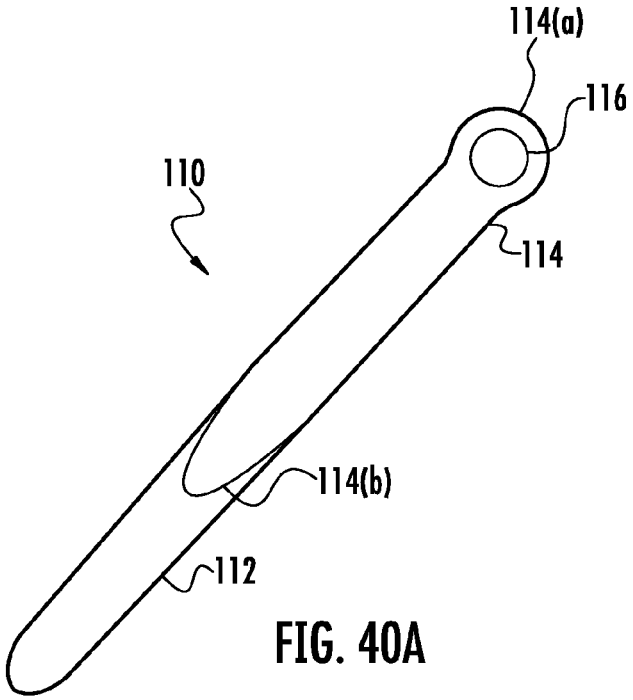
Figure 40B:
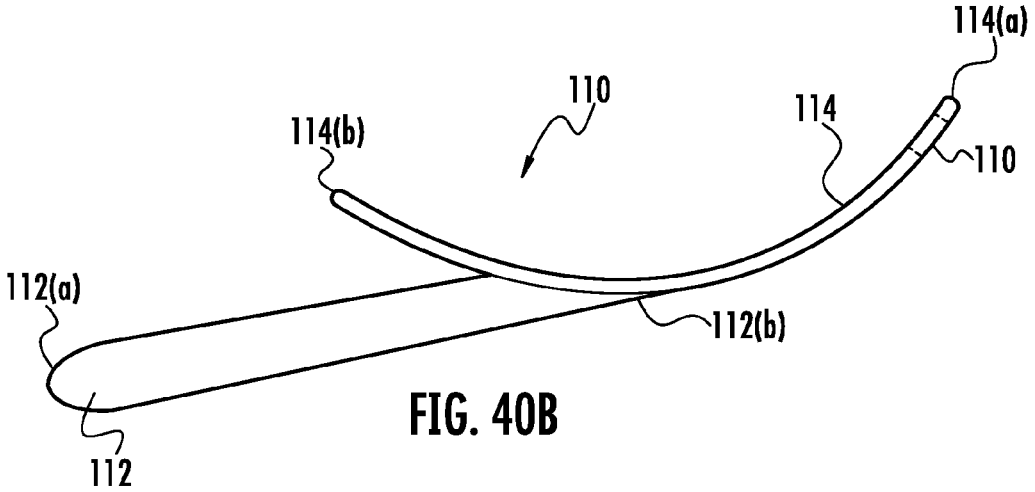
Figure 41:
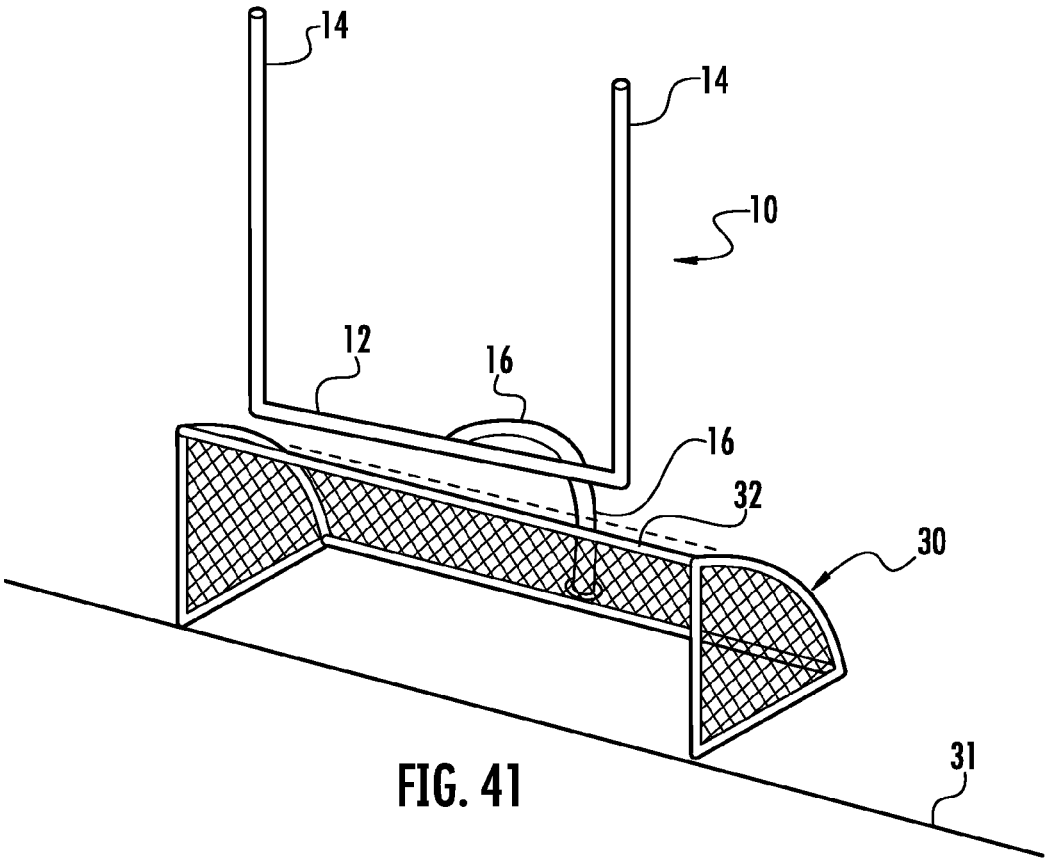
Figure 42B:
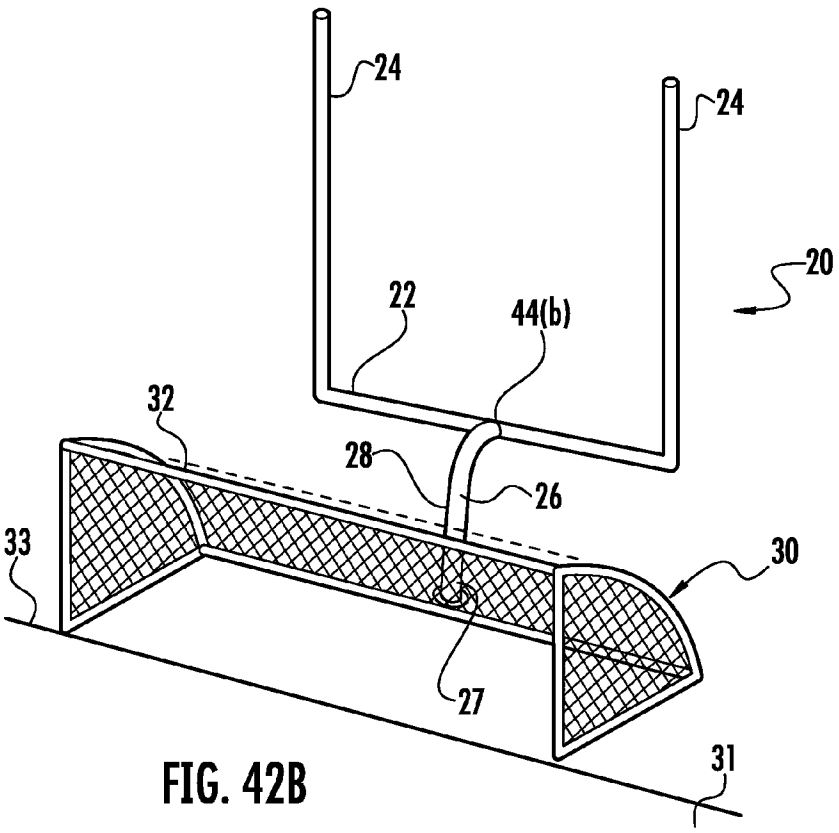
Figure 42A:
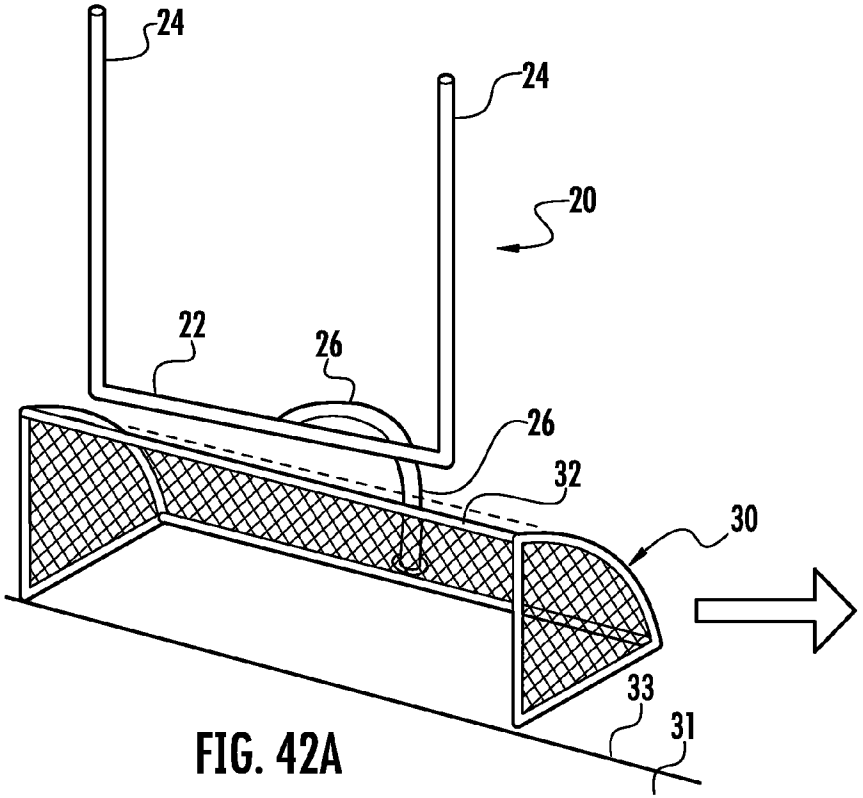
Figure 43A:
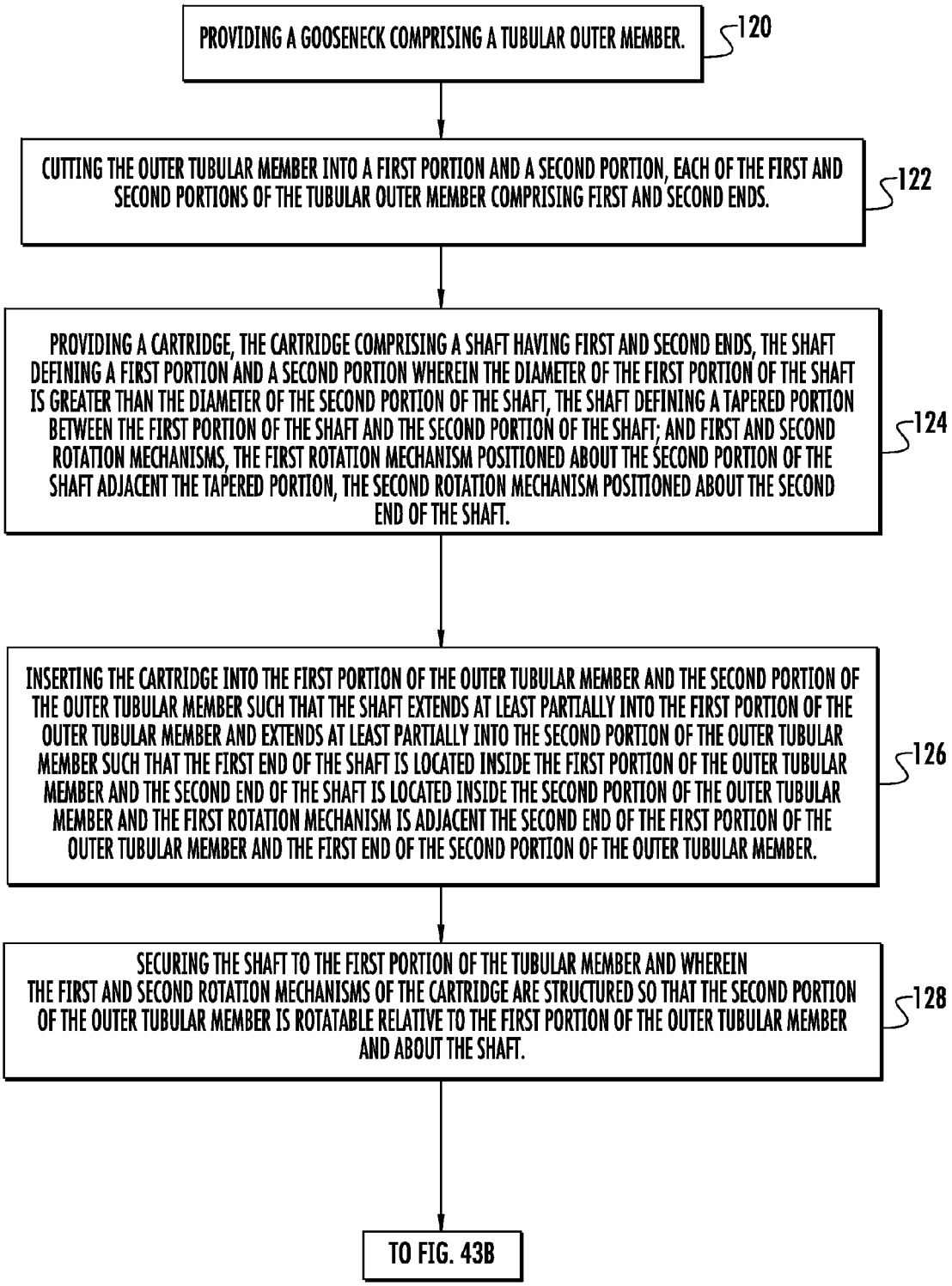
Figure 43B:
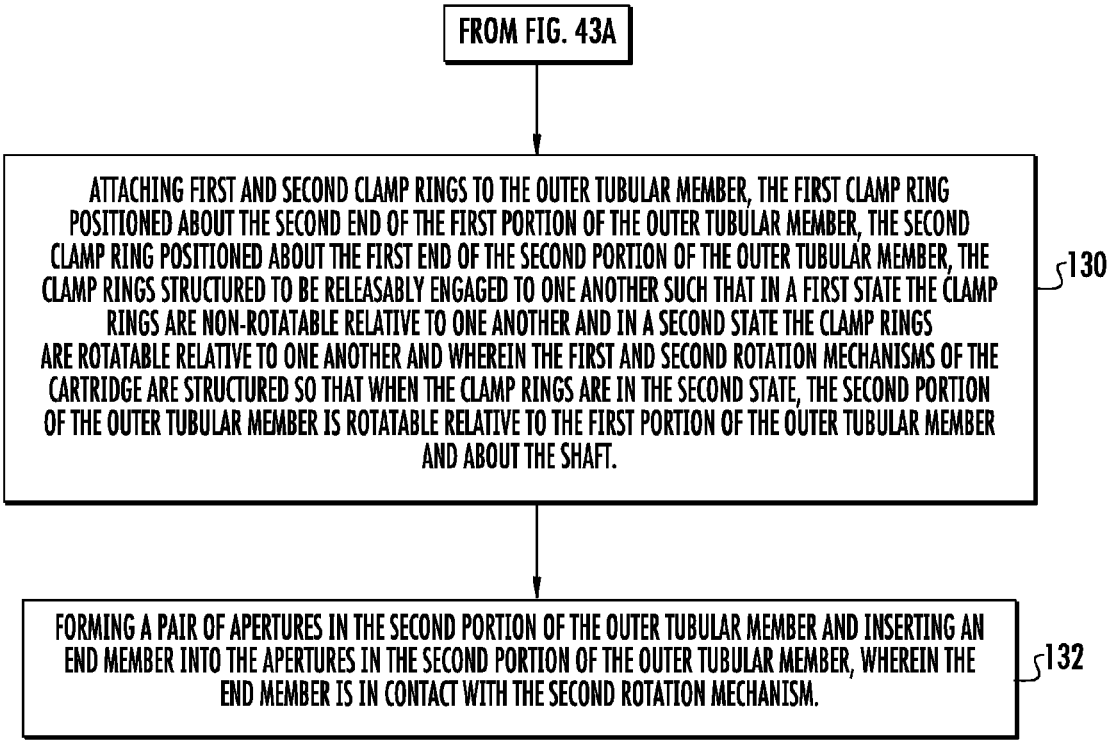

Having thus described embodiments of the invention in general terms, reference will now be made to the accompanying drawings, which are not necessarily drawn to scale, and wherein:

FIGS. 1-10 and 11(*a*)-11(*c*) illustrate the components and installation of one embodiment of a plate-mounted version of a conventional football goalpost;

FIGS. 12-15, 16(*a*)-16(*c*), 17-21, 22(*a*)-22(*b*), 23, and 24(*a*)-24(*b*) illustrate the components and installation of one embodiment of the ground-sleeve-mounted version of a conventional football goalpost;

FIG. 25 is a cross-sectional view of the outer tubular member of the gooseneck and a cartridge, according to one embodiment of the present invention;

FIG. 26 is a cross-sectional view of the first rotational mechanism of the cartridge of FIG. 25, according to one embodiment of the present invention;

FIG. 27 is a cross-sectional view of the second rotational mechanism of the cartridge of FIG. 25, according to one embodiment of the present invention;

FIG. 28 is a cross-sectional view of the outer tubular member of the gooseneck and a cartridge, according to another embodiment of the present invention;

FIG. 29 is a cross-sectional view of the first rotational mechanism of the cartridge of FIG. 28, according to another embodiment of the present invention;

FIG. 30 is a cross-sectional view of the second rotational mechanism of the cartridge of FIG. 28, according to another embodiment of the present invention;

FIG. 30(*a*) is a side-plan view of the shaft of the cartridge of FIGS. 25 and 28, including the dimension thereof and material composition, according to one embodiment of the present invention;

FIG. 30(*b*) is a side plan view of the first portion of the shaft illustrated in FIG. 30(*a*);

FIG. 30(*c*) is a plan view of the first end of the shaft illustrated in FIG. 30(*a*) along lines A-A of FIG. 30(*a*);

FIG. 30(*d*) is a plan view of the second end of the shaft illustrated in FIG. 30(*a*) along lines B-B of FIG. 30(*a*);

FIGS. 31(*a*) and (*b*) are side and top plan views of the outer race of the first rotational shaft of the cartridge of FIGS. 25 and 28, including the dimensions thereof and material composition, according to one embodiment of the present invention;

FIGS. 32(*a*) and (*b*) are side- and top-plan views of the inner race of the first rotational shaft of the cartridge of FIGS. 25 and 28, including the dimensions thereof and material composition, according to one embodiment of the present invention;

FIGS. 33(*a*) and (*b*) are side- and top-plan views of the outer race of the second rotational shaft of the cartridge of FIGS. 25 and 28, including the dimensions thereof and material composition, according to one embodiment of the present invention;

FIGS. 34(*a*) and (*b*) are side- and top-plan views of the inner race of the second rotational shaft of the cartridge of FIGS. 25 and 28, including the dimensions thereof and material composition, according to one embodiment of the present invention;

FIGS. 35(*a*) and (*b*) are side- and top-plan views of the support band of the gooseneck of FIGS. 25 and 28, including the dimensions thereof and material composition;

FIGS. 36(*a*) and (*b*) are side and top plan views of one embodiment of the first clamp ring of the gooseneck, including the dimensions thereof and material composition, according to one embodiment of the present invention;

FIGS. 37(*a*) and (*b*) are side- and top-plan views of the second clamp ring of the gooseneck of FIGS. 25 and 28, including the dimensions thereof and material composition, according to one embodiment of the present invention;

FIGS. 38(*a*) and (*b*) are side- and top-plan views of the end cap or cap of the cartridge of FIGS. 25 and 28, including the dimensions thereof and material composition, according to one embodiment of the present invention;

FIGS. 39(*a*) and (*b*) are side and top plan views of one embodiment of the support tube of the cartridge of FIG. 28, including the dimensions thereof and material composition, according to one embodiment of the present invention;

FIG. 40 illustrates a tool for rotating the second portion of the outer tubular member of the gooseneck relative to the first portion of the outer tubular member, according to one embodiment of the present invention;

FIG. 41 is a partial-perspective view of a football/soccer field with a conventional football goalpost and soccer goalpost arrangement;

FIGS. 42(*a*) and (*b*) are partial-perspective views of a football/soccer field with a football goalpost and soccer goalpost arrangement, according to one embodiment of the present invention; and FIGS. 43(*a*) and (*b*) are block diagram illustrating the steps in retrofitting an existing football goalpost so that the second portion of the outer tubular member of the gooseneck relative to the first portion of the outer tubular member, according to one embodiment of the present invention.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

As used herein and in the claims, the term "ground" refers to the surface of the earth, but also refers other natural or manmade surfaces including, for example, manmade floors in a building. For example, where the present application describes a plate 18 or ground sleeve 15 as being anchored in the ground, the post or sleeve may be anchored in the dirt of a field, concrete, a floor in a building, or other material or surface suitable for anchoring the post or sleeve, including, without limitation, foundations for artificial turf.

Referring to the drawings, and in particular, to FIGS. 42(*a*) and (*b*), in accordance with one embodiment of the present invention, there is illustrated a football goalpost 20 having a gooseneck 26 in which at least a portion of the gooseneck can be rotated to move the crossbar 22 and uprights 24 to a location where they will not significantly or materially interfere with a soccer goal 30 or field 31. In one embodiment, the portion of the gooseneck 26 of the football goalpost 20 is rotatable about a substantially vertical axis defined by the center of the relatively straight portion of the gooseneck 26 extending upwardly from where the gooseneck is mounted to or secured in the ground (either via the plate 18 or ground sleeve 15, respectively, as discussed above). According to the present invention, the rotation of the goalpost 20 may be unrestricted, i.e., 360 degree rotation in either direction; restricted 360 degree rotation in a particular direction (i.e., clockwise or counter-clockwise direction); restricted rotation to a limited angle between 0 degrees and 360 degrees in either direction (e.g., 180 degrees); or restricted rotation to a limited angle between 0 degrees and 360 degrees in a particular direction (e.g., 180 degrees in a clockwise or counter-clockwise direction).

More particularly, FIG. 42(*b*) illustrates how a football field may be converted to a soccer field by positioning a soccer goal 30 in front of the football goalpost 20, wherein the football goalpost has a gooseneck 26 that can be rotated to move the crossbar 18 to a location where it will not significantly or materially interfere with a soccer goal 30 or field 31. Positioned as such, the crossbar 22 and the uprights 24 are located well behind the end line 33 of the field 31 where they will not materially or significantly interfere with the soccer goal 30 and field. As described in detail below, embodiments of the present invention provide a rotating football goalpost 20 that allows a user to easily rotate the rotatable portion of the gooseneck 26 of the goalpost. In one embodiment, the user must apply approximately one hundred (100) ft/lbs of torque (or twenty-five (25) lbs thrust at a four (4) foot distance from the central axis of the gooseneck 26) or less. The present invention also provides a method for retrofitting an existing football goalpost 10 (as illustrated in FIG. 41) such that the gooseneck of the existing goalpost becomes rotatable. Embodiments of the rotating football goalpost 20 further allow a user to make adjustments in the vertical and rotational alignment of the football goalpost after installation.

Referring to FIG. 25, there is shown a portion of the gooseneck 26 of a football goal post 20, according to one embodiment of the present invention. The gooseneck 22 comprises an outer tubular member 40 having a first portion 42 and a second portion 44. The first portion 42 of the outer tubular member 40 has a first end 42(*a*) and a second end 42(*b*). The second portion 44 of the outer tubular member 40 has a first end 44(*a*) and a second end 44(*b*). The second end 44(*b*) of the second portion 44 of the outer tubular member 40 is attached to the cross bar 22 of the goalpost 20 and the uprights 24 extend from the cross bar, as is known in the art and as is disclosed in FIGS. 1 and 13. The first end 42(*a*) of the first portion 42 of the outer tubular member 40 is secured to a mounting structure, such as the plate-mounting structure illustrated in FIGS. 1-10 and 11(*a*)-11(*c*) or the ground-sleeve-mounting structure illustrated in FIGS. 12-15, 16(*a*)-16(*c*), 17-21, 22(*a*)-22(*b*), 23, and 24(*a*)-24(*b*), both of which are well known in art.

The second end 42(*b*) of the first portion 42 of the outer tubular member 40 releasably engages the first end 44(*a*) of the second portion 44 of the outer tubular member 40 such that the second portion of the outer tubular member is structured to rotate relative to the first portion of the outer tubular member. In one embodiment, as illustrated in FIGS. 25 and 26, the rotating football goalpost 20 includes a first clamp ring 46 and second clamp ring 48. The first clamp ring 46 is positioned about the second end 42(*b*) of the first portion 42 of the outer tubular member 40. The second clamp ring 48 is positioned about the first end 44(*a*) of the second portion 44 of the outer tubular member 40. As discussed more fully below, the first and second clamp rings 46, 48 are structured to be releasably engaged to one another such that in a first state the clamp rings (and the first and second portions 42, 44 of the outer tubular member 40) are non-rotatable relative to one another and in a second state the clamp rings (and the first and second portions 42, 44 of the outer tubular member 40) are rotatable relative to one another.

The first and second clamp rings 46, 48 each comprise a flange 46(*a*), 48(*a*) and a cylindrical portion 46(*b*), 48(*b*), both of which have an inner diameter approximately equal to, but slightly greater than, the outer diameter of the outer tubular member 40 of the gooseneck 26 such that the first and second clamp rings can be positioned on the second end 42(*b*) of the first portion 42 of the outer tubular member 40 and the first end 44(*a*) of the second portion 44 of the outer tubular member 40, respectively. Preferably the fit between the first and second clamp rings 46, 48 on the second end 42(*b*) of the first portion 42 of the outer tubular member 40 and the first end 44(*a*) of the second portion 44 of the outer tubular member 40, respectively, is relatively tight. The first clamp ring 46 is secured to the second end 42(*b*) of the first portion 42 of the outer tubular member 40 and the second clamp ring 48 is secured to the first end 44(*a*) of the second portion 44 of the outer tubular member by welding and/or using mechanical fasteners. In one embodiment, as illustrated in FIGS. 26, 36(*a*) and (*b*), and 37(*a*) and (*b*), the first clamp ring 46 is secured to the second end 42(*b*) of the first portion 42 of the outer tubular member 40 and the second clamp ring 48 is secured to the first end 44(*a*) of the second portion 44 of the outer tubular member by one or more set screws 50, each through a corresponding aperture 47 in the first and second clamp rings. In addition to securing the first clamp ring 46 to the second end 42(*b*) of the first portion 42 of the outer tubular member 40 and the second clamp ring 48 to the first end 44(*a*) of the second portion 44, the set screws 50 in the flanges 46(*a*), 48(*a*) of the first and second clamp rings also can be used to stiffen and adjust the position of the first and second portions 42, 44 of the corresponding outer tubular member 40. As illustrated in FIG. 26, the set screws 50 extending through the apertures 47 in the cylindrical portions 46(*b*), 48(*b*) of the first and second clamp rings 46, 48 preferably extend into corresponding apertures that are pre-drilled in the first and second portions 42, 44 of the outer tubular member 40, respectively.

As discussed above, the first and second clamp rings 46, 48 are structured to be releasably engaged to one another such that in a first state the clamp rings (and first and second portions 42, 44 of the outer tubular member 40) are non-rotatable relative to one another and in a second state the clamp rings (and first and second portions 42, 44 of the outer tubular member) are rotatable relative to one another. As illustrated in FIGS. 26, 36(*a*) and (*b*), and 37(*a*) and (*b*), the first clamp ring 46 and the second clamp ring 48 each include one or more apertures 52 that are structured to receive either a threaded or non-threaded bolt. In the embodiment illustrated FIGS. 36(*a*) and (*b*) and 37(*a*) and (*b*), apertures 52(*a*) are threaded and structured to receive a threaded bolt whereas apertures 52(*b*) are unthreaded and structured to receive a shoulder bolt. In another embodiment of the present invention, one or more of apertures 52(*b*) can be structured to receive the shackle of a padlock (not shown) so that the first and second clamp rings 46, 48 can be locked together in the non-rotatable first state for safety and security purposes to prevent unauthorized rotation of the second portion 44 of the outer tubular member 40 relative to the first portion 42 of the outer tubular member. Preferably, the aperture(s) 52(*b*) are sized to be approximate to, but slightly greater than the diameter of the shackle to avoid wearing the inside of the aperture(s). The apertures 52(*b*) may be provided with bronze bushings (not shown) that can be replaced in the event of wear.

FIGS. 36(*a*) and (*b*) and 37(*a*) and (*b*) disclose dimensions for the first and second clamp rings 46, 48, according to one embodiment of the present invention. The first and second clamp rings 46, 48 are preferably formed of metal by casting or machining from stock material, or another material having substantial rigidity and strength. According to the embodiments illustrated in FIGS. 36(*a*) and (*b*) and 37(*a*) and (*b*), the first and second clamp rings 46, 48 the first and second clamp rings 46, 48 are formed of either 6061-T6 aluminum or 304 stainless steel.

When the first and second the clamp rings 46, 48 are locked in the first state (whether by a threaded or unthreaded bolt or the shackle of a lock, or a combination thereof) and are non-rotatable relative to one another, the first and second clamp rings provide support to the gooseneck 26 by securing the second end 42(*a*) of the second portion of the outer tubular member 40 and the first end 44(*a*) of the second portion 44 of the outer tubular member together.

In one embodiment, the first and second the clamp rings 46, 48 are preferably is covered with padding or an elastomeric material to prevent or mitigate injury should an athlete fall on or collide with the gooseneck 26.

Referring again to FIG. 25, rotation of the second portion 44 of the outer tubular member 40 relative to the first portion 42 of the outer tubular member is accomplished through a cartridge 60. As illustrated in FIG. 25 and FIGS. 30(*a*), (*b*), (*c*), and (*d*), the cartridge 60 comprises at least a shaft 62, a first rotation mechanism 80, and a second rotation mechanism 90. The shaft 62 has first and second ends 62(*a*), 62(*b*). The shaft 62 defines a first portion 64 and a second portion 66 wherein the diameter of the first portion 64 of the shaft is greater than the diameter of the second portion 66 of the shaft. The shaft 62 further defines a tapered portion 68 between the first portion 64 of the shaft and the second portion 66 of the shaft.

The shaft 62 can be constructed of hollow tubular members and/or of solid tubular members. Preferably the shaft 62 is constructed of metal or another material having substantial rigidity and strength, as the shaft must bear a substantial portion of the weight and shear forces generated by the gooseneck 26, cross bar 22 and uprights 24. The first portion 64, second portion 66 and tapered portion 68 of the shaft 62 can be separately formed components that are secured together by welding or mechanical fasteners or, alternatively, two or more of these components can be cast together as a unitary piece or machined from stock material. In the embodiment illustrated in FIG. 25 and FIGS. 30(*a*), (*b*), (*c*), and (*d*), the shaft 62 comprises a solid, unitary piece of 6061-T6 aluminum.

The shaft 62 can be secured to the first portion 42 of the outer tubular member 40 by welding or using mechanical fasteners. As illustrated in FIG. 25 and FIGS. 30(*a*), (*b*), and (*c*), the shaft 62 can included apertures 70 structured to receive the bolts shown in FIGS. 15 and 16(*c*) that secure the gooseneck 26 to the upper portion of the ground sleeve 15. For plate-mounted versions of the goalpost 20, apertures 70 are not necessary. Additional, as illustrated in FIG. 25, the shaft 62 and the first portion 42 of the outer tubular member 40 can be further secured together using set screws 72. In one embodiment, the set screws 72 are provided in pairs that are vertically spaced. There can be one or more pairs of these set screws 72. For purposes of example and not limitation, there can be two (2) sets of set screws 72, each set having one (1) pair, that are spaced 90 degrees or 180 degrees apart or four (4) sets, each set having one (1) pair, that are spaced 90 degrees apart.

As illustrated in FIGS. 25 and 26, the first rotation mechanism 80 is positioned about the first portion 64 of the shaft 62 adjacent the tapered portion 68 and near the junction of the first portion 42 of the outer tubular member 40 and the second portion 44 of the outer tubular member. The first rotation mechanism 80 comprises a radial and thrust load bearing structured to support the weight and shear load generated by the gooseneck 26, cross bar 22 and uprights 24, while at the same time enabling the second portion 44 of the outer tubular member 40 to rotate relative to the first portion 42 of the outer tubular member. The first rotation mechanism 80 can comprise a ball or roller bearing and, preferably, comprise a helical roller bearing, spherical-roller bearing or tapered roller bearing.

In an alternate embodiment, as illustrated in FIGS. 26, 31(*a*) and (*b*) and 32(*a*) and (*b*), the first rotation mechanism 80 comprises an outer race 82 formed of 304 stainless steel and an inner race 84 formed of bearing bronze. Other bearing materials, such as nylon, may alternatively be used between the shaft 62 and the second portion 44 of the outer tubular member. As illustrated in FIG. 26, the shaft 62 includes a shoulder or notched area 74 on which the inner race 84 is seated. The inner race 84 can be secured to the shaft 62 by welding or using mechanical fasteners. As illustrated in FIGS. 26 and 30(*a*), the inner race 84 is secured to the shaft 62 by a pair of set screws 86 that are screwed through corresponding apertures 86(*a*) in the inner race and into apertures 86(*b*) in the shaft and that are spaced 180 degrees apart. Four (4) set screws 86 at 90 degrees apart can be used as well. As illustrated in FIGS. 32(*a*) and (*b*), the inner race 84 has a substantially cylindrical configuration with an inner diameter approximately equal to, but slightly larger than, the outer diameter of the second portion 66 of the shaft 62.

As illustrated in FIGS. 26, 31(*a*) and (*b*), the outer race 82 has an L-shaped configuration comprising a base 82(*a*) and a flange 82(*b*) extending therefrom. The base 82(*a*) and flange 82(*b*) define a shoulder or notched area 83 having a width approximately equal to the thickness of the inner race 84 such that the outer race 82 is structured to be slidably seated on the inner race. As illustrated in FIGS. 31(*a*) and (*b*), the base 82(*a*) has a substantially cylindrical configuration with an inner diameter approximately equal to, but slightly larger than, the outer diameter of the second portion 66 of the shaft 62 and the flange 82(*b*) has a substantially cylindrical configuration with an inner diameter approximately equal to, but slightly larger than, the outer diameter of the inner race 84. The outer diameter of the base 82(*a*) and a flange 82(*b*) are the same and are approximately equal to, but slightly smaller than, the inner diameter of the second portion 44 of the outer tubular member 40 to ensure a relatively tight fit between the outer race 82 and the interior of the second portion 44 of the outer tubular member.

Referring to FIG. 26, in one embodiment, the set screws 50 extending through the apertures 47 in the cylindrical portion 48(*b*) of the second clamp ring 48 may extend through the corresponding apertures pre-drilled in the second portion 44 of the outer tubular member 40 so that the set screws are in contact with the outer race 82 to secure the outer race to the second portion 44 of the outer tubular member. In one embodiment, the outer race 82 defines apertures that receive the ends of the set screws and, in other embodiments, the ends just contact the outer surface of the base 82(*a*).

As illustrated in FIGS. 25 and 27, the second rotation mechanism 90 is positioned about the second end 62(*b*) of the shaft 62. The second rotation mechanism 90 comprises a radial and thrust load bearing structured to support the weight and shear load generated by the gooseneck 26, cross bar 22 and uprights 24, while at the same time enabling the second portion 44 of the outer tubular member 40 to rotate relative to the first portion 42 of the outer tubular member. The second rotation mechanism 90 can comprise a ball or roller bearing and, preferably, comprise a helical roller bearing, spherical-roller bearing or tapered roller bearing.

In an alternate embodiment, as illustrated in FIGS. 26, 33(*a*) and (*b*) and 34(*a*) and (*b*), the second rotation mechanism 90 comprises an outer race 92 formed of 304 stainless steel and an inner race 94 formed of bearing bronze. Other bearing materials, such as nylon, may alternatively be used between the shaft 62 and the second portion 44 of the outer tubular member 40. As illustrated in FIGS. 26 and 30(*a*), the second end 62(*b*) of the shaft 62 defines a shoulder or notched area 76 having a reduced diameter on which the inner race 94 is seated. The inner race 94 can be secured to the shaft 62 by welding or using mechanical fasteners. As illustrated in FIGS. 26 and 30(*a*), the inner race 94 is secured to the shaft 62 by a pair of set screws 96 that are screwed through corresponding apertures 96(*a*) in the inner race and into apertures 96(*b*) in the shaft and that are spaced 180 degrees apart. Four (4) set screws 96 at 90 degrees apart can be used as well. As illustrated in FIGS. 34(*a*) and (*b*), the inner race 94 has a substantially cylindrical configuration with an inner diameter approximately equal to, but slightly larger than, the outer diameter of the second end 62(*b*) of the shaft 62 at the shoulder or notched area 76.

As illustrated in FIG. 26 and FIGS. 33(*a*) and (*b*), the outer race 92 has an L-shaped configuration comprising a base 92(*a*) and a flange 92(*b*) extending therefrom. The base 92(*a*) and flange 92(*b*) define a shoulder or notched area 93 having a width approximately equal to the thickness of the inner race 94 such that the outer race 92 is structured to be slidably seated on the inner race. As illustrated in FIGS. 33(*a*) and (*b*), the base 92(*a*) has a substantially cylindrical configuration with an inner diameter approximately equal to, but slightly larger than, the outer diameter of the second end 62(*b*) of the shaft 62 at the shoulder or notched area 76 and the flange 92(*b*) has a substantially cylindrical configuration with an inner diameter approximately equal to, but slightly larger than, the outer diameter of the inner race 94. The outer diameter of the base 92(*a*) and a flange 92(*b*) are the same and are approximately equal to, but slightly smaller than, the inner diameter of the second portion 44 of the outer tubular member 40 to ensure a relatively tight fit between the outer race 92 and the interior of the second portion 44 of the outer tubular member.

Referring to FIGS. 27 and 35(*a*) and (*b*), in one embodiment, the set screws extending through the apertures 108 in the support band 104 may extend through the corresponding apertures pre-drilled in the second portion 44 of the outer tubular member 40 so that the set screws are in contact with the outer race 92 to secure the outer race to the second portion 44 of the outer tubular member. In one embodiment, the outer race 92 defines apertures that receive the ends of the set screws and, in other embodiments, the ends just contact the outer surface of the base 92(*a*).

The first rotation mechanism 80 and the second rotation mechanism 92 cooperate to allow the second portion 44 of the outer tubular member 40 of the gooseneck 26 (including the cross bar 22 and the uprights 24) to rotate relative to the first portion 42 of the outer tubular member and the shaft 62 when the first and second clamp rings 46, 48 are in the second state (i.e., are not secured together). More specifically, the outer race 82 of the first rotation mechanism 80 and the outer race 92 of the second rotation mechanism 90 slide upon the inner race 84 of the first rotation mechanism and the inner race 94 of the second rotation mechanism, respectively, to allow the second portion 44 of the outer tubular member 40 of the gooseneck 26 (including the cross bar 22 and the uprights 24) to rotate relative to the first portion 42 of the outer tubular member, the shaft 62, the inner race 84 of the first rotation mechanism and the inner race 94 of the second rotation mechanism.

Referring to FIGS. 25, 27, 30(*a*) and (*d*), and 38 (*a*) and (*b*), the cartridge 60 may also include an end cap or cap 78. As illustrated in FIG. 27, the outer race 92 of the second rotation mechanism includes a shoulder or notched area 95 structured to slidably receive the cap 78. The cap 78 may be attached to the second end 62(*b*) of the shaft 62 by welding or using mechanical fasteners. As illustrated in FIGS. 30(*a*) and (*d*) and 38 (*a*) and (*b*), the cap 78 is attached to the second end 62(*b*) of the shaft 62 using four (4) screws 79 received in apertures 79(*a*) of the shaft 62 and 79(*b*) of the end cap. The purpose of the cap 78 is to slidably secure and retain the outer race 92 to, and as part of, the cartridge 60 during installation of the cartridge into the outer tubular member 40. In an alternate embodiment (not shown), the exterior of the upper edge of the second end 62(*b*) of the shaft 62 may be notched so as to receive a snap or shrink-fitted ring made of metal, nylon or another synthetic material and that is structure to slidably retain the outer race 92 against the inner race 94 during installation of the cartridge 60 into the outer tubular member 40.

Referring to FIGS. 28, 29, and 30, in one embodiment, the cartridge 60 may also include a support tube 104 positioned inside the outer tubular member 40 and outside at least a portion of the shaft 62. The support tube 104 extends from the first rotation mechanism 80 to the second rotation mechanism 90. The purpose of the support tube 104 is to provide stiffen and provide additional support to the second portion 44 of the outer tubular member 40.

Referring to FIG. 27, the second portion 44 of the outer tubular member 40 of the gooseneck 26 may further include an end member 100 structured to distribute the weight and shear load generated by the gooseneck 26, cross bar 22 and uprights 24 to the outer race 92 of the second rotational mechanism 90. As illustrated in FIG. 27, the outer tubular member 40 comprises a pair of apertures 102 positioned between the first end 44(*a*) and the second end 44(*b*) of the second portion 44 of the outer tubular member. The end member 100 is structured to extend through the pair of apertures 102 in the second portion 44 of the outer tubular member 40 and to be in contact with the second rotation mechanism 90 and, more specifically, the outer race 92 of the second rotation mechanism, to at least partially transfer the weight and shear load generated by the gooseneck 26, cross bar 22 and uprights 24 to the second rotation mechanism. In one embodiment, the end member 100 is structured to be in slidable contact with the end cap 78, if one is used, or the second end 62(*b*) of the shaft 62, if no end cap is used, to at least partially transfer the weight and shear load generated by the gooseneck 26, cross bar 22 and uprights 24 to the shaft. As illustrated in FIG. 27, the end member 100 may comprise a bolt extending through the second portion 44 of the outer tubular member 40 secured using a nut (or a nut and washer).

According to one embodiment, as illustrated in FIGS. 27 and 35(*a*) and (*b*), the gooseneck 26 may further include a support band 104 positioned about the second portion 44 of the outer tubular member 40 where the end member 100 is inserted. The support band 104 has a substantially cylindrical configuration with an inner diameter approximately equal to, but slightly larger than, the outer diameter of the outer tubular member 40. The support band 104 has a pair of apertures 106 structured to receive the end member 100 and that correspond to apertures 102 in the second portion 44 of the outer tubular member 40. The support band 104 may also include threaded apertures 108 structured to receive a set screws (not shown) to further secure the support band to the second portion 44 of the outer tubular member 40. These set screws may extend through corresponding apertures pre-drilled into in the second portion 44 of the outer tubular member 40. As illustrated in FIG. 35(*b*), the support band 104 includes three apertures 108 spaced at approximately 120 degree increments. Other spacing configurations may be used. The purpose of the support band 104 is to provide additional support to the outer tubular member 40 where the end member 100 is inserted, as the apertures 102 may create stress concentrations in the outer tubular member 40 and areas potentially subject to fatigue.

Referring to FIGS. 40(*a*) and (*b*), there is illustrated a tool 110 that can be used to rotate the second portion 44 of the outer tubular member 40 relative to the first portion 42 of the outer tubular member. The tool 110 comprises a handle 112 (that may include an elastomeric grip), an engagement member 114, and an engagement recess 116. The length of the handle 112 may vary, but it has been determined that a handle of approximately four (4) feet provides sufficient leverage to reduce the required force to rotate the second portion 44 of the outer tubular member 40 relative to the first portion 42 to approximately twenty-five (25) lbs (i.e., one hundred (100) ft/lbs of total torque or twenty-five (25) lbs at a distance of four (4) feet). The handle has first and second ends 112(*a*) and (*b*). The first end 112 of the handle 112 may include a ribbed surface or may be covered at least partially with an elastomeric material or cover having a ribbed surface or other raised areas to provide sufficient friction for the user to firmly grip the handle.

The engagement member 114 extends from the second end 112(*b*) of the handle 112 and is attached to the handle by welding, using mechanical fasteners or a bracket and mechanical fasteners. The engagement member 114 is configured to have a curvature that is substantially the same as the curvature of the outer tubular member 40, if no support band 104 is used, or the curvature of the support band, if one is used. The length of the engagement member 114 can vary, but preferably the length is such that the engagement member extends at least 90 degrees and, more preferably, 180 degrees, around the outer tubular member 40, if no support band 104 is used, or around the support band, if one is used. The engagement member 114 preferably is covered with padding or an elastomeric material to prevent scratching or marring of the surface of the outer tubular member 40, if no support band 104 is used, or support band, if one is used, as scratches may result in rusting or discoloration. The engagement member 114 has first and second ends 114(*a*), 114(*b*). The first end 114(*a*) of the engagement member defines an engagement recess 116, which is configured to matingly engage the head of the end member 100, or the nut securing the end member, similar to a socket of a socket wrench. The engagement recess 116 may comprise either a recessed area (like a socket of a socket wrench) or an aperture extending through the first end 114(*a*) of the engagement member 114.

The tool 110 may be constructed of a variety of materials. In one embodiment, the tool 110 is constructed of aluminum or another relatively strong, but lightweight metal.

To use the tool 110, the head of the end member 100 (or the nut securing the engagement member) is positioned inside the engagement recess 116 and then the tool is pivoted so that the second end 114(*b*) of the engagement member 114 is urged toward and in contact with the surface of the outer tubular member 40, if no support band 104 is used, or the surface of the support band, if one is used. In this position, the handle will extend beyond the side of the gooseneck 26. The user will then push the handle 112 of the tool 110 in a manner to push the second end 114 of the engagement member 114 against the outer tubular member 40, if no support band 104 is used, or the surface of the support band, if one is used. If the gooseneck 26 is configured for rotation only in a particular direction, the tool must be oriented such that the user is pushing in the required direction.

The present invention also provides a method for retrofitting the gooseneck 16 of an existing football goalpost 10, as illustrated in FIG. 41, so that the gooseneck 16 is converted into a rotatable gooseneck 26. According to one embodiment, as illustrated in FIGS. 43(*a*) and (*b*), the method comprises providing a gooseneck comprising a tubular outer member. See Block 120. The provision of the gooseneck will likely include removing the football goalpost 10 from its mounting structure, which may comprise removing the gooseneck 16 from the ground sleeve 15 or decoupling the plate 18 from the concrete foundation 19. The outer tubular member is then cut into a first portion and a second portion, each of the first and second portions of the tubular outer member comprising first and second ends. See Block 122. A cartridge is then provided. See Block 124. In one embodiment, the cartridge comprises a shaft having first and second ends, the shaft defining a first portion and a second portion wherein the diameter of the first portion of the shaft is greater than the diameter of the second portion of the shaft, the shaft defining a tapered portion between the first portion of the shaft and the second portion of the shaft. The cartridge further comprises first and second rotation mechanisms, the first rotation mechanism positioned about the second portion of the shaft adjacent the tapered portion, the second rotation mechanism positioned about the second end of the shaft. In one embodiment, a support tube positioned outside at least a portion of the shaft, the support tube extending from the first rotation mechanism to the second rotation mechanism. The cartridge is then inserted into the first portion of the outer tubular member and the second portion of the outer tubular member such that the shaft extends at least partially into the first portion of the outer tubular member and extends at least partially into the second portion of the outer tubular member such that the first end of the shaft is located inside the first portion of the outer tubular member and the second end of the shaft is located inside the second portion of the outer tubular member and the first rotation mechanism is adjacent the second end of the first portion of the outer tubular member and the first end of the second portion of the outer tubular member. See Block 126. The shaft is then secured to the first portion of the outer tubular member and wherein the first and second rotation mechanisms of the cartridge are structured so that the second portion of the outer tubular member is rotatable relative to the first portion of the outer tubular member and about the shaft. See Block 128.

In one embodiment, first and second clamp rings are attached to the outer tubular member, the first clamp ring positioned about the second end of the first portion of the outer tubular member, the second clamp ring positioned about the first end of the second portion of the outer tubular member, the clamp rings structured to be releasably engaged to one another such that in a first state the clamp rings are non-rotatable relative to one another and in a second state the clamp rings are rotatable relative to one another and wherein the first and second rotation mechanisms of the cartridge are structured so that when the clamp rings are in the second state, the second portion of the outer tubular member is rotatable relative to the first portion of the outer tubular member and about the shaft. See Block 130. In one embodiment, forming a pair of apertures in the second portion of the outer tubular member and inserting an end member into the apertures in the second portion of the outer tubular member, wherein the end member is in contact with the second rotation mechanism. See Block 132.

Specific embodiments of the invention are described herein. Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A rotatable football goalpost, the goalpost comprising:

a mounting structure;

a gooseneck, said gooseneck comprising an outer tubular member having first and second portions, each of said first and second portions of said outer tubular member having first and second ends, said first end of said first portion of said outer tubular member being secured to said mounting structure, wherein the second end of the first portion and the first end of the second portion each comprise a planar surface having the same diameter, and wherein the second end of the first portion abuts the first end of the second portion without overlapping;

a cross bar attached to said second end of said second portion of said outer tubular member;

a pair of upright members extending from said cross bar;

a shaft having first and second ends, said shaft defining a first portion and a second portion wherein the diameter of said first portion of said shaft is greater than the diameter of said second portion of said shaft, said shaft defining a tapered portion between said first portion of said shaft and said second portion of said shaft, wherein said shaft is configured to be secured to the first portion of the outer tubular member; and first and second rotation mechanisms, said first rotation mechanism positioned about said first portion of said shaft adjacent said tapered portion, said second rotation mechanism positioned about said second end of said shaft, and wherein at least a portion of said first and second rotation mechanisms is configured (i) to be secured to the second portion of the outer tubular member of the gooseneck so that the second end of the first portion and the first end of the second portion abut without overlapping (ii) to rotate about said shaft such that the second portion of the outer tubular member of the gooseneck rotates relative to the first portion of the outer tubular member of the gooseneck.

2. A rotatable football goalpost according to claim 1, wherein said second portion of outer tubular member comprises a pair of apertures positioned between said first end and said second end of said second portion of said outer tubular member and wherein said gooseneck further comprises an end member extending through said pair of apertures in said second portion of said outer tubular member, said end member being in contact with said second rotation mechanism to at least partially transfer the weight of said second portion of said outer tubular member and said cross bar and said pair of uprights to said second rotation mechanism.

3. A rotatable football goalpost according to claim 1, wherein said gooseneck further comprises:

first and second clamp rings, said first clamp ring positioned about said second end of said first portion of said outer tubular member, said second clamp ring positioned about said first end of said second portion of said outer tubular member, said first and second clamp rings structured to be releasably engaged to one another such that in a first state said clamp rings are non-rotatable relative to one another and in a second state said clamp rings are rotatable relative to one another.

4. A rotatable football goalpost according to claim 1, wherein said gooseneck further comprises:

a support tube positioned inside said outer tubular member and outside at least a portion of said shaft, said support tube extending from said first rotation mechanism to said second rotation mechanism.

5. A cartridge for retrofitting the gooseneck of a football goal post comprising an outer tubular member having first and second portions, each of the first and second portions of the outer tubular member comprising first and second ends, wherein the second end of the first portion and the first end of the second portion each comprise a planar surface having the same diameter, and wherein the second end of the first portion abuts the first end of the second portion without overlapping, the cartridge comprising:

a shaft having first and second ends, said shaft defining a first portion and a second portion wherein the diameter of said first portion of said shaft is greater than the diameter of said second portion of said shaft, said shaft defining a tapered portion between said first portion of said shaft and said second portion of said shaft, wherein said shaft is configured to be secured to the first portion of the outer tubular member; and first and second rotation mechanisms, said first rotation mechanism positioned about said first portion of said shaft adjacent said tapered portion, said second rotation mechanism positioned about said second end of said shaft, and wherein at least a portion of said first and second rotation mechanisms is (i) secured to the second portion of the outer tubular member of the gooseneck so that the second end of the first portion and the first end of the second portion abut without overlapping and (ii) to rotate about said shaft such that the second portion of the outer tubular member of the gooseneck rotates relative to the first portion of the outer tubular member of the gooseneck.

6. A cartridge according to claim 5, further comprising:

a cap secured to said second end of said shaft.

7. A cartridge according to claim 6, further comprising:

a support tube positioned outside at least a portion of said shaft, said support tube extending from said first rotation mechanism to said second rotation mechanism.

8. A cartridge according to claim 5, wherein at least one of said first and second rotation mechanism comprises a radial and thrust load bearing.

9. A cartridge according to claim 5, wherein at least one of said first and second rotation mechanism comprises an outer race and an inner race.

10. A method for retrofitting the gooseneck of a football goalpost so that the gooseneck is rotatable, the method comprising:

providing a gooseneck comprising a tubular outer member;

cutting the outer tubular member into a first portion and a second portion, each of the first and second portions of the tubular outer member comprising first and second ends, wherein the second end of the first portion and the first end of the second portion each comprise a planar surface having the same diameter;

providing a cartridge, the cartridge comprising:

a shaft having first and second ends, the shaft defining a first portion and a second portion wherein the diameter of the first portion of the shaft is greater than the diameter of the second portion of the shaft, the shaft defining a tapered portion between the first portion of the shaft and the second portion of the shaft; and first and second rotation mechanisms;

inserting the cartridge into the first portion of the outer tubular member and the second portion of the outer tubular member such that the shaft extends at least partially into the first portion of the outer tubular member and extends at least partially into the second portion of the outer tubular member such that the first end of the shaft is located inside the first portion of the outer tubular member and the second end of the shaft is located inside the second portion of the outer tubular member and the first rotation mechanism is adjacent the second end of the first portion of the outer tubular member and the first end of the second portion of the outer tubular member, and wherein the second end of the first portion abuts the first end of the second portion without overlapping;

securing the shaft to the first portion of the outer tubular member such that the first rotation mechanism is positioned about the first portion of the shaft adjacent the tapered portion; and securing the shaft to the second portion of the outer tubular member such that the second rotation mechanism is positioned about the second end of the shaft, and wherein at least a portion of said first and second rotation mechanisms is configured to be secured to the second portion of the outer tubular member of the gooseneck so that the abutting ends of the first and second portions of the outer tubular member are aligned and not overlapping and wherein the first and second rotation mechanisms of the cartridge are structured so that the second portion of the outer tubular member is rotatable relative to the first portion of the outer tubular member and about the shaft.

11. A method of retrofitting a gooseneck as provided in claim 10, further comprising:

attaching first and second clamp rings to the outer tubular member, the first clamp ring positioned about the second end of the first portion of the outer tubular member, the second clamp ring positioned about the first end of the second portion of the outer tubular member, the clamp rings structured to be releasably engaged to one another such that in a first state the clamp rings are non-rotatable relative to one another and in a second state the clamp rings are rotatable relative to one another and wherein the first and second rotation mechanisms of the cartridge are structured so that when the clamp rings are in the second state, the second portion of the outer tubular member is rotatable relative to the first portion of the outer tubular member and about the shaft.

12. A method of retrofitting a gooseneck as provided in claim 10, wherein the cartridge further comprises:

a support tube positioned outside at least a portion of the shaft, the support tube extending from the first rotation mechanism to the second rotation mechanism.

13. A method of retrofitting a gooseneck as provided in claim 10, further comprising:

forming a pair of apertures in the second portion of the outer tubular member; and inserting an end member into the apertures in the second portion of the outer tubular member, wherein the end member is in contact with the second rotation mechanism.

14. A football goalpost kit, the kit comprising:

a rotatable football goalpost, the goalpost comprising:

a mounting structure;

a gooseneck, said gooseneck comprising an outer tubular member having first and second portions, each of said first and second portions of said outer tubular member having first and second ends, wherein the second end of the first portion and the first end of the second portion each comprise a planar surface having the same diameter, and wherein the second end of the first portion abuts the first end of the second portion without overlapping;

a cross bar attached to said second end of said second portion of said outer tubular member;

a pair of upright members extending from said cross bar;

a shaft having first and second ends, said shaft defining a first portion and a second portion wherein the diameter of said first portion of said shaft is greater than the diameter of said second portion of said shaft, said shaft defining a tapered portion between said first portion of said shaft and said second portion of said shaft, wherein said shaft is configured to be secured to the first portion of the outer tubular member; and first and second rotation mechanisms, said first rotation mechanism positioned about said first portion of said shaft adjacent said tapered portion, said second rotation mechanism positioned about said second end of said shaft, and wherein at least a portion of said first and second rotation mechanisms is configured (i) to be secured to the second portion of the outer tubular member of the gooseneck so that the second end of the first portion and the first end of the second portion abut without overlapping (ii) to rotate about said shaft such that the second portion of the outer tubular member of the gooseneck rotates relative to the first portion of the outer tubular member of the gooseneck a tool for rotating the first portion of the gooseneck of the football goalpost relative to the second portion, the tool comprising:

a handle having first and second ends; and an engagement member attached to a first end of said handle, said engagement member having first and second ends, and wherein said first end of said engagement member defines a engagement recess.

15. A kit according to claim 14, wherein said engagement recess defines an aperture extending through said first end of said engagement member.

16. A kit according to claim 14, wherein said engagement member defines an inside surface, and further comprising an elastomeric cover attached to at least a portion of said engagement member and covering at least a portion of said inside surface of said engagement member.

* * * * *